US010549247B2

(12) United States Patent
Schwartz

(10) Patent No.: US 10,549,247 B2
(45) **Date of Patent: *Feb. 4, 2020**

(54) PORTABLE CUSTOM NAIL POLISH CREATOR

(71) Applicant: Eric D. Schwartz, Palm Beach Gardens, FL (US)

(72) Inventor: Eric D. Schwartz, Palm Beach Gardens, FL (US)

( * ) Notice: Subject to any disclaimer, the term of this patent is extended or adjusted under 35 U.S.C. 154(b) by 171 days.

This patent is subject to a terminal disclaimer.

(21) Appl. No.: 14/629,806

(22) Filed: Feb. 24, 2015

(65) Prior Publication Data

US 2015/0231582 A1 Aug. 20, 2015

Related U.S. Application Data

(63) Continuation-in-part of application No. 13/053,912, filed on Mar. 22, 2011, now Pat. No. 8,960,994.
(Continued)

(51) Int. Cl.

| | |
|---|---|
| ***B01F 13/10*** | (2006.01) |
| ***B01F 15/00*** | (2006.01) |
| ***A45D 34/00*** | (2006.01) |
| ***A45D 44/00*** | (2006.01) |
| ***G07F 13/06*** | (2006.01) |
| ***B01F 7/00*** | (2006.01) |

(Continued)

(52) U.S. Cl.

CPC ..... *B01F 13/1055* (2013.01); *A45D 34/00* (2013.01); *A45D 44/005* (2013.01); *B01F 7/00716* (2013.01); *B01F 7/161* (2013.01); *B01F 7/32* (2013.01); *B01F 13/1058* (2013.01); *B01F 13/1063* (2013.01); *B01F 15/00019* (2013.01); *B01F 15/00025* (2013.01); *B01F 15/00214* (2013.01); *B01F 15/0237* (2013.01); *G07F 13/06* (2013.01); *B01F 2215/005* (2013.01); *B01F 2215/0031* (2013.01)

(58) Field of Classification Search

CPC ..... B01F 13/1058; B01F 2215/005; B01F 13/1055; B01F 15/0458; B01F 2215/0031; B01F 13/00; B01F 15/00019; B01F 15/00214; A45D 34/00; A45D 44/005; G07F 13/06

USPC ..... 366/140, 197; 356/425

See application file for complete search history.

(56) References Cited

U.S. PATENT DOCUMENTS

| | | | |
|---|---|---|---|
| 4,403,866 | A | 9/1983 | Falcoff et al. |
| 4,637,527 | A | 1/1987 | Arrigoni |

(Continued)

*Primary Examiner* — Tony G Soohoo

(74) *Attorney, Agent, or Firm* — Akerman LLP; Mammen (Roy) P. Zachariah, Jr.

(57) ABSTRACT

A nail polish creator is provided. The nail polish creator may include a processor that can receive a selection of the nail polish color from a device communicatively linked with the nail polish creator, such as via a wireless communication. Once the selection is received, the processor may determine an amount of one or more nail polish colors that are needed to create a nail polish corresponding to the selection. The nail polish creator may further include an assembly that may receive a nail polish bottle so that the nail polish bottle is in a position to receive the nail polish that is created based on the amount of the nail polish colors needed to create the nail polish. Moreover, the nail polish creator may include a mixer assembly for mixing the nail polish in the nail polish bottle.

20 Claims, 57 Drawing Sheets

Related U.S. Application Data

(60) Provisional application No. 61/316,260, filed on Mar. 22, 2010.

(51) Int. Cl.

| | |
|---|---|
| ***B01F 7/16*** | (2006.01) |
| ***B01F 7/32*** | (2006.01) |
| ***B01F 15/02*** | (2006.01) |

(56) References Cited

U.S. PATENT DOCUMENTS 4,705,083 A * 11/1987 Rossetti ..... B01F 13/1055 141/1
4,871,262 A * 10/1989 Krauss ..... B01F 13/1055 222/135
5,778,901 A 7/1998 Abrahamian
5,836,169 A * 11/1998 Marlette ..... A47J 31/007 62/331
5,904,421 A * 5/1999 Mazzalveri ..... B01F 9/00 366/209
5,938,080 A 8/1999 Haaser et al.
6,000,837 A * 12/1999 Randsborg ..... B01F 13/1055 366/141
6,010,032 A 1/2000 Vermylen et al.
6,052,195 A 4/2000 Mestha et al.
6,056,158 A * 5/2000 Rossetti ..... B67D 7/0216 222/100
6,067,996 A 5/2000 Weber et al.
6,177,093 B1 1/2001 Lombardi et al.
6,202,895 B1 3/2001 Fox
6,273,298 B1 8/2001 Post et al.
6,286,517 B1 9/2001 Weber et al.
6,288,783 B1 9/2001 Auad
6,516,245 B1 2/2003 Dirksing et al.
6,603,550 B1 8/2003 Flynn et al.
6,622,064 B2 * 9/2003 Bartholomew ..... A45D 29/00 222/144
6,655,551 B2 12/2003 Manne
6,715,642 B2 4/2004 Engel et al.
6,769,462 B2 8/2004 Larson et al.
6,935,386 B2 * 8/2005 Miller ..... B01F 13/1055 141/104
6,986,442 B2 1/2006 Engel et al.
7,099,740 B2 8/2006 Bartholomew et al.
7,318,484 B2 * 1/2008 Rousseau ..... A62C 13/003 169/77
7,395,134 B2 7/2008 Bartholomew et al.
7,445,372 B1 11/2008 Engel et al.
7,475,710 B2 1/2009 Bartholomew et al.
7,565,860 B1 * 7/2009 Liu ..... A47J 31/10 99/291
8,960,994 B2 * 2/2015 Schwartz ..... A45D 34/00 366/140
2002/0167663 A1 11/2002 Martino et al.
2003/0062385 A1 4/2003 Engel et al.
2003/0158788 A1 8/2003 Turpin et al.
2003/0192616 A1 10/2003 Larson et al.
2003/0198125 A1 * 10/2003 Linsen ..... B01F 13/1066 366/152.1
2003/0214878 A1 * 11/2003 Huckby ..... B01F 9/0001 366/217
2004/0108015 A1 6/2004 Bartholomew et al.
2004/0122553 A1 * 6/2004 Phan ..... A45D 44/005 700/233
2004/0135859 A1 7/2004 German et al.
2004/0143367 A1 * 7/2004 Bartholomew ..... A45D 29/00 700/239
2004/0164096 A1 8/2004 Engel et al.
2006/0000852 A1 1/2006 Manne
2006/0124196 A1 6/2006 Bartholomew et al.
2006/0283720 A1 12/2006 Minnella
2007/0189995 A1 8/2007 Weber et al.
2008/0047972 A1 * 2/2008 Bartholomew ..... A45D 44/005 222/1
2008/0087659 A1 * 4/2008 Norman ..... A47J 36/2438 219/521
2008/0225637 A1 9/2008 Hogan
2009/0161484 A1 6/2009 Tarallo
2010/0116843 A1 5/2010 Bartholomew et al.
2010/0116845 A1 5/2010 Penciu
2011/0226803 A1 * 9/2011 Schwartz ..... A45D 34/00 222/1
2012/0152406 A1 * 6/2012 Bartholomew ..... B65B 25/00 141/104
2012/0216911 A1 8/2012 Bartholomew et al.
2013/0128686 A1 5/2013 Bartholomew et al.
2013/0338821 A1 * 12/2013 Igarashi ..... B67D 7/08 700/233
2014/0081463 A1 3/2014 Igarashi
2014/0094964 A1 4/2014 Bartholomew et al.
2015/0231582 A1 * 8/2015 Schwartz ..... B01F 13/1055 366/142
2016/0107133 A1 * 4/2016 Sugino ..... B01F 13/1063 366/142

* cited by examiner

100

PORTABLE CUSTOM NAIL POLISH CREATOR

RELATED APPLICATIONS AND PRIORITY

The present application is a continuation-in-part of and claims the benefit of U.S. patent application Ser. No. 13/053,912 filed on Mar. 22, 2011, which claims priority to U.S. Provisional Application No. 61/316,260, filed Mar. 22, 2010, each of which are hereby incorporated by reference in their entireties.

FIELD OF THE INVENTION

The present application relates to cosmetics and providing color selection options, and, more particularly, to a portable custom nail polish creator.

BACKGROUND

Personal cosmetics such as nail polish, skin lotions, makeup and other similar products are widely utilized and very popular all around the world. Currently, the cosmetics industry is a profitable business for many manufacturers because of the ever-increasing demand for such personal care products. This demand will only increase as people around the world have become significantly more interested in their personal appearance. Technological advances and developments have provided customers with not only many new different types of cosmetics, but also more effective and specialized cosmetics. Despite such advances, most customers still have to go to a beauty salon, cosmetics store, or other similar location to view, sample, and purchase the cosmetics. For example, many customers go to cosmetics stores to view a wide range of nail polish colors and nail polish cleaning solutions. Typically, such customers desire to choose colors that properly match their skin tones, clothes, and accessories. The color matching and selection process can be very time consuming, especially when provided with so many options and also having to deal with other customers as well. Additionally, despite often having many options, the customer may ultimately end up not finding a matching nail polish color at the store location, which will cause the customer to go elsewhere. The customer may find even more options online, however, the customer often cannot sample the cosmetics beforehand and the colors viewed on a web page may appear different than color of the actual product.

SUMMARY

In accordance with one aspect of the exemplary embodiments provided herein, a portable nail polish creator may be provided. The portable nail polish creator may include a user interface for enabling a user to generate a selection of a nail polish color of a plurality of nail polish colors. Additionally, the portable nail polish creator may include an electronic processor communicatively linked to the user interface. The electronic processor may receive the selection of the nail polish color from the user via the user interface and determine an amount of at least one of the plurality of nail polish colors to be used to create a nail polish corresponding to the selection. The portable nail polish creator may also include an arm assembly that may be communicatively linked with the electronic processor. The arm assembly may receive a signal from the electronic processor to move a nail polish bottle in position to receive the nail polish based on the amount of at least one of the plurality of nail polish colors determined by the electronic processor. Furthermore, the portable nail polish creator may include a mixer assembly for mixing the nail polish in the nail polish bottle. The arm assembly may position the nail polish bottle in position to enable the nail polish to be mixed by the mixer assembly after the nail polish is received in the nail polish bottle.

In accordance with another exemplary embodiment, a method for utilizing a portable nail polish creator, which may include, but is not limited to including: selecting a nail polish color of a plurality of nail polish colors via a user interface of the portable nail polish creator; determining an amount of at least one of the plurality of nail polish colors to create a nail polish corresponding to the selected nail polish color, wherein the determining may be performed by an electronic processor; positioning a nail polish bottle in position to receive the nail polish from at least one pigment bottle; dispensing the nail polish from the at least one pigment bottle into the nail polish bottle based on the amount of at least one of the plurality of nail polish colors determined by the electronic processor to create the nail polish; and mixing the nail polish in the nail polish bottle by utilizing a mixer assembly after the nail polish from the at least one pigment bottle is dispensed into the nail polish bottle.

In accordance with another exemplary embodiment, a portable nail polish creator kit may be provided. The portable nail polish creator kit may include a user interface for enabling a user to generate a selection of a nail polish color; an electronic processor configured to receive the selection of the nail polish color from the user via the user interface, and wherein the electronic processor is configured to determine an amount of at least one of the plurality of nail polish colors to create a nail polish corresponding to the selection; an arm assembly for positioning a nail polish bottle in position to receive the nail polish based on the amount of at least one of the plurality of nail polish colors determined by the electronic processor; and a mixer assembly for mixing the nail polish in the nail polish bottle after the nail polish is received in the nail polish bottle.

In accordance with another exemplary embodiment, another nail polish creator may be provided. The nail polish creator may include a memory that stores instructions and an electronic processor that executes the instructions from the memory to perform the operations of the nail polish creator. The electronic processor may receive a selection of a nail polish color from a device communicatively linked with the nail polish creator. The selection may be received, such as via a wireless communication link between the device and the nail polish creator. Once the selection is received, the electronic processor may determine an amount of one or more nail polish colors needed to create a nail polish corresponding to the selection. The nail polish creator may also include an assembly that is configured to receive a nail polish bottle so that the nail polish bottle may be in a position to receive the nail polish. Furthermore, the nail polish creator may include a mixer assembly for mixing the nail polish after the nail polish is received in the nail polish bottle.

In accordance with another exemplary embodiment, another nail polish creator may be provided. The nail polish creator may include a memory that stores instructions and an electronic processor that executes the instructions from the memory to perform the operations of the nail polish creator. The electronic processor may receive a selection of a nail polish color from a device communicatively linked with the nail polish creator. The selection may be received, such as via a wireless communication link between the device and the nail polish creator. Once the selection is received, the electronic processor may determine an amount of one or more nail polish colors needed to create a nail polish corresponding to the selection. The nail polish creator may also include an assembly that is configured to receive a nail polish bottle so that the nail polish bottle may be in a position to receive the nail polish. Furthermore, the nail polish creator may include a pigment cartridge holder that includes a receptacle for receiving a pigment cartridge including a pigment of the nail polish that is to be dispensed into the nail polish bottle.

In accordance with another exemplary embodiment, yet another nail polish creator may be provided. The nail polish creator may include a memory that stores instructions and an electronic processor that executes the instructions from the memory to perform the operations of the nail polish creator. The electronic processor may receive a selection of a nail polish color from a device communicatively linked with the nail polish creator. The selection may be received, such as via a wireless communication link between the device and the nail polish creator. Once the selection is received, the electronic processor may determine an amount of one or more nail polish colors needed to create a nail polish corresponding to the selection. The nail polish creator may also include an assembly that is configured to receive a nail polish bottle so that the nail polish bottle may be in a position to receive the nail polish.

The above-described and other features and advantages of the present disclosure will be appreciated and understood by those skilled in the art from the following detailed description, drawings, and appended claims.

DETAILED DESCRIPTION OF THE INVENTION

Figure 1:
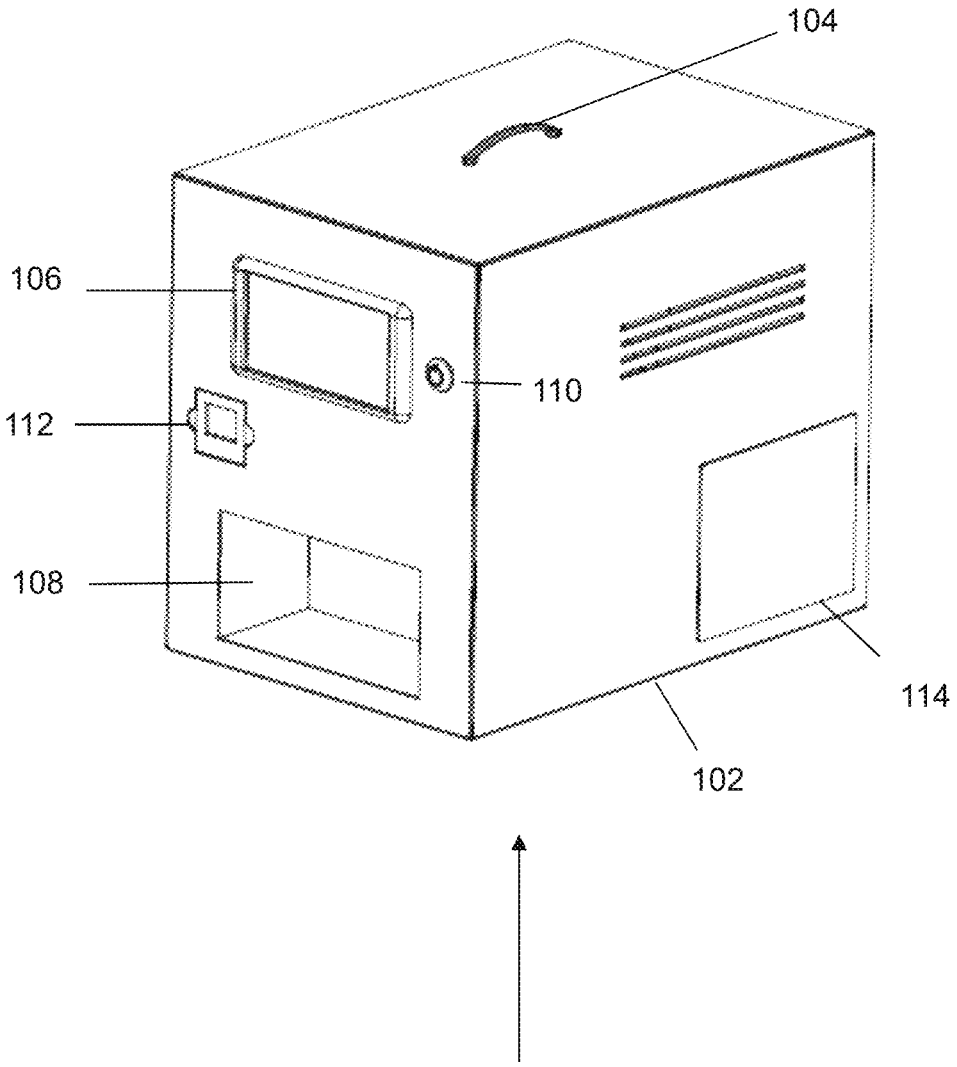
FIG. 1 illustrates an isometric view of the exterior of a portable nail polish creator according to an exemplary embodiment.
Figure 2:
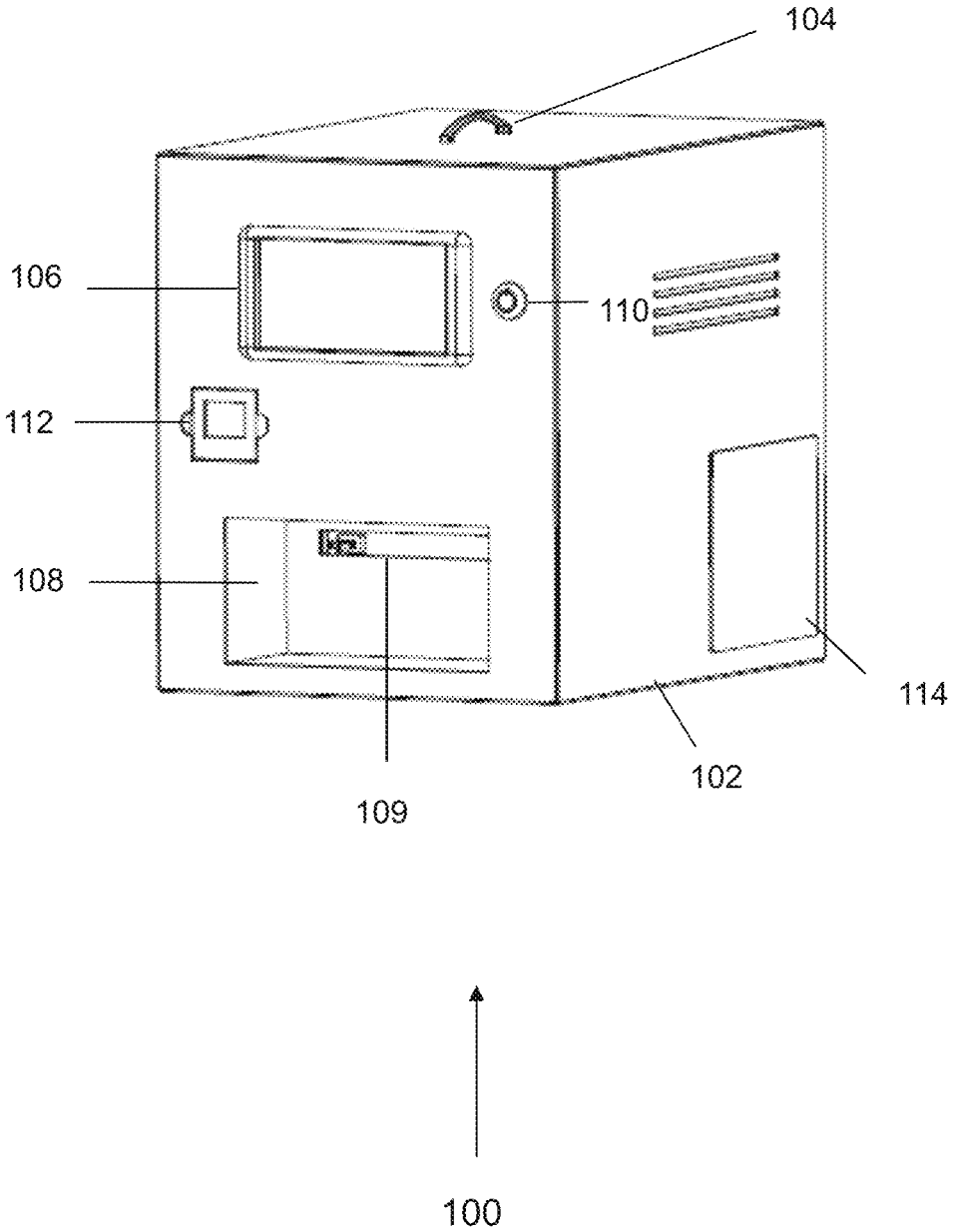
FIG. 2 illustrates another isometric view of the exterior of the portable nail polish creator of FIG. 1.
Figure 3:
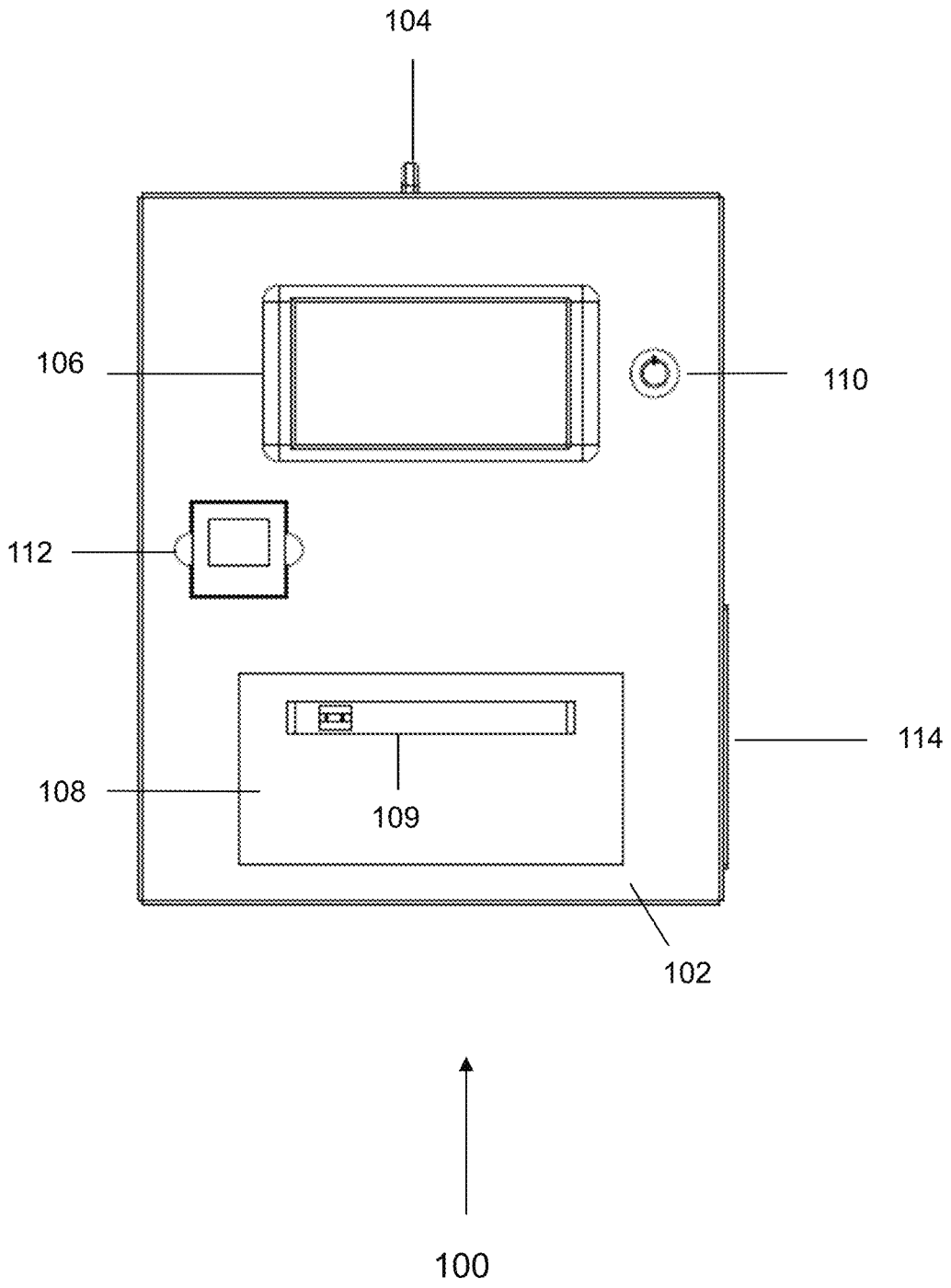
FIG. 3 illustrates a front exterior view of the portable nail polish creator of FIG. 1.
Figure 4:
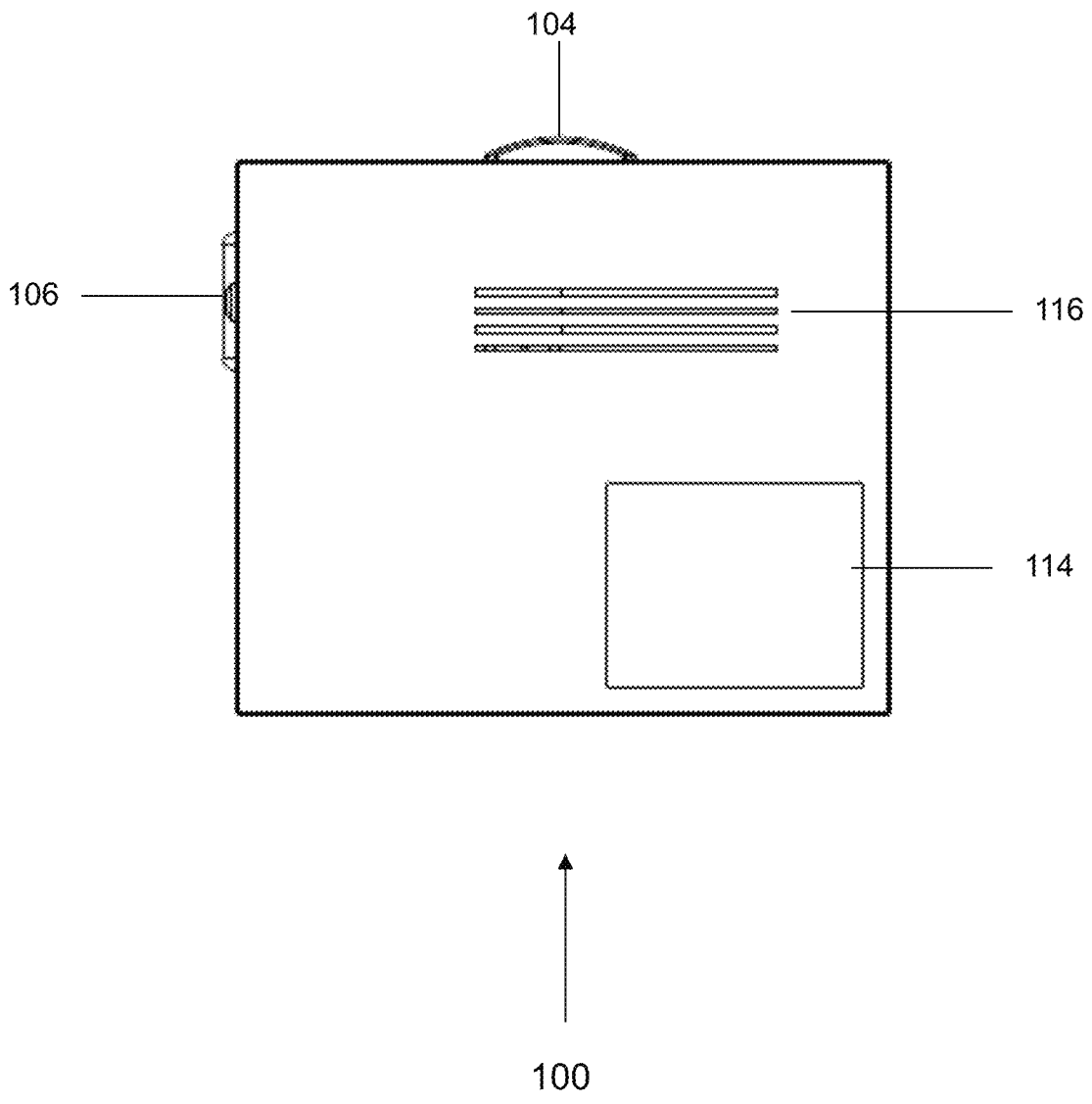
FIG. 4 illustrates a right side exterior view of the portable nail polish creator of FIG. 1.
Figure 5:
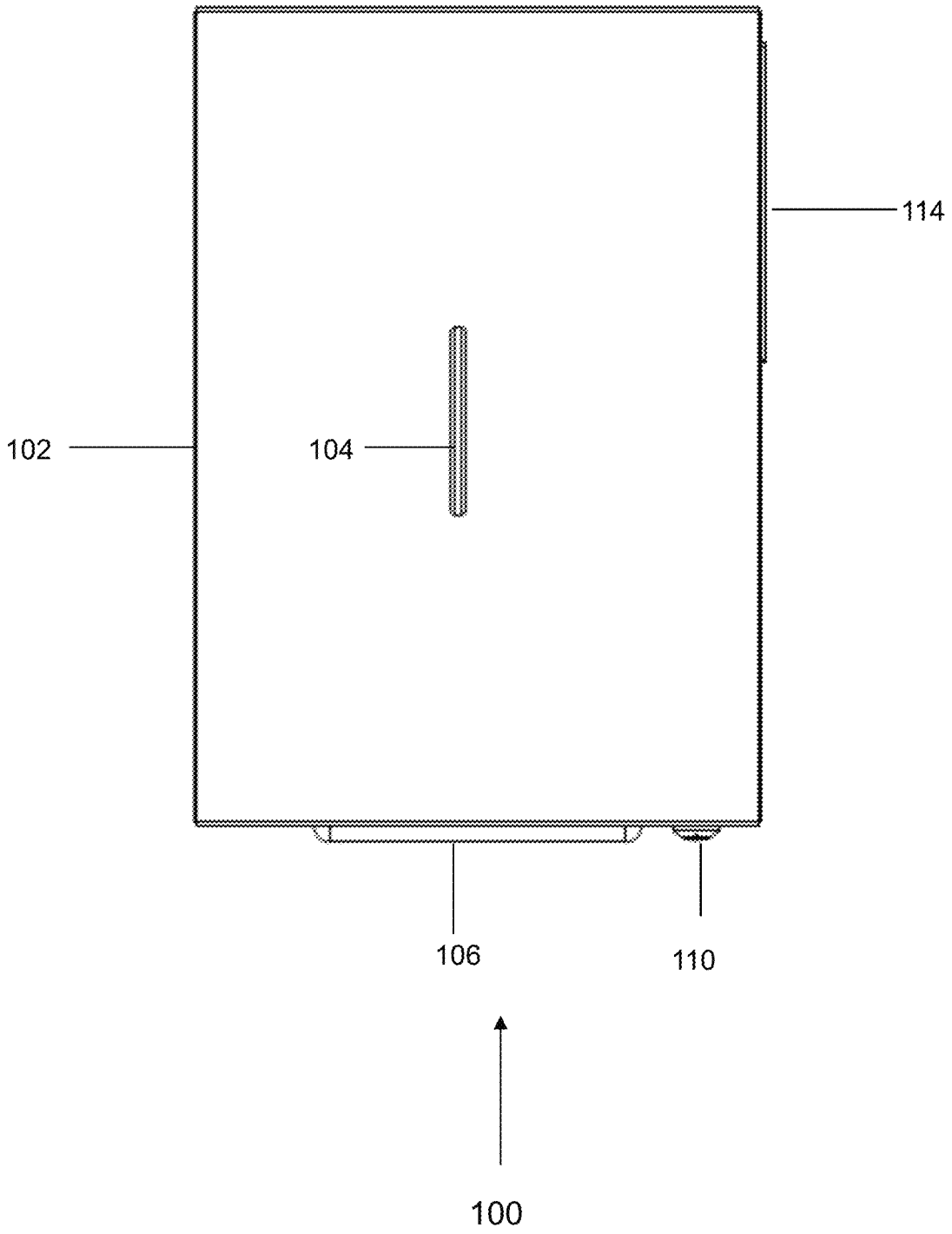
FIG. 5 illustrates a top view of the portable nail polish creator of FIG. 1.
Figure 6:
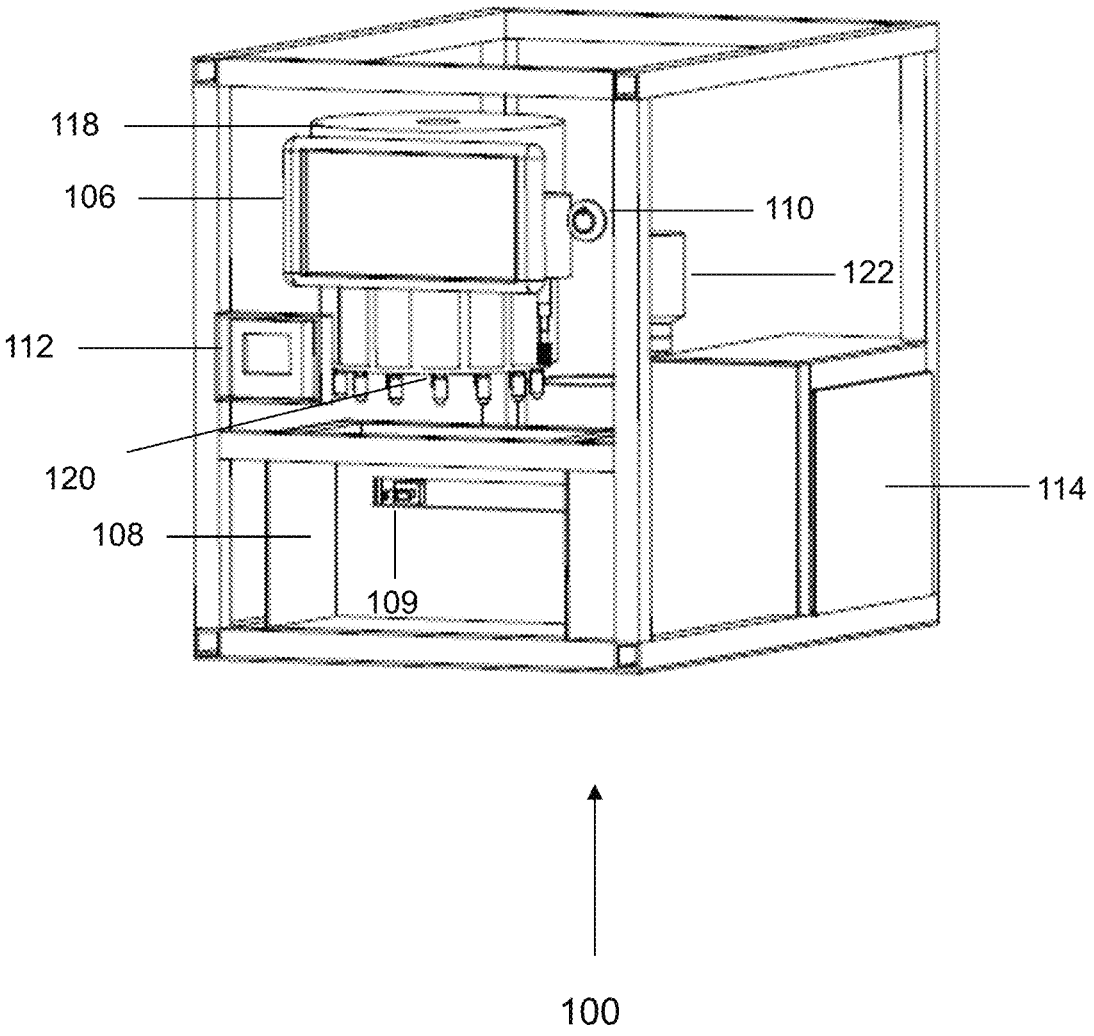
FIG. 6 illustrates an isometric view of the interior of the portable nail polish creator of FIG. 1.
Figure 7:
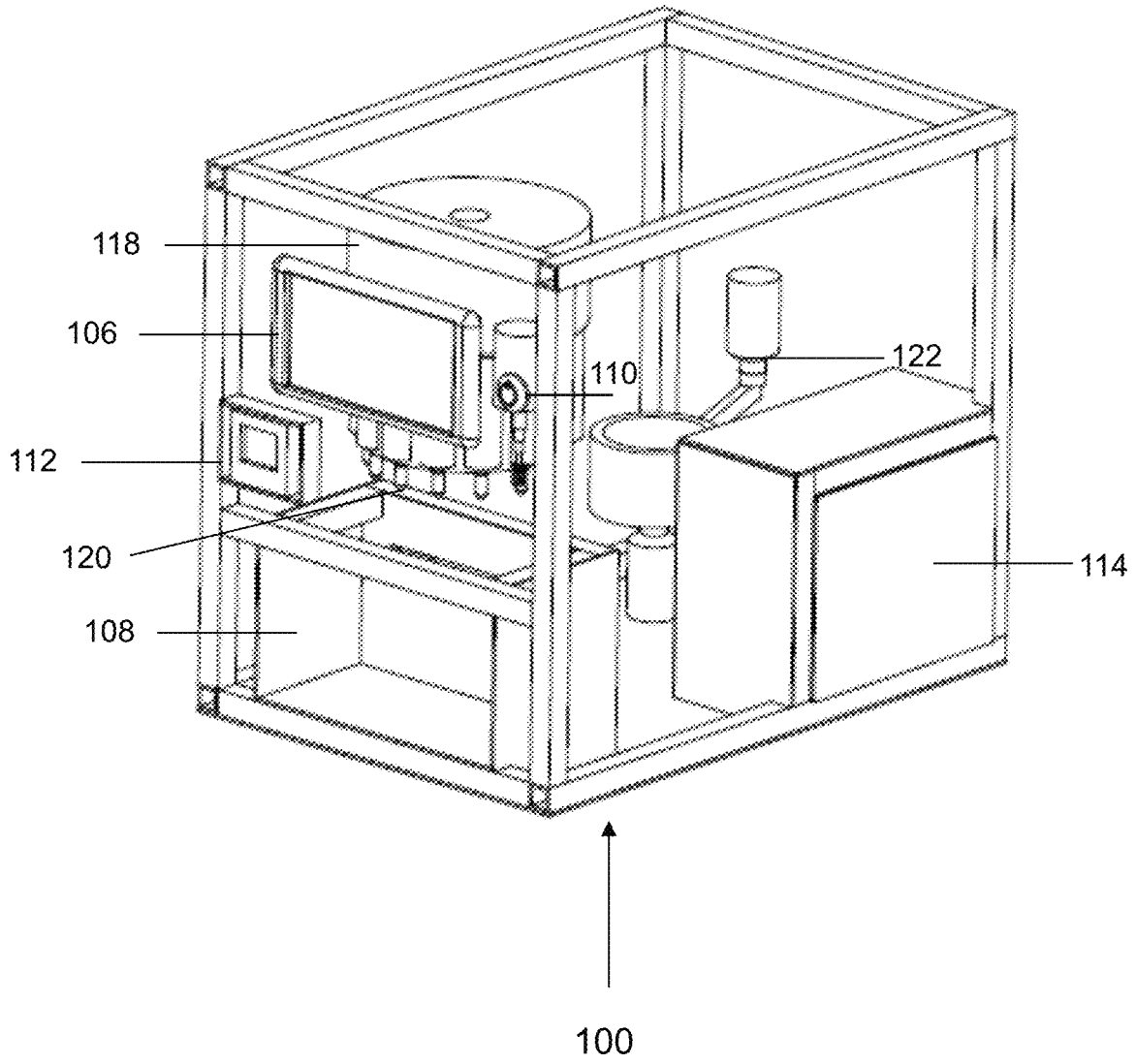
FIG. 7 illustrates an angled isometric view of the interior of the portable nail polish creator of FIG. 1.
Figure 8:
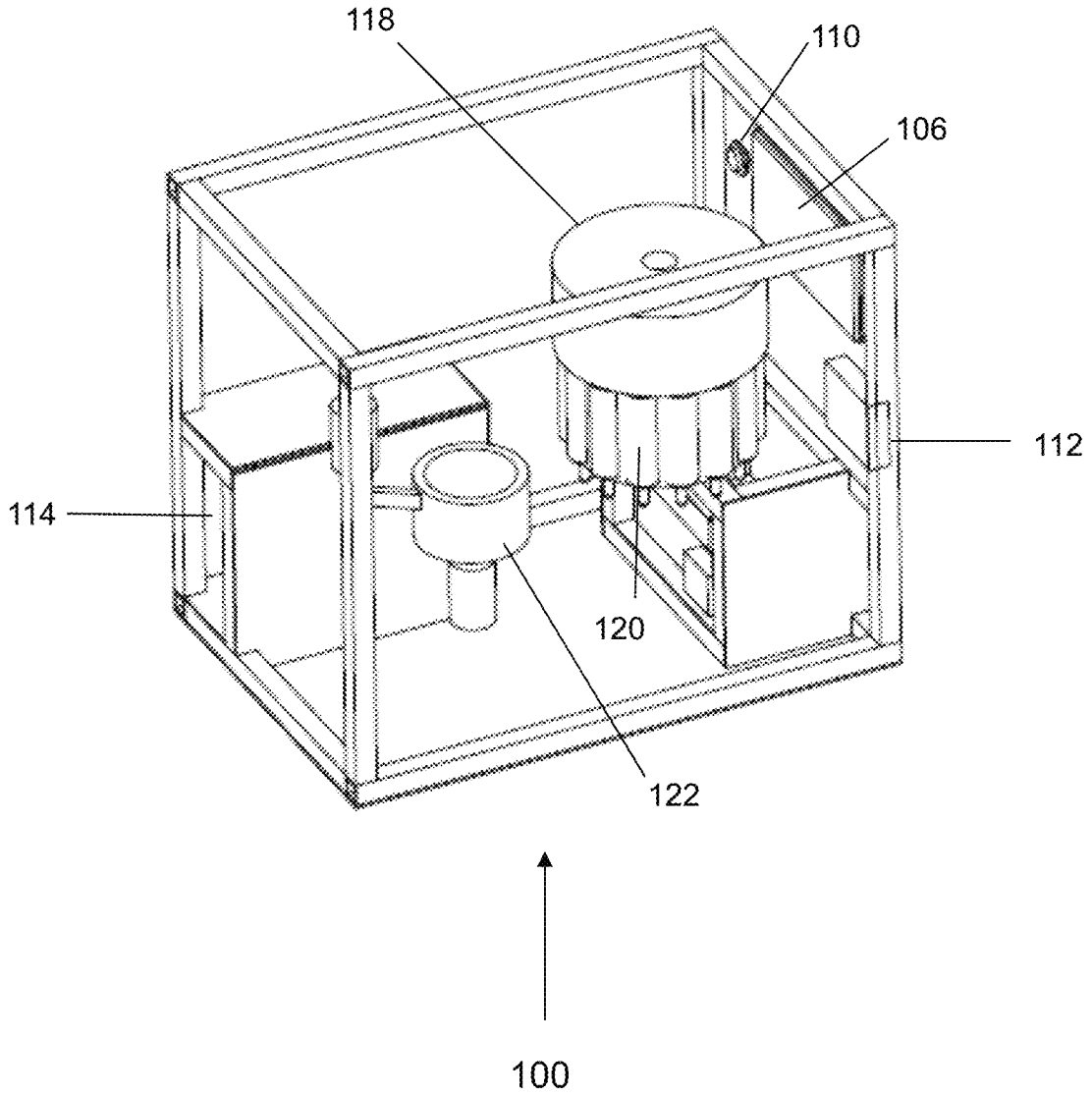
FIG. 8 illustrates an isometric view of the interior from the left side of the portable nail polish creator of FIG. 1.
Figure 9:
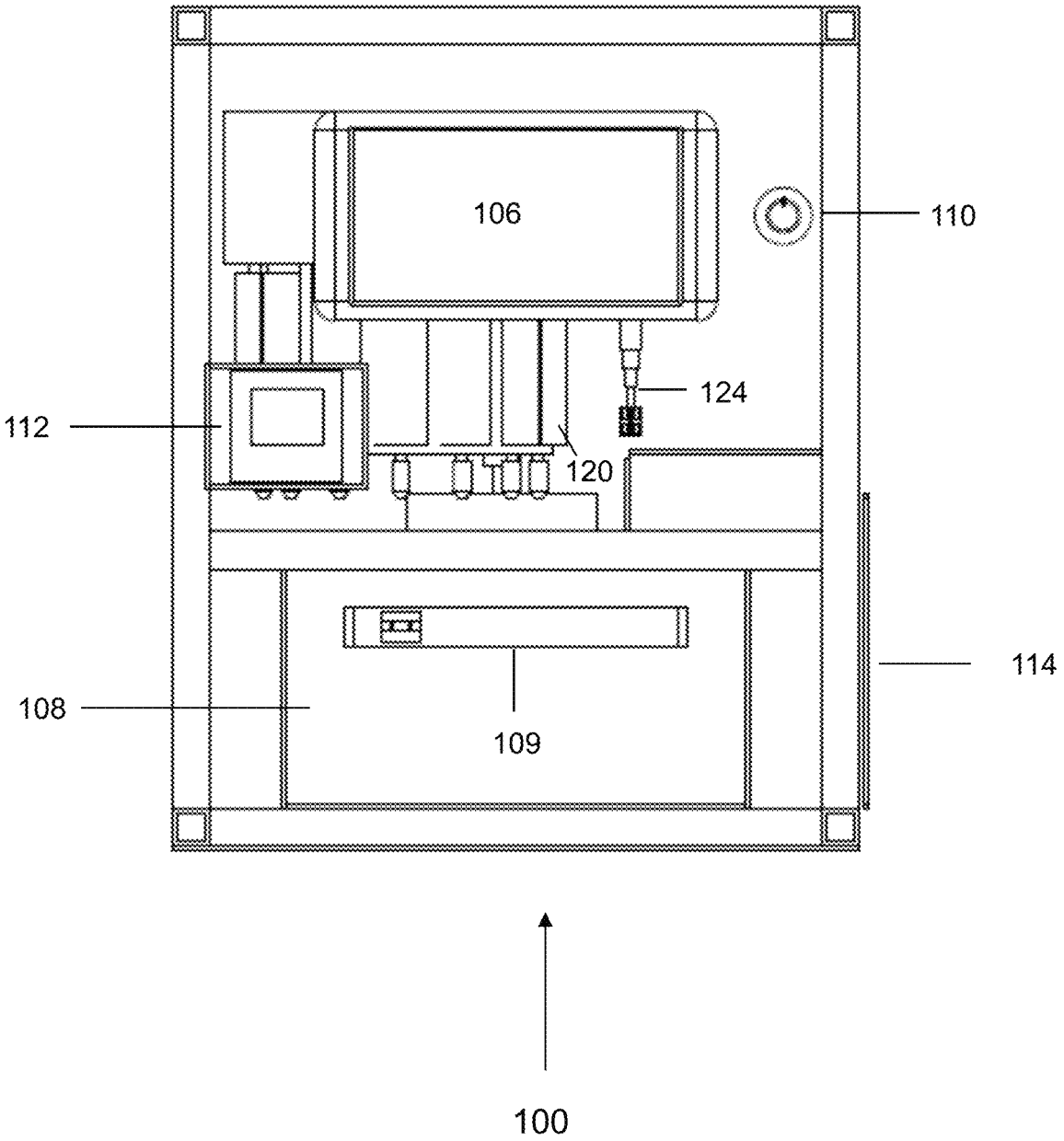
FIG. 9 illustrates a front isometric view of the interior of the portable nail polish creator of FIG. 1.
Figure 10:
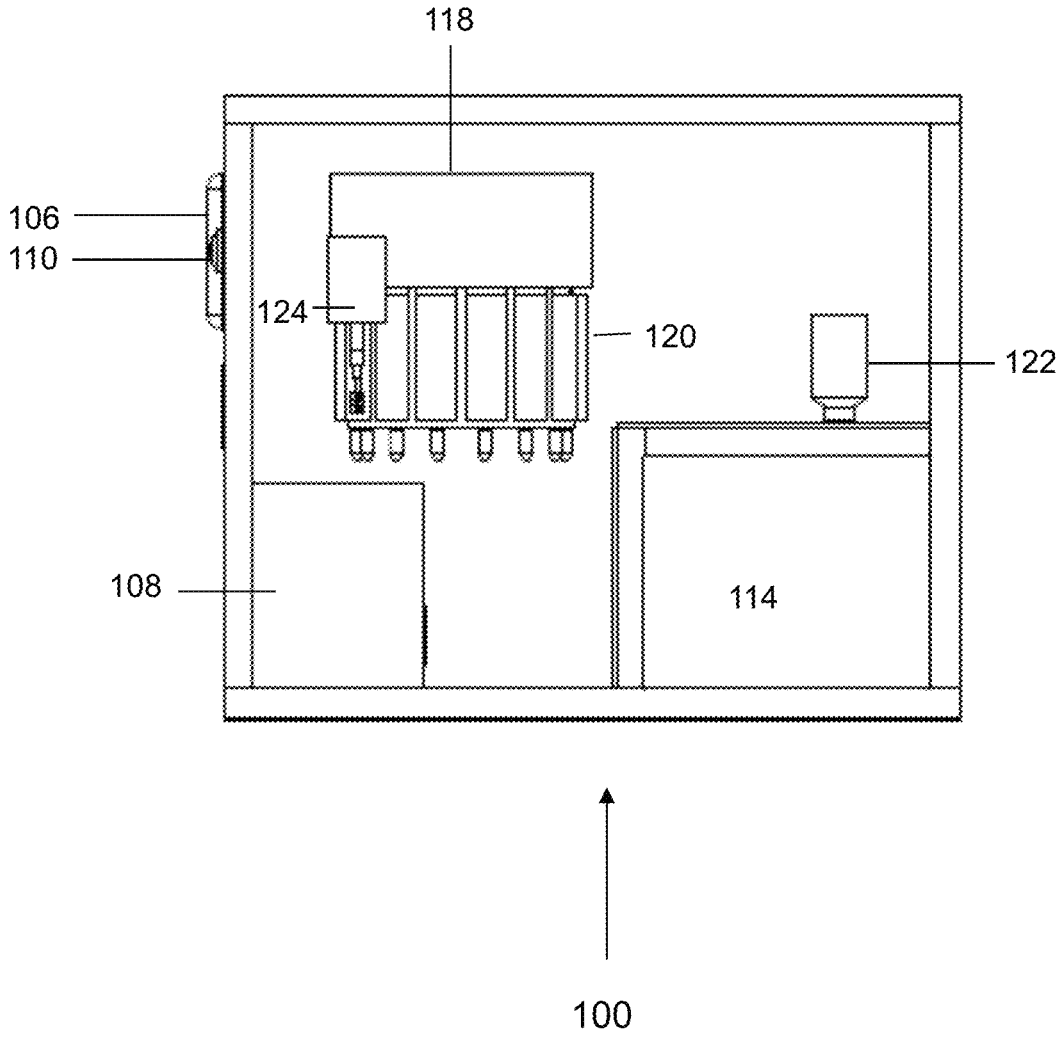
FIG. 10 illustrates a right side isometric view of the interior of the portable nail polish creator of FIG. 1.
Figure 11:
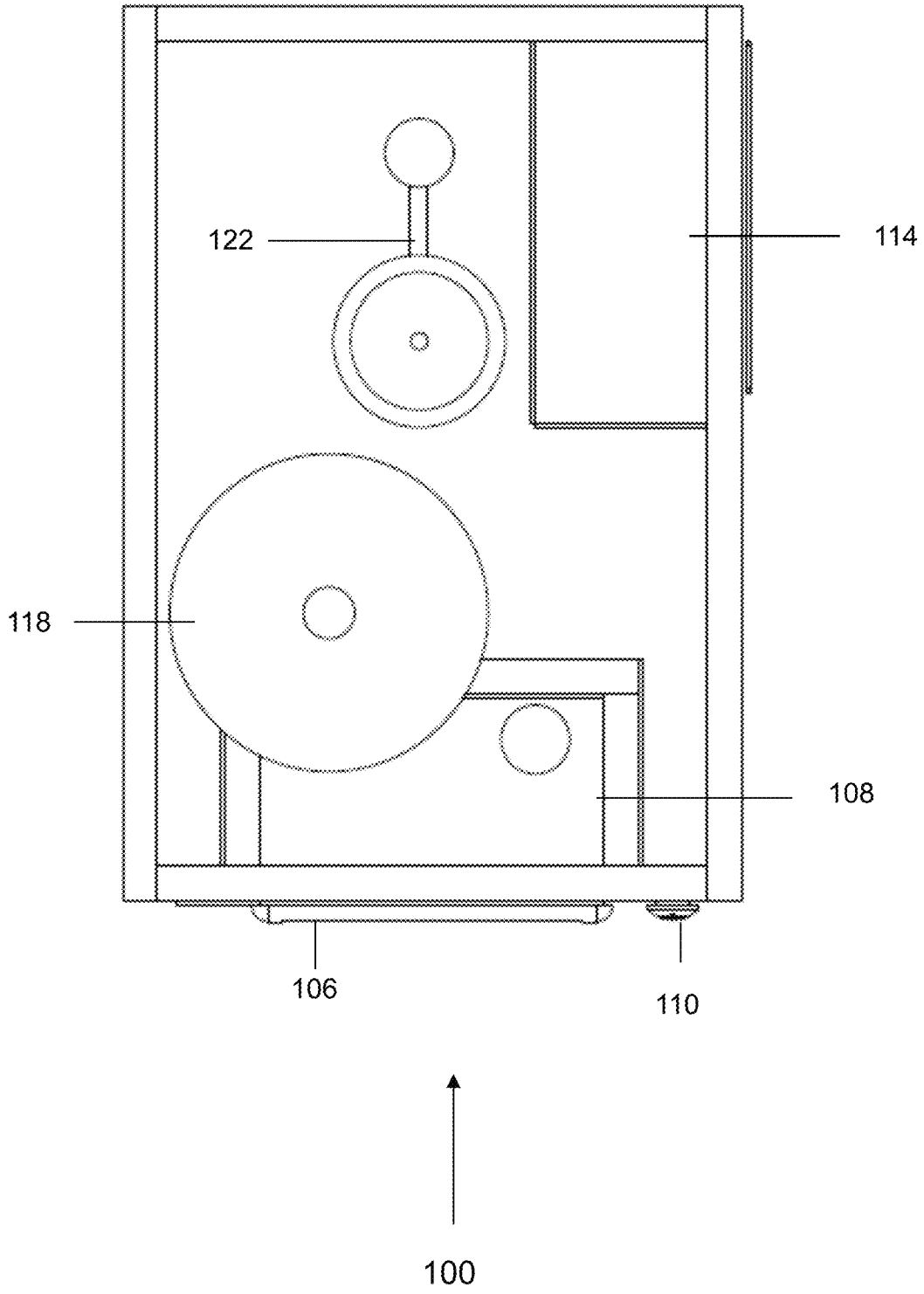
FIG. 11 illustrates a top view of the interior of the portable nail polish creator of FIG. 1.

The exemplary embodiments of the present disclosure are described with respect to a portable nail polish creator and methods for utilizing the portable nail polish creator. Individuals often spend considerable time and effort trying to match and coordinate cosmetics, such as nail polish, with their skin tone, clothing, and accessories. Despite spending the time and effort, the individual may ultimately end up not finding a matching nail polish color. As a result, the portable nail polish creator and methods for utilizing the portable nail polish creator disclosed herein allow an individual to select a color from a pallet of standard colors, create their own color, use a spectrometer to scan a desired color, or select a color from a previously saved set of colors. The portable nail polish creator may then determine an amount from at least one of a plurality of colors to be used in creating the nail polish. Pigments for each color needed to create the selected nail polish may be dispensed into a nail polish bottle and then mixed by a mixer assembly. The individual can then remove the bottle from the nail polish creator and use then nail polish as she or he desires. It should be understood by one of ordinary skill in the art that the exemplary embodiments of the present disclosure can be applied to other types of nail polish creators and methods, such as those described below. Additionally, features of the exemplary embodiments can be used with each other and/or with alternative features that are not shown.

Referring to the drawings 1-40 and in particular to FIGS. 1-11, an exemplary embodiment of a portable nail polish creator 100 is schematically illustrated. In FIGS. 1-11, the portable nail polish creator 100 is illustratively shown to have a particular structure, however, other alternative structures, such as those described below or otherwise, may also be utilized. The portable nail polish creator 100 may include a housing 102, a handle 104, a user interface 106, a computer memory or computer-readable medium (not explicitly shown), and an electronic processor (not explicitly shown). Additionally, the portable nail polish creator 100 may include an area 108 for creating and mixing the nail polish and an arm assembly 109 for moving a nail polish bottle back and forth during the nail polish creation process. The portable nail polish creator 100 may also include an on/off switch 110 for turning the portable nail polish creator 100 off and on, a spectrometer 112 for scanning colors of various objects, a storage area 114, a vent 116, a pigment holding unit 118, pigment holders 120, a cleaning unit 122, and a mixer assembly 124.

In more specific detail, the housing 102 may be utilized to cover and shield all the various components that are housed within the portable nail polish creator 100. The housing may be made from a variety of materials such as, but not limited to, metals, plastics, various composites, or other suitable or desired materials. The housing may also include a cut out for the area 108 for creating and mixing the nail polish, a slot for the on/off switch 110, a slot for housing the spectrometer 112, a slot for the storage area 114, and slits for the vent 116. Other components and cables for the various components may be housed within the housing 102 as well. The handle 104 may be affixed to the housing and, in an embodiment, may have either end of the handle 104 attached to the top surface of the portable nail polish creator 100. The handle 104 may be attached through other means as well and may be positioned on other areas or surfaces of the portable nail polish creator 100.

The user interface 106 may allow an individual to input various types of selections and retrieve information stored in the portable nail polish creator 100. The user interface 106 may be communicatively linked to the electronic processor, which can perform various functional operations with regard to the portable nail polish creator 100. In an embodiment, the user interface 106 may include a touch screen and/or various buttons for inputting selections. When the portable nail polish creator 100 is turned on using the on/off switch 110, the touch screen can activate and display a series of options to the individual by utilizing the electronic processor. For example, one option may include the option of selecting a color from a pallet of standard colors such, as but not limited to, green, red, blue, black, white, yellow, orange, brown, purple, etc. Another option may include providing the individual with the option of creating their own customized color. The individual may be provided with a display of a series of bars corresponding to the three primary colors: blue, red, and yellow. Each bar may be displayed with a sliding scale that can move from zero percent to one-hundred percent of the particular color. The user can slide each scale for each bar to a desired percentage until the individual is able to get the desired color and then select the color to have the portable nail polish creator 100 create the color.

Additionally, the user interface 106 may present the user with the option of using the spectrometer 112 to scan a color of an object. Once the spectrometer 112 has scanned the color of the object, the color may be transmitted to the electronic processor, which can determine what combination of colors are needed to make the scanned color and then cause the portable nail polish creator 100 to create the scanned color. The user interface 106 may also provide the individual with the option of saving a selected color to a memory device of the portable nail polish creator 100. Furthermore, the user interface 106 may also provide the individual with an option to retrieve a previously saved color from the memory device. The user interface 106 may also display power levels if the portable nail polish creator 100 is powered with batteries. If the portable nail polish creator 100 is powered using an A/C adaptor, the user interface 106 may provide an indication that power is flowing to the portable nail polish creator 100.

As noted above, the spectrometer 112 may be utilized to scan a color of an object so that nail polish may be created that matches the scanned color of the object. As schematically illustrated in FIGS. 1-11, the spectrometer 112 may be located on the front face of the portable nail polish creator 100. However, the spectrometer 112 may be located on the sides of the portable nail polish creator 100 or on other locations as well. In an embodiment, the spectrometer 112 may be flush with the outer surface of the portable nail polish creator 100 and may include pockets so that it may be pulled out of its storage location in the portable nail polish creator 100. In an embodiment, the spectrometer 112 may a free standing device in the storage location or it may be connected to the portable nail polish creator 100 by using a cable or other attachment device. The individual may either pull out the spectrometer 112 completely if the spectrometer 112 is free standing or the individual may pull the spectrometer 112 out with the cable attached if not free standing.

When the individual pulls out the spectrometer 112, the individual may scan a color of the object using the spectrometer 112, which may then forward the scanned color to the electronic processor for processing. The electronic processor may store the scanned color in the computer memory as well and determine which pigments need to be dispensed to create nail polish of the scanned color. Additionally, the spectrometer 112 may include a display, which can display the scanned color so that the individual can see if the color of the object actually matches the scanned color displayed on the spectrometer 112. In an embodiment, the individual may be given the option to approve or reject the scanned color. If the individual rejects the scanned color, the individual may be prompted to rescan the color of the object and/or may delete the scanned color from memory. If the individual approves the scanned color, the electronic processor may then determine the pigments to make nail polish matching the scanned color and/or store the scanned color in memory. Additionally, the individual may be given the option of adjusting the scanned color, such as by utilizing the sliding scales disclosed herein.

As noted above, the portable nail polish creator 100 may include a storage area 114. The storage area 114 may be utilized to store user manuals, pigment bottles, brushes, mixer blades, nail polish remover solution, and any other items the individual wishes to store. The storage area 114 may be a tray or other storage device that can securely store various components or objects. Notably, the storage area 114 may be pulled out much like a drawer from a side of the portable nail polish creator 100 so that the individual can retrieve stored items or store items in the storage area 114. Once the individual is done using the storage area 114, the storage area 114 may be reinserted into the portable nail polish creator 100. The storage area 114 is illustratively shown on the right side of the portable nail polish creator 100, however other locations on the portable nail polish creator 100 may be utilized as well.

The electronic processor of the portable nail polish creator 100 may perform many, if not all, of the operative functions associated with the portable nail polish creator 100. Notably, the electronic processor may be communicatively linked to the arm assembly 109, the computer memory, the user interface 106, the spectrometer 112, the on/off switch 110, the cleaning unit 122, the mixer assembly 124, and to other components of the portable nail polish creator 100. Once the portable nail polish creator 100 is turned on using the on/off switch 110, the electronic processor may cause the various user interface 106 options to be displayed on the user interface 106 for the individual to view. As the individual enters a selection, the selection may be processed by the electronic processor, which can then cause the electronic processor to send signals to activate the various components the electronic processor is in communication with. For example, once the electronic processor receives a color selection, the processor can determine the precise combination of colors required to make the selected color and may transmit a signal to the arm assembly 109 to move the nail polish bottle in a position under the pigment holder unit 118 and lock the arm assembly 109 into place, and transmit another signal to the pigment holder unit 118 to dispense the precise amounts of nail polish pigments from each pigment bottle 136 into the nail polish bottle 170.

Once the nail polish pigments are dispensed into the pigment bottle 136, the electronic processor can transmit a signal to the arm assembly 109 to move the nail polish bottle 170 to the mixer assembly 124. The electronic processor may also send a signal to the mixer assembly 124 to lower itself into the nail polish bottle 170 and start mixing the nail polish in the nail polish bottle 170. Also, the electronic processor may signal the pigment holder unit 118 to dip the pigment holders 120 into the cleaning unit 122. The pigment holders 120 may be cleaned while the mixer assembly 124 is mixing the nail polish or at another time. Once the mixer assembly 124 is finished mixing, the electronic processor can send a signal to the mixer assembly 124 to dip the mixer blade 150 into the cleaning unit 122 so that the mixer blade 150 may be cleaned. The electronic processor may also send a signal to the components to return to their original position. In an embodiment, the electronic processor may also cause color selections or any other inputs or outputs received or outputted by the portable nail polish creator 100 to be stored in the memory device for future use.

Figure 12:
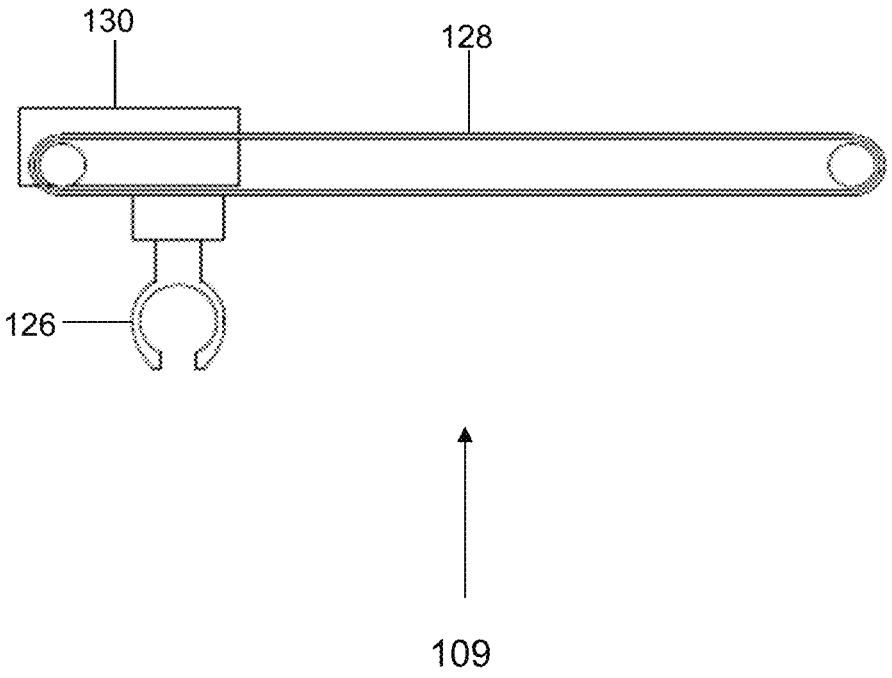
FIG. 12 illustrates a top view of an arm assembly utilized in the portable nail polish creator.
Figure 13:
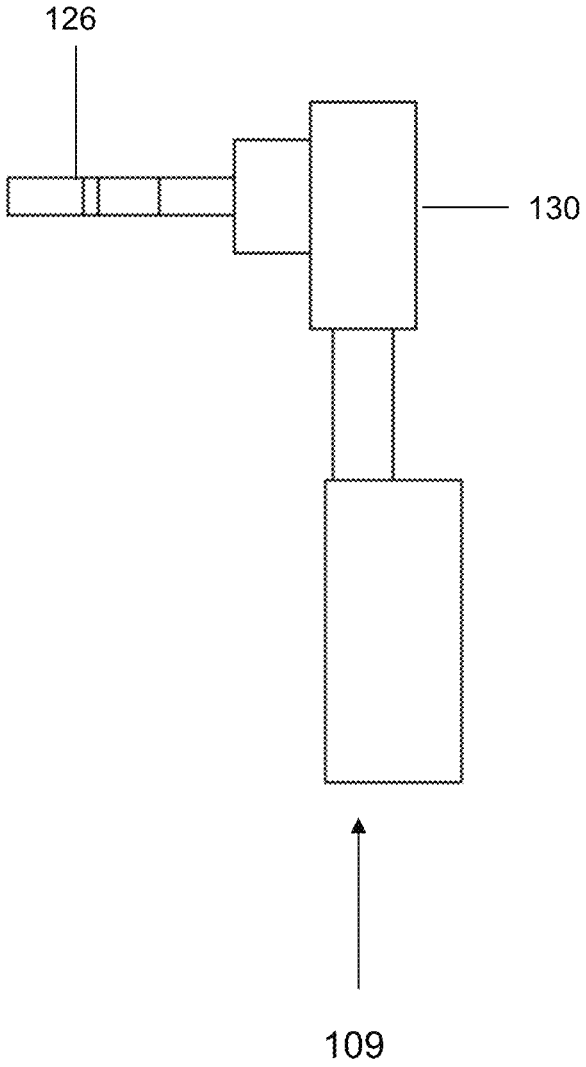
FIG. 13 illustrates a right side view of the arm assembly of FIG. 12.
Figure 14:
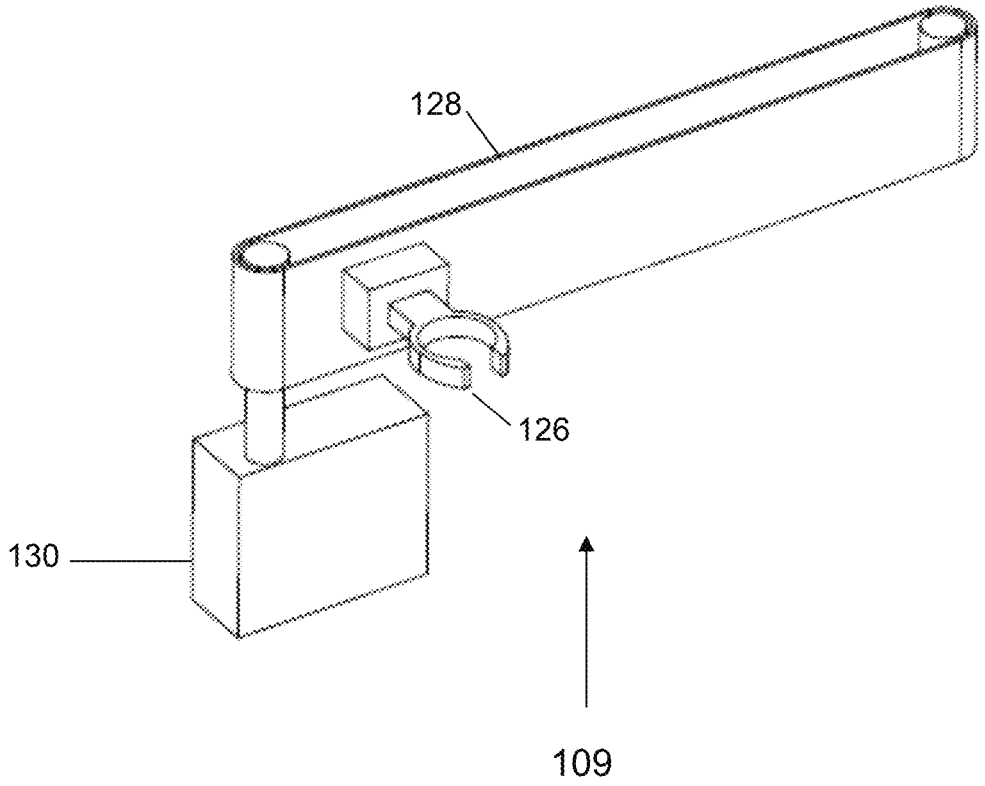
FIG. 14 illustrates an isometric view of the arm assembly of FIG. 12.
Figure 15:
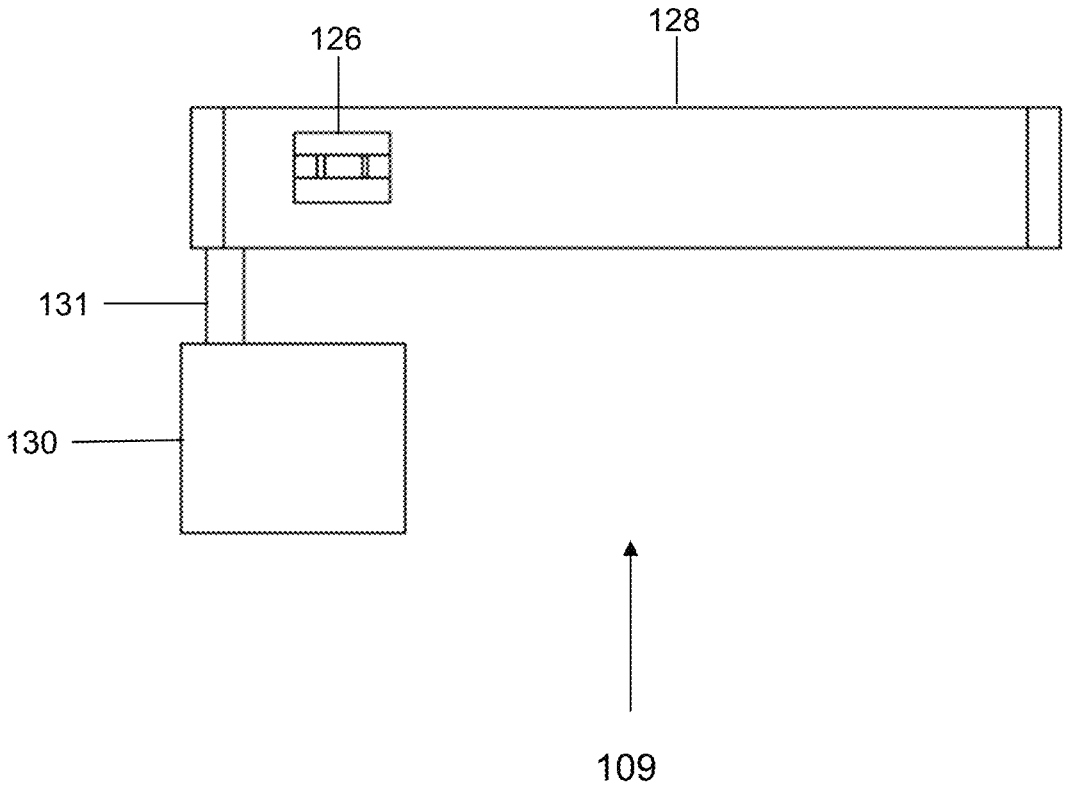
FIG. 15 illustrates a front view of the arm assembly of FIG. 12.
Figure 16:
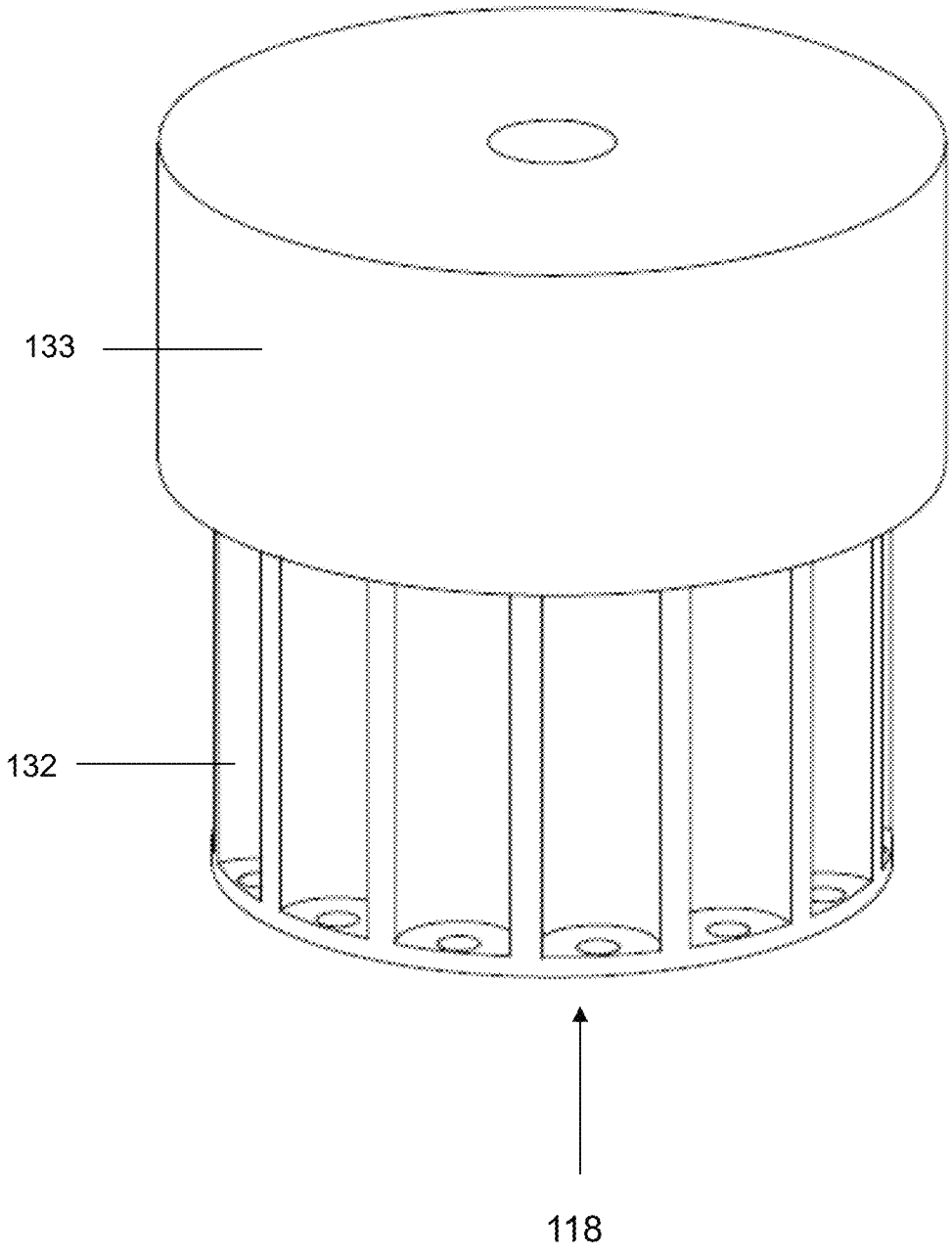
FIG. 16 illustrates an empty pigment holder unit utilized in a portable nail polish creator.
Figure 17:
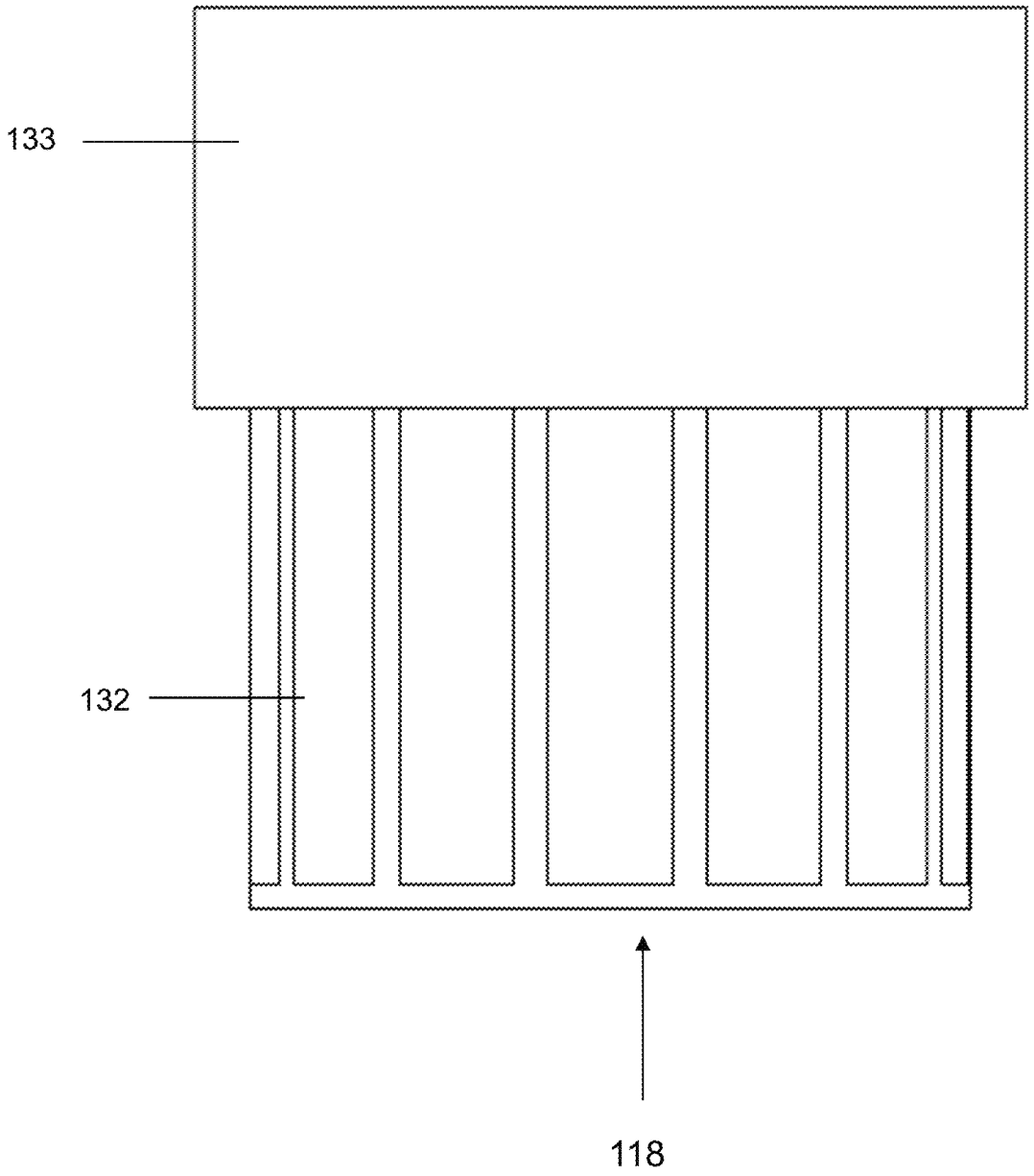
FIG. 17 illustrates a front view of the pigment holder unit of FIG. 16.
Figure 18:
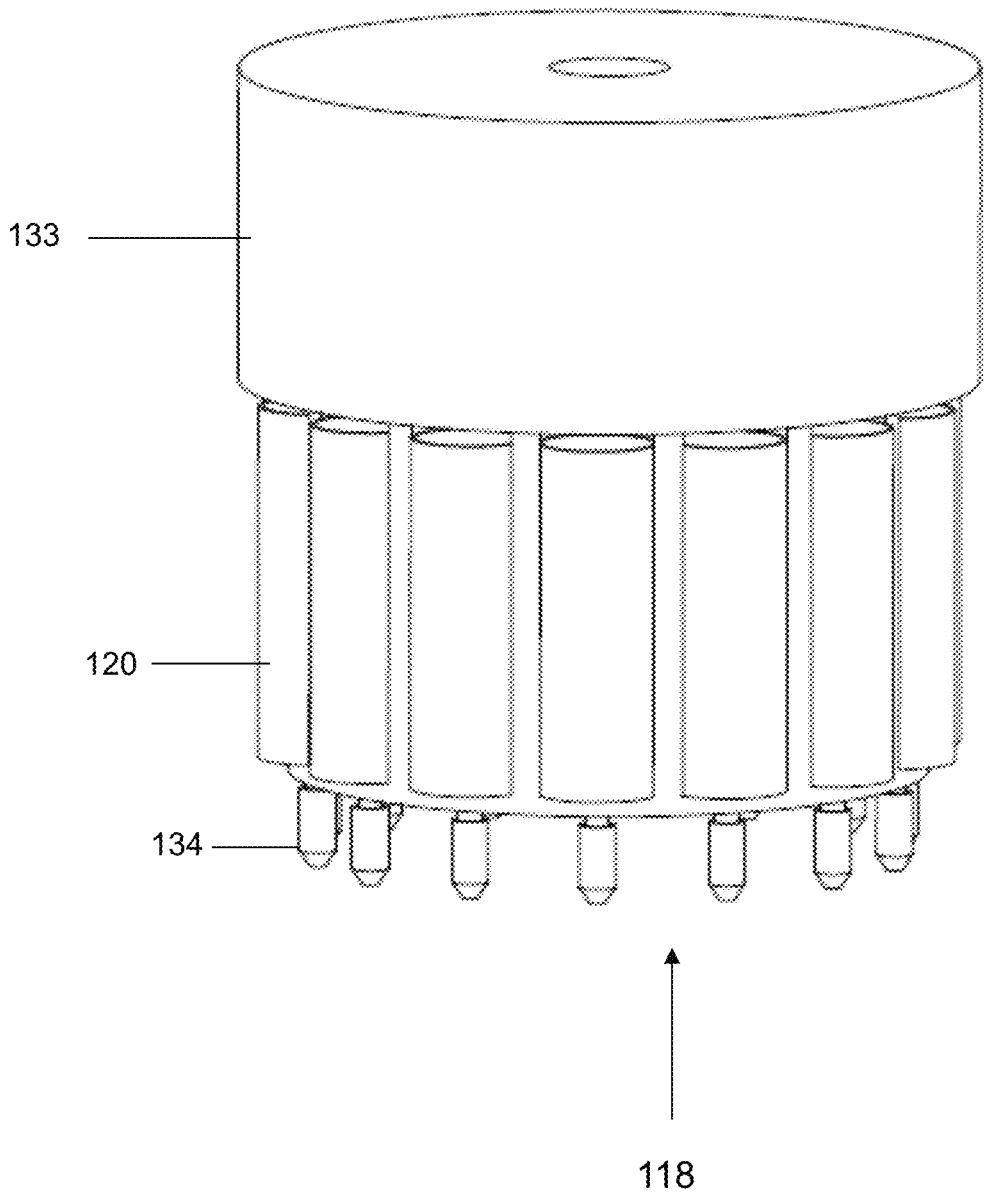
FIG. 18 illustrates the pigment holder unit of FIG. 16 with a full set of pigment holders.
Figure 19:
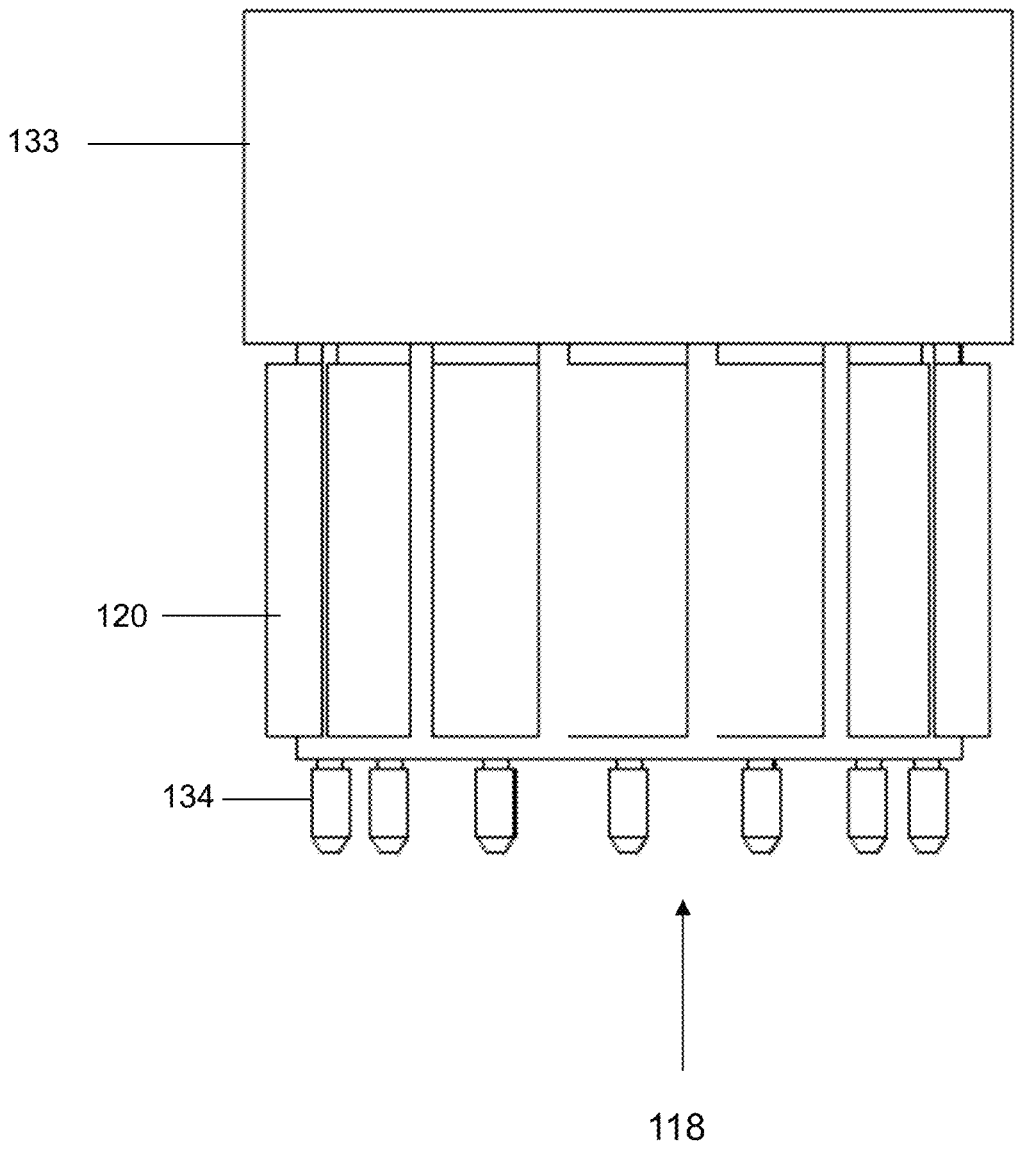
FIG. 19 illustrates a front of view of the pigment holder unit of FIG. 16 with a full set of pigment holders.
Figure 20:
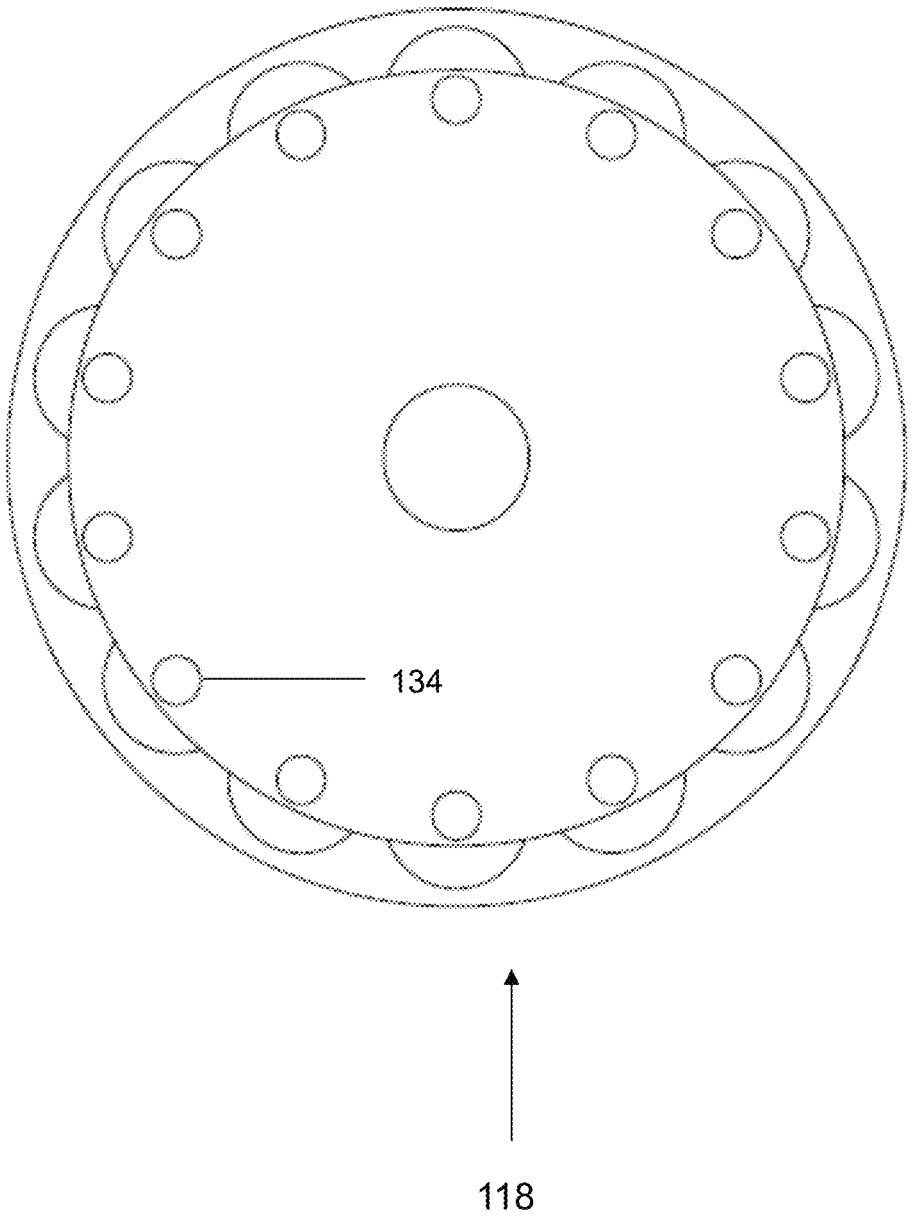
FIG. 20 illustrates a top view of the pigment holder unit of FIG. 16.
Figure 21:
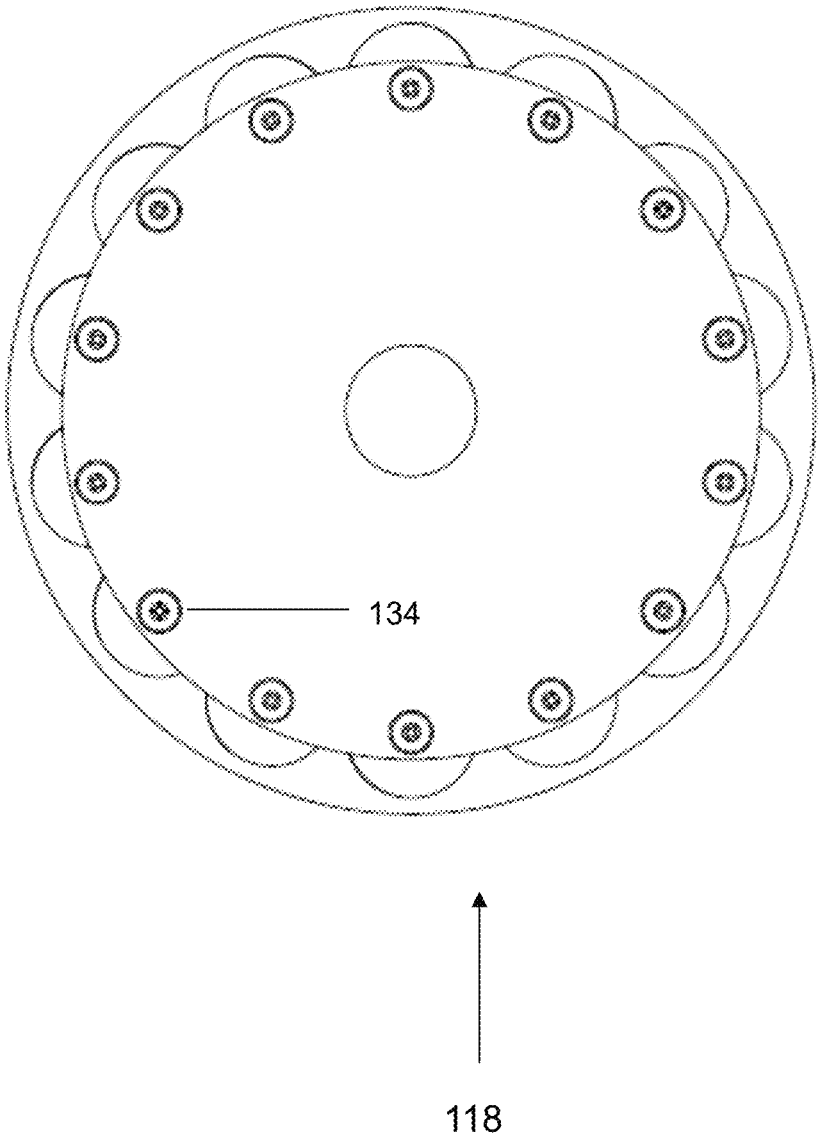
FIG. 21 illustrates a bottom view of the pigment holder unit of FIG. 16.
Figure 22:
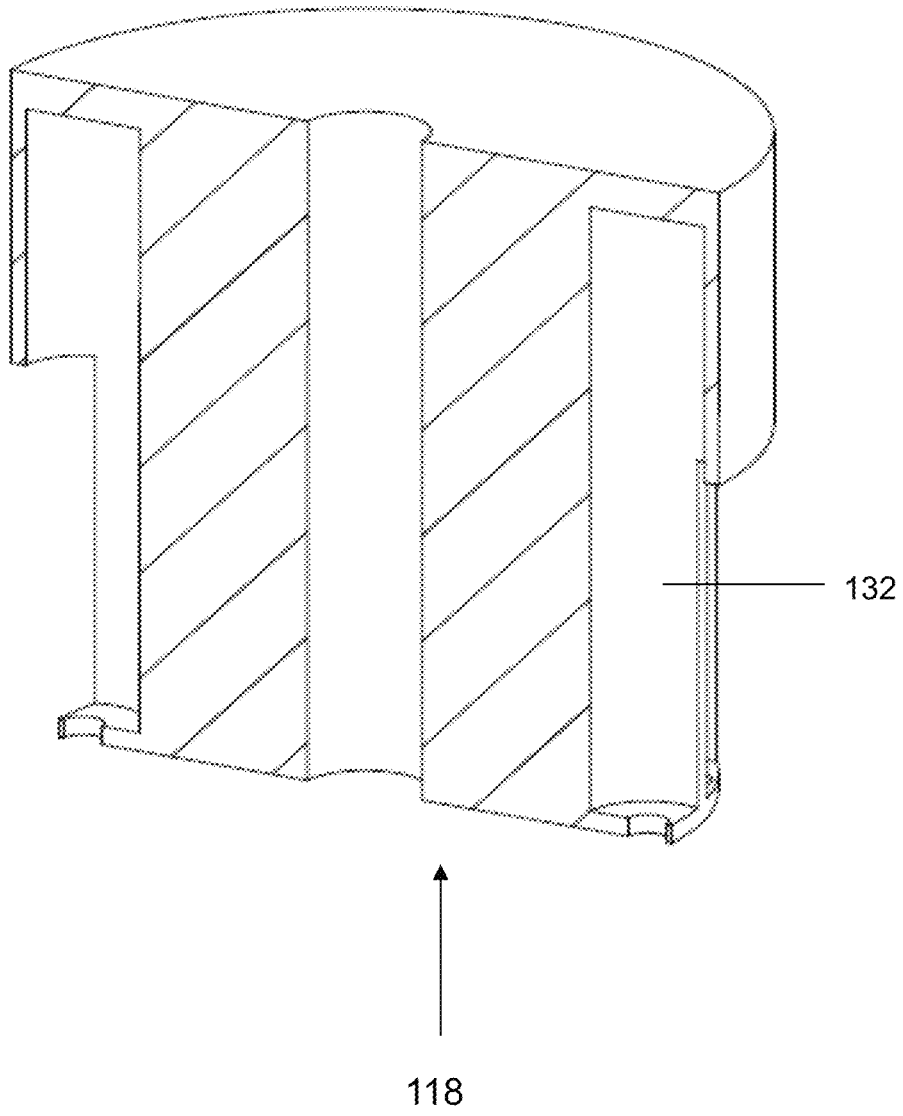
FIG. 22 illustrates a front cross-sectional isometric view of the empty pigment holder unit of FIG. 16.
Figure 23:
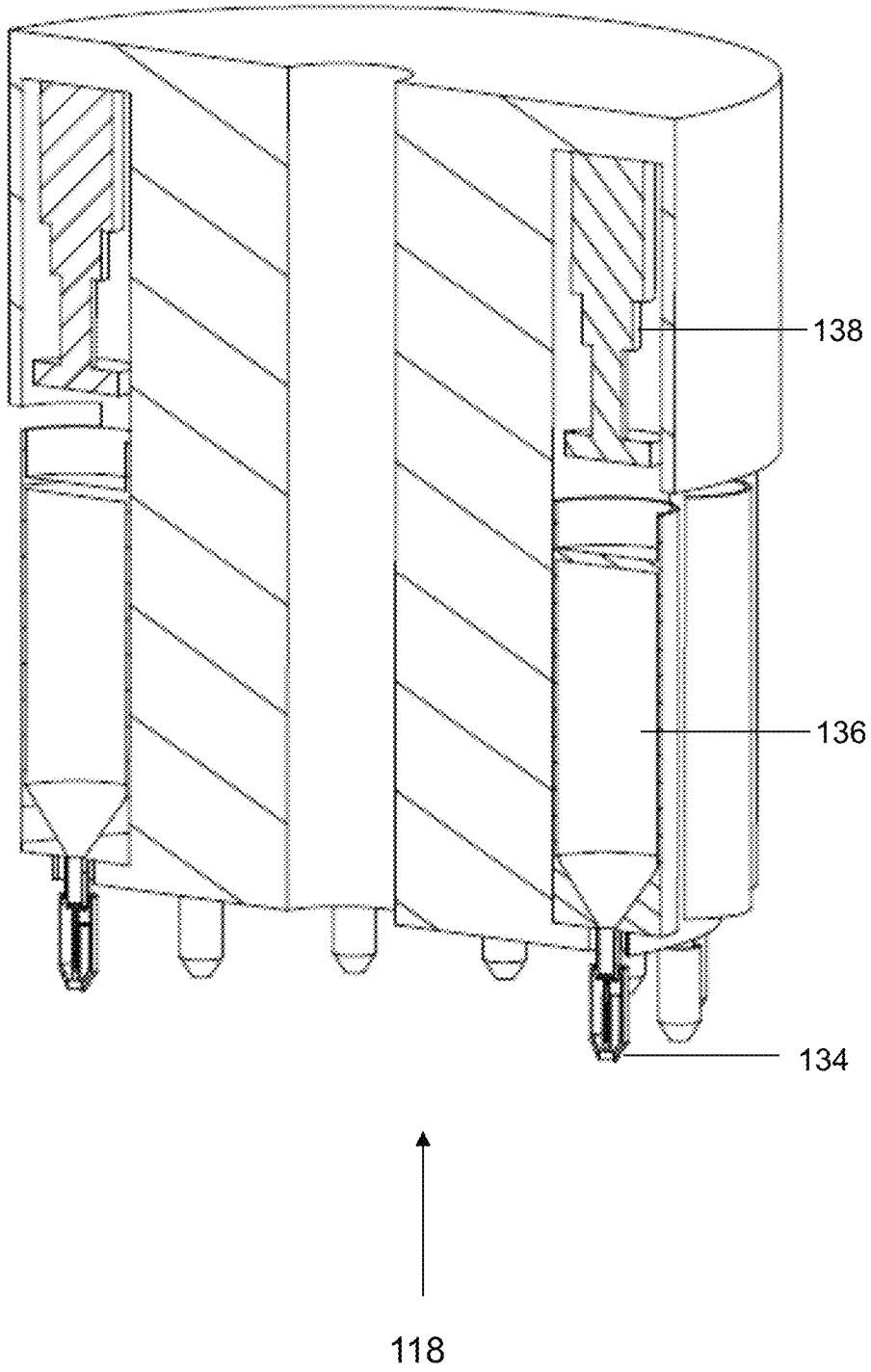
FIG. 23 illustrates a front cross-sectional isometric view of the pigment holder unit of FIG. 16 with pigment holders inside.

Referring now also to FIGS. 12-15, further features and details regarding the arm assembly 109 are provided. As noted above, the arm assembly 109 may be configured to receive a signal from the electronic processor to move the nail polish bottle 170 in a variety of positions. The arm assembly 109 may include a nail polish bottle holder 126, which may, in an embodiment, take the form of a circular clamp. The nail polish bottle holder 126 may have an opening so that the nail polish bottle 170 may be easily inserted or removed from the nail polish bottle holder 126. The arm assembly 109 may also include a belt 128, which may be partially wrapped around the arm assembly motor 130 and the bearing 131, as illustrated in FIG. 12. The arm assembly motor 130 may move the belt such that the nail polish bottle holder 126 may move in various positions, such as horizontally across the arm assembly 109. This may allow the nail polish bottle 170 to be moved at positions that allow it to be in proximity with the pigment holder unit 118 and the mixer assembly 124 so that the nail polish may be dispensed into the nail polish bottle 170 and mixed.

Referring now also to FIGS. 16-32, further features and details regarding the pigment holder unit 118, the pigment holders 120, the nozzle snap on devices 134, the pigment bottles 136, the pistons 138, the shut off cap posts 140, the shut off caps 142, the spring 144, and the opening 146 are schematically illustrated and provided. The pigment holder unit 118 may be cylindrical or round in structure as illustrated in the Figures, however, other structures are also contemplated according to the present disclosure. Additionally, the pigment holder unit 118 may be placed in the portable nail polish creator 100 in either a horizontal or vertical position. The pigment holder unit 118 may include a series of openings 132 that may be configured to receive the pigment holders 120, which may include the pigment bottles 136. The openings 132 may be positioned at the bottom half of the pigment holder unit 118, however, other locations are also contemplated as well. Additionally, the pigment holder unit 118 may include a motor 133 that can allow the pigment holder unit 118 to rotate in the center so as to allow each of the pigments to be dispensed in the nail polish bottle 170 that is positioned underneath the pigment holder unit 118 during dispensing. The electronic processor can send a signal to the motor 133 so that the pigment holder unit 118 may be either activated or deactivated.

Figure 24:
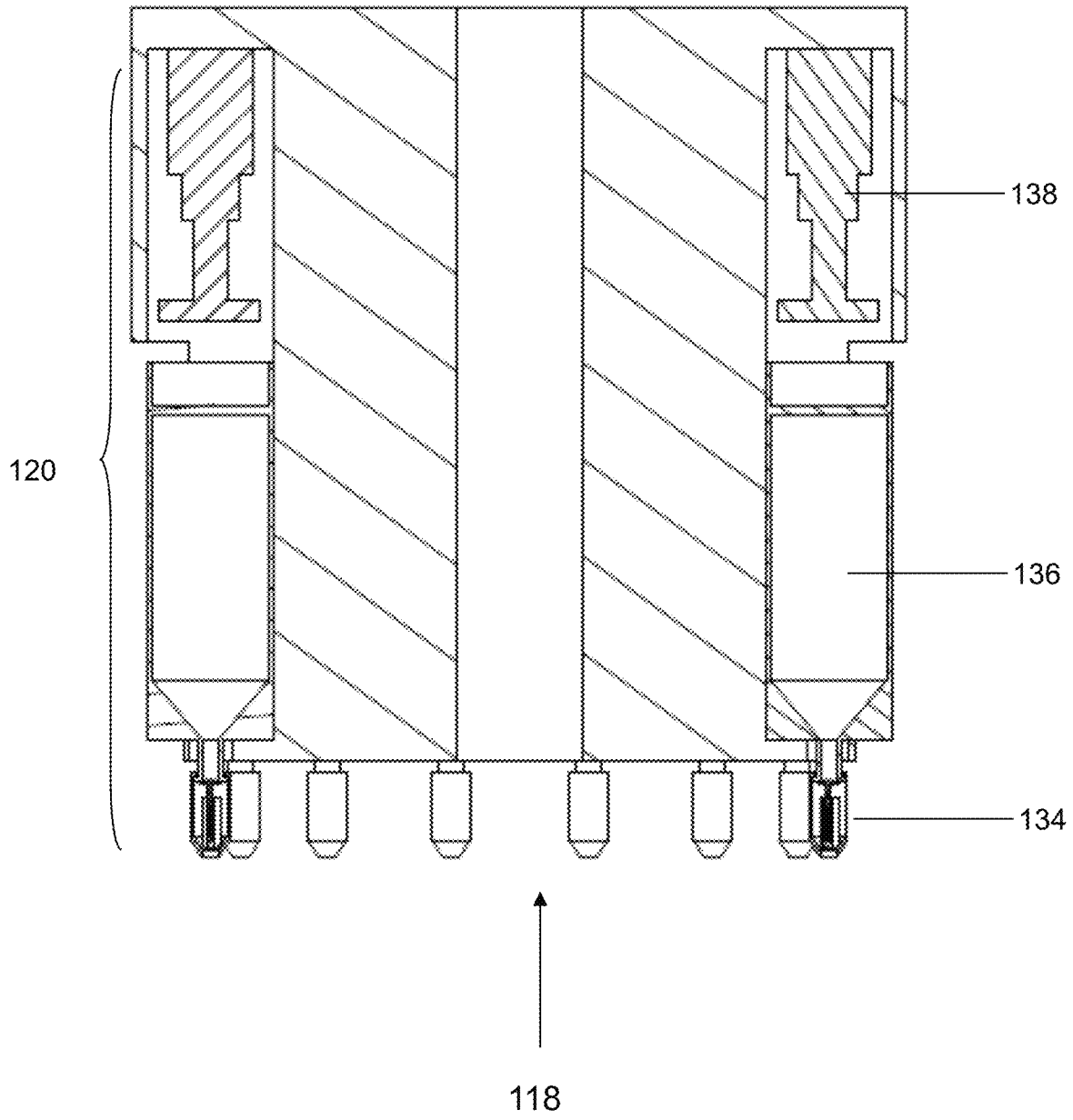
FIG. 24 illustrates a front cross-sectional isometric view of the pigment holder unit of FIG. 16 with pigment holders.
Figure 25:
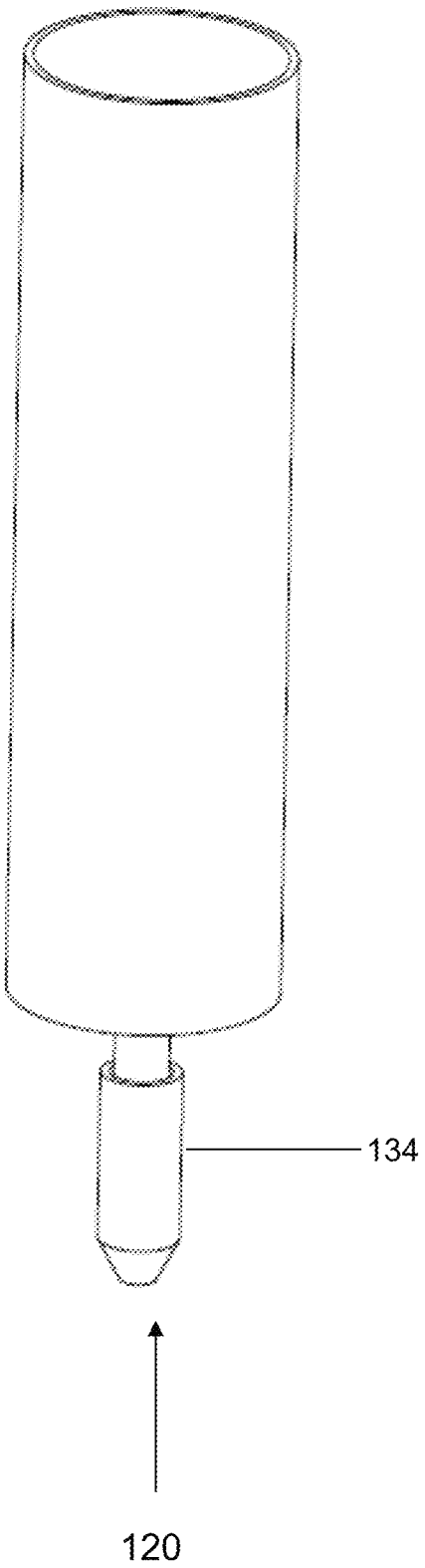
FIG. 25 illustrates an isometric view of a pigment holder utilized in a portable nail polish creator.
Figure 26:
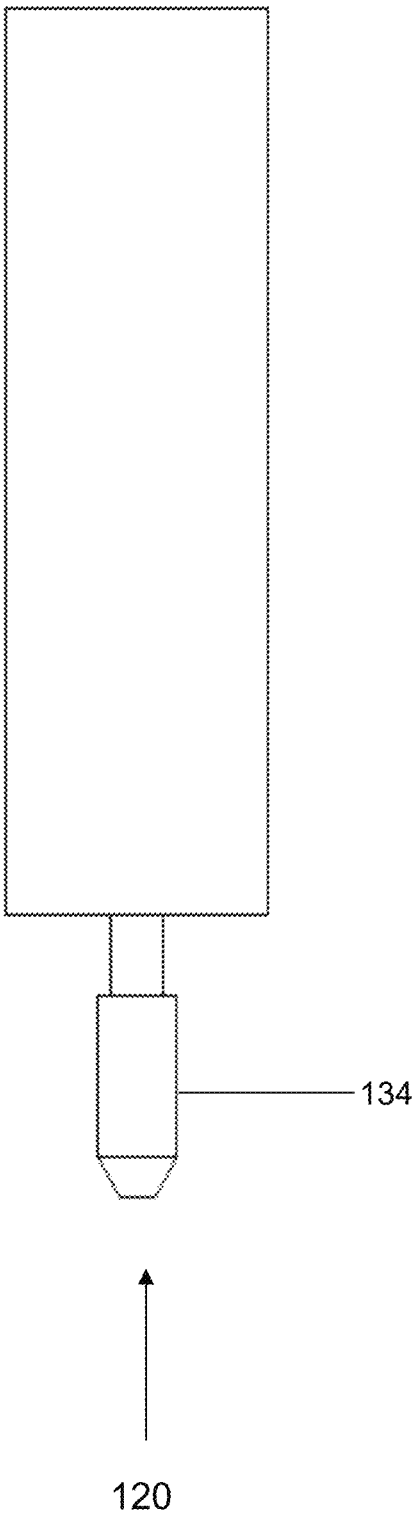
FIG. 26 illustrates a front view of the pigment holder of FIG. 25.
Figure 27:
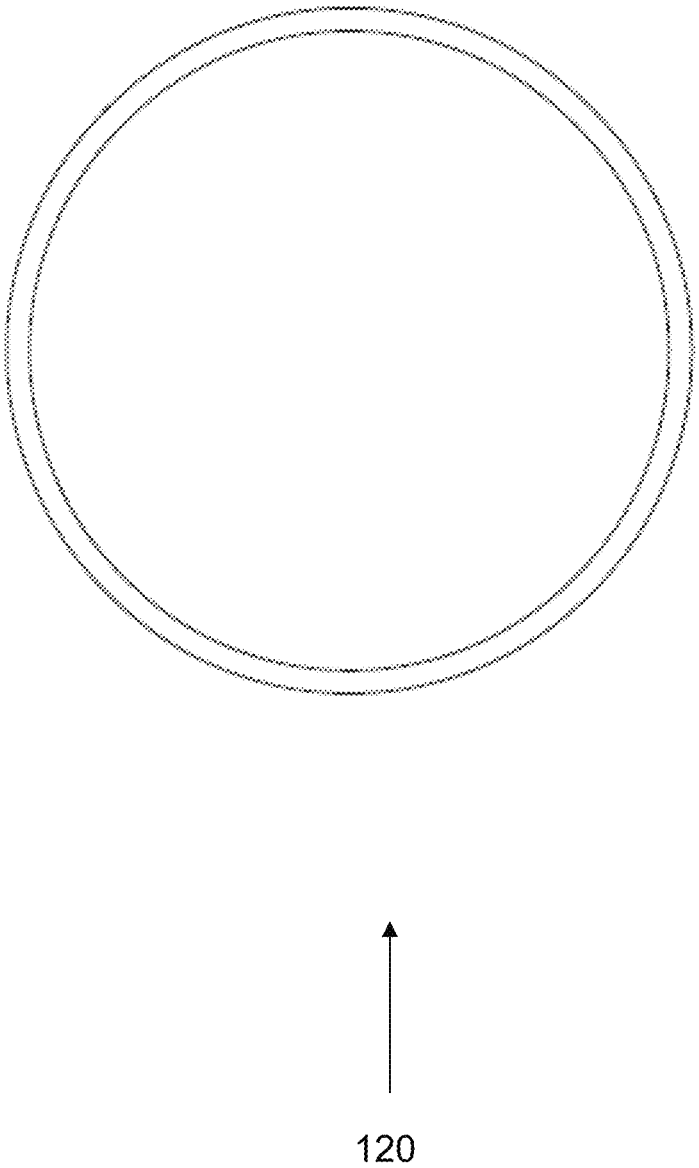
FIG. 27 illustrates a top view of the pigment holder of FIG. 25.
Figure 28:
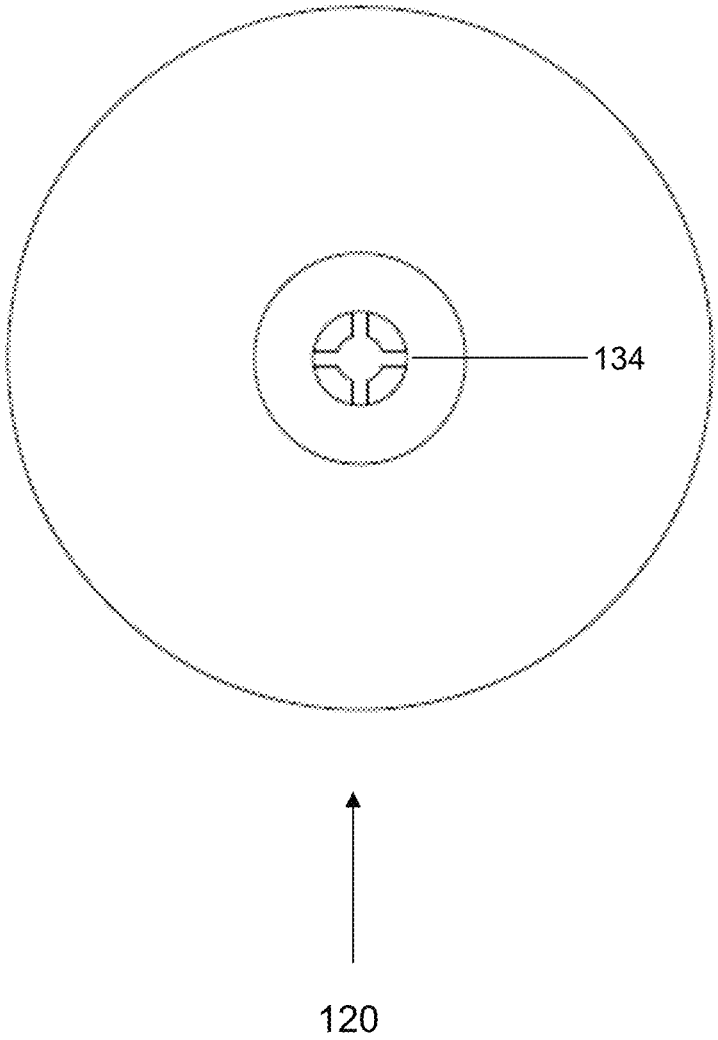
FIG. 28 illustrates a bottom view of the pigment holder of FIG. 25.

With regard to the pigment bottles 136, each may be positioned in its own pigment holder 120, such as shown in FIG. 24. The pigment bottles 136 may be slid into the openings 132 and locked into place. In an embodiment, the pigment bottles 136 may be tubes which contain a particular color of nail polish and which include a diaphragm at the top of the tube. When the pigment holder unit 118 is activated by the electronic processor, the motor 133 may cause a piston 138 to push down on the diaphragm so as to dispense the pigment/nail polish out of the pigment bottle 136 and into the nail polish bottle 170.

A specialized nozzle snap on device 134 may be utilized to control the flow of pigment from a pigment bottle 136. In particular, the nozzle snap on device 134 may be snapped onto a distal end of the pigment bottle 136. The nozzle snap on device 134 may prevent the pigment from dripping out of the pigment bottle 134 after the piston 138 has finished pushing down on the pigment bottle 136 and finished dispensing the exact amount of pigment into the nail polish bottle 170. In an embodiment, the nozzle snap on device 134 may include shut off cap posts 140 that may be utilized to hold a spring 144 and also the shut off caps 142 in place. In an embodiment, four shut off cap posts 140 may be utilized, which may be positioned at 90 degrees apart so as to allow the pigment to flow from the pigment bottle 136, through the nozzle snap on device 134, and into the nail polish bottle 170.

Figure 29:
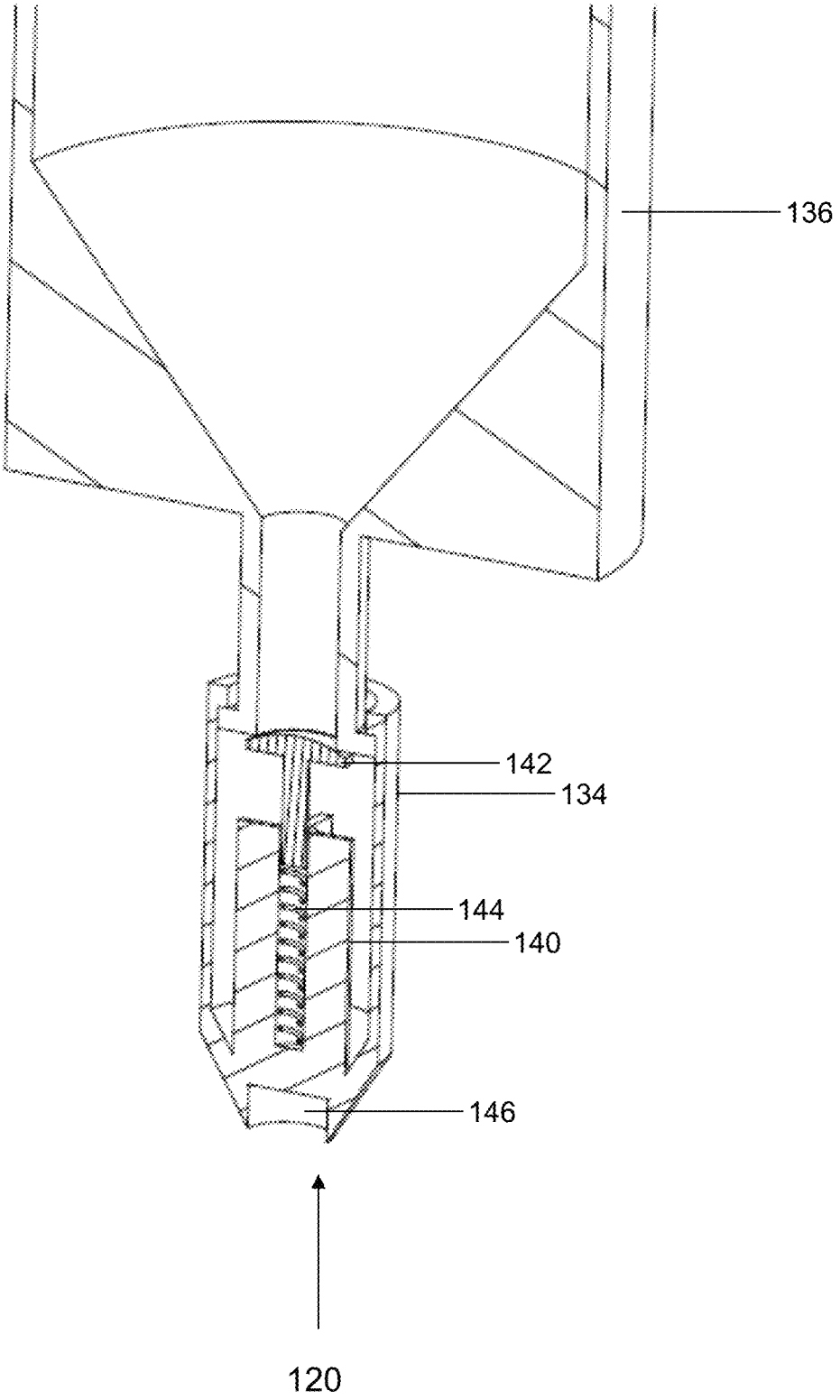
FIG. 29 illustrates a cross-sectional isometric view of the pigment holder of FIG. 25.
Figure 30:
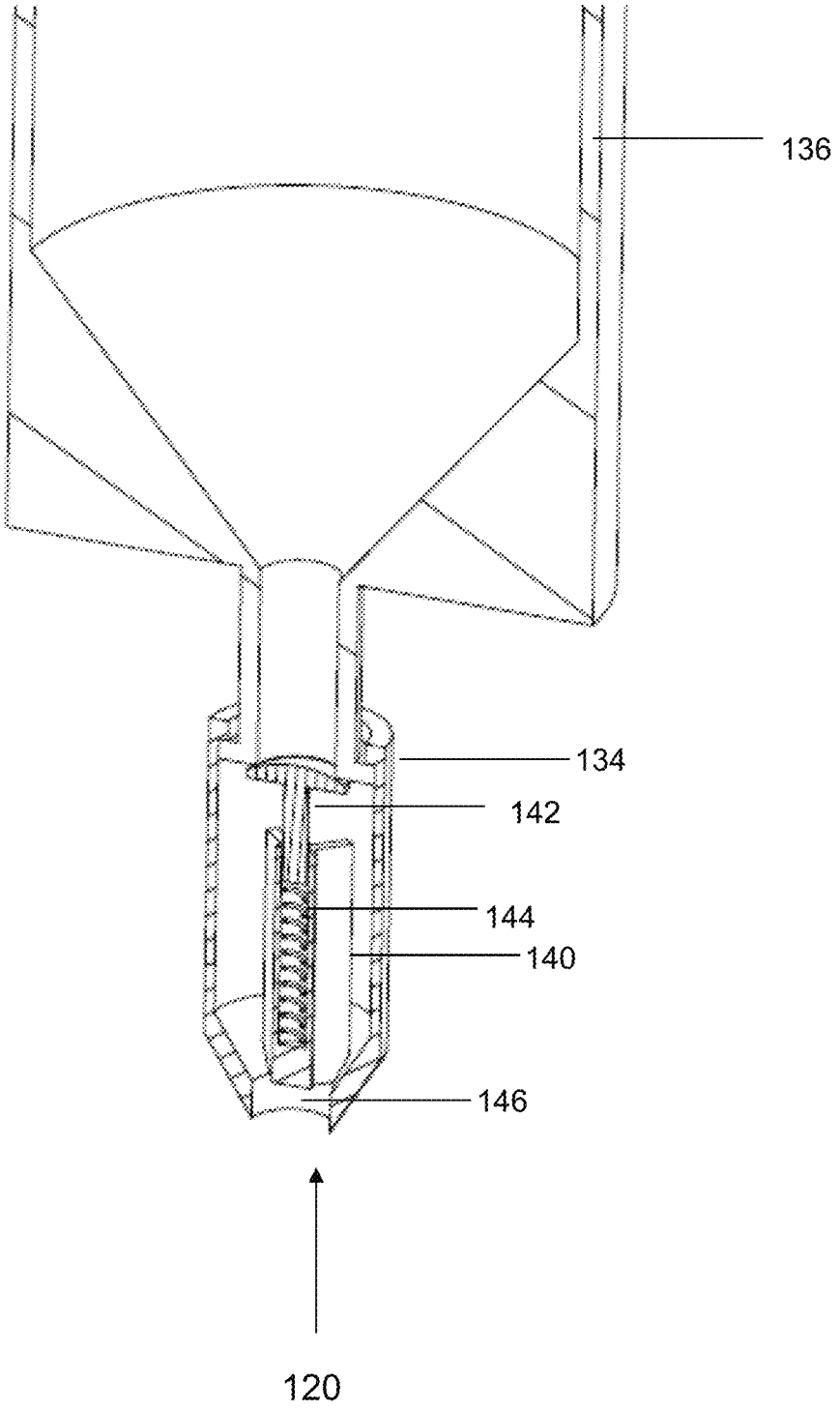
FIG. 30 illustrates another cross-sectional isometric view of the pigment holder of FIG. 25.
Figure 31:
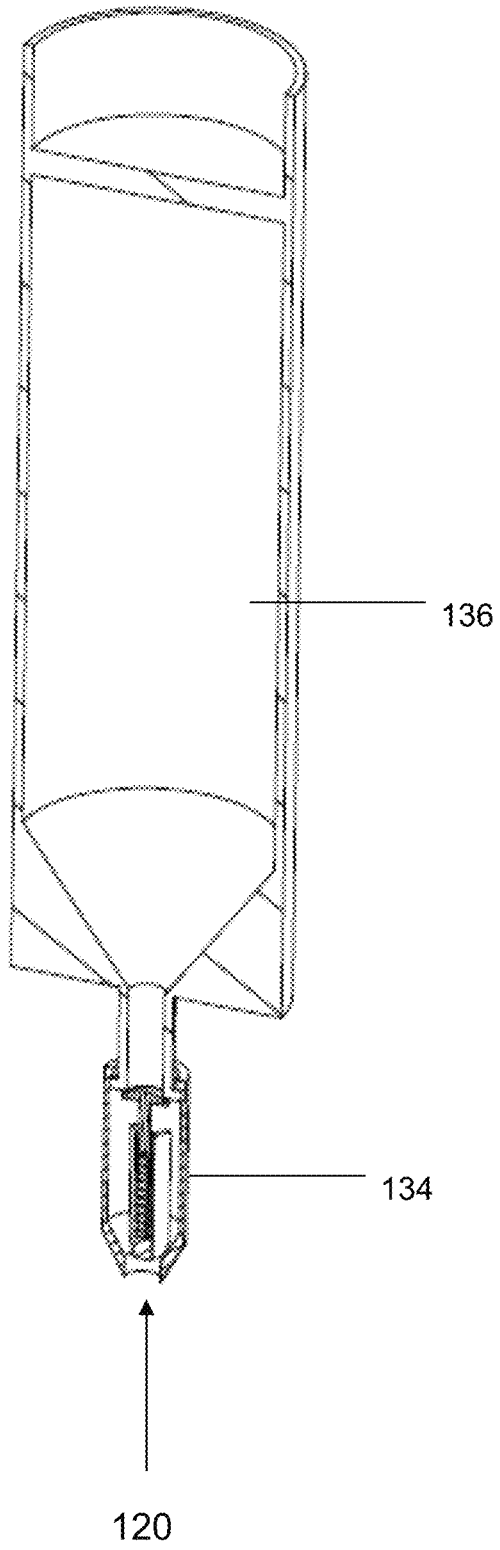
FIG. 31 illustrates a cross-sectional view of the pigment holder of FIG. 25 with a pigment bottle.
Figure 32:
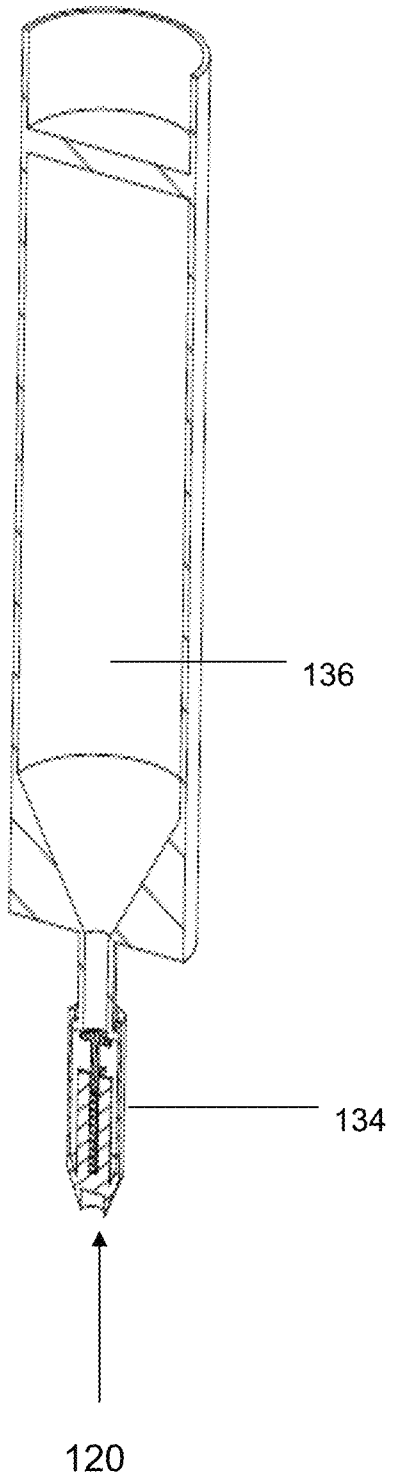
FIG. 32 illustrates another cross-sectional view of the pigment holder of FIG. 25 with a pigment bottle.

The spring 144 may be utilized to force the nozzle snap on device 134 up against the opening of the pigment bottle 136 so as to prevent pigments from flowing out while the portable nail polish creator 100 is either turned off or not in use. However, the spring will be adjustable enough so as to allow the force of the piston 138 to push the pigment out of the pigment bottle 136 and into the nail polish bottle 170. The shut off cap 142 may be positioned against the opening of the pigment bottle 140, such as shown in FIG. 29, due to the force applied by the spring 144. When the piston 138 pushes down on the diaphragm of the pigment bottle 136, the force on the pigments may push the shut off cap 142 and the spring 144 down, which will allow the pigment to flow around the shut off cap posts 140 and through the opening 146 of the nozzle snap on device 134 and into the nail polish bottle 170.

Figure 33:
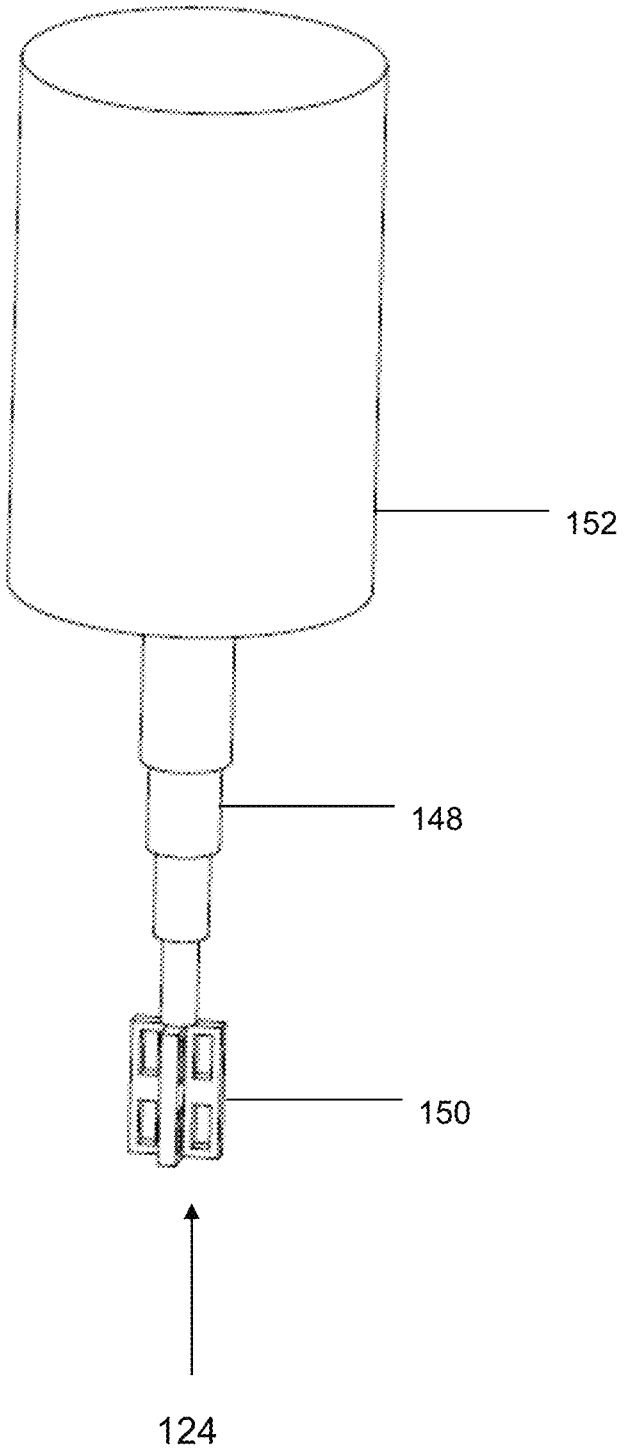
FIG. 33 illustrates an isometric view of a mixer assembly unit utilized in a portable nail polish creator.
Figure 34:
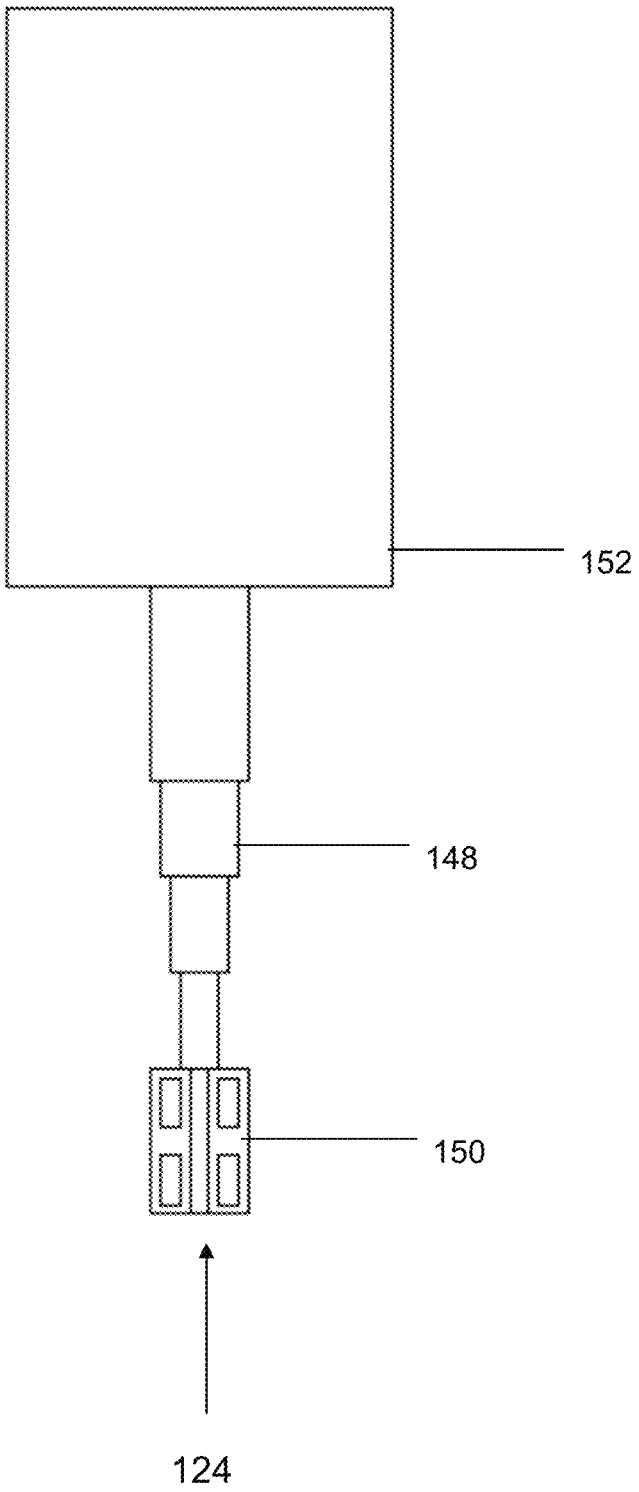
FIG. 34 illustrates a front view of the mixer assembly unit of FIG. 33.
Figure 35:
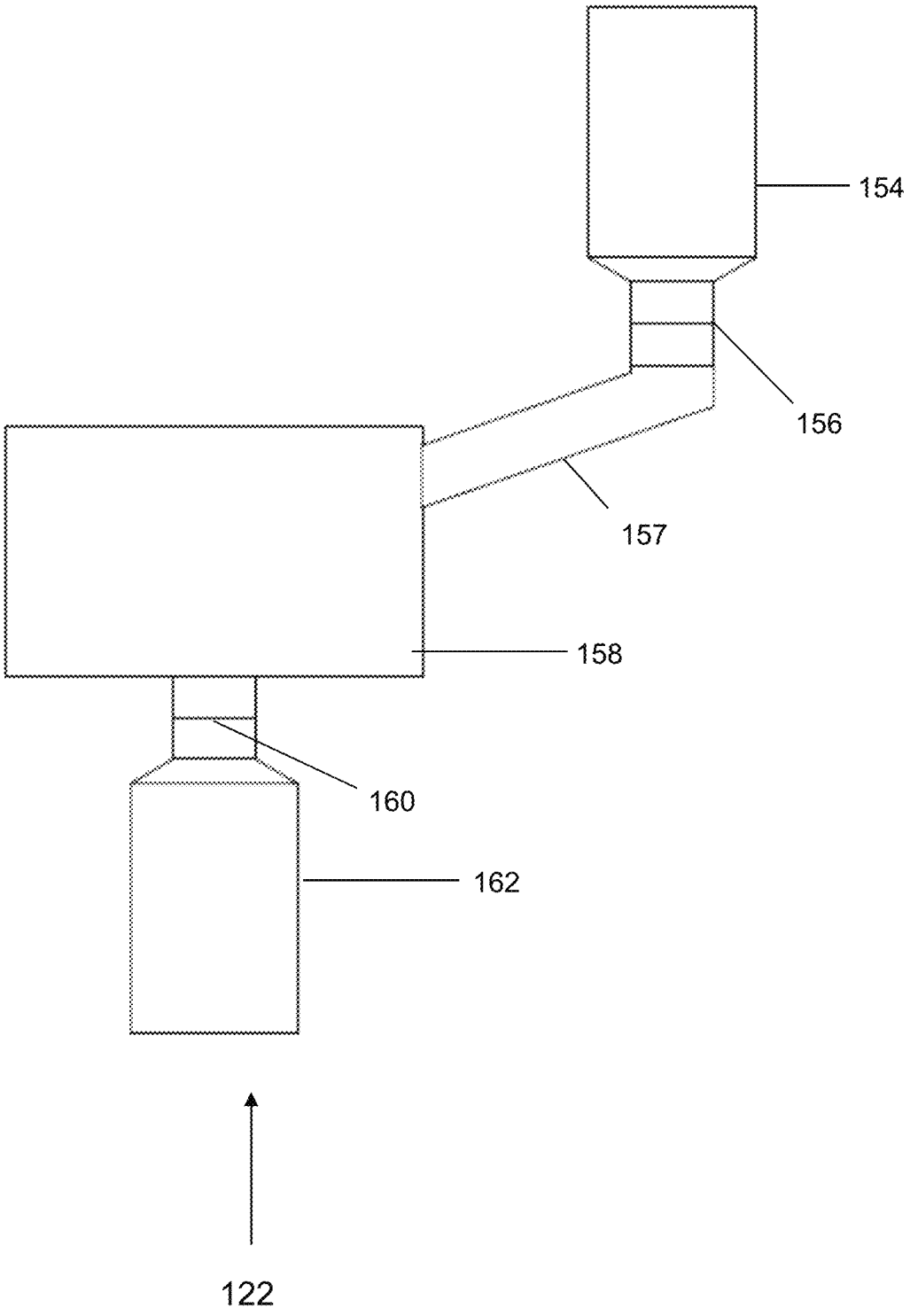
FIG. 35 a side view of a cleaning unit utilized in a portable nail polish creator.
Figure 36:
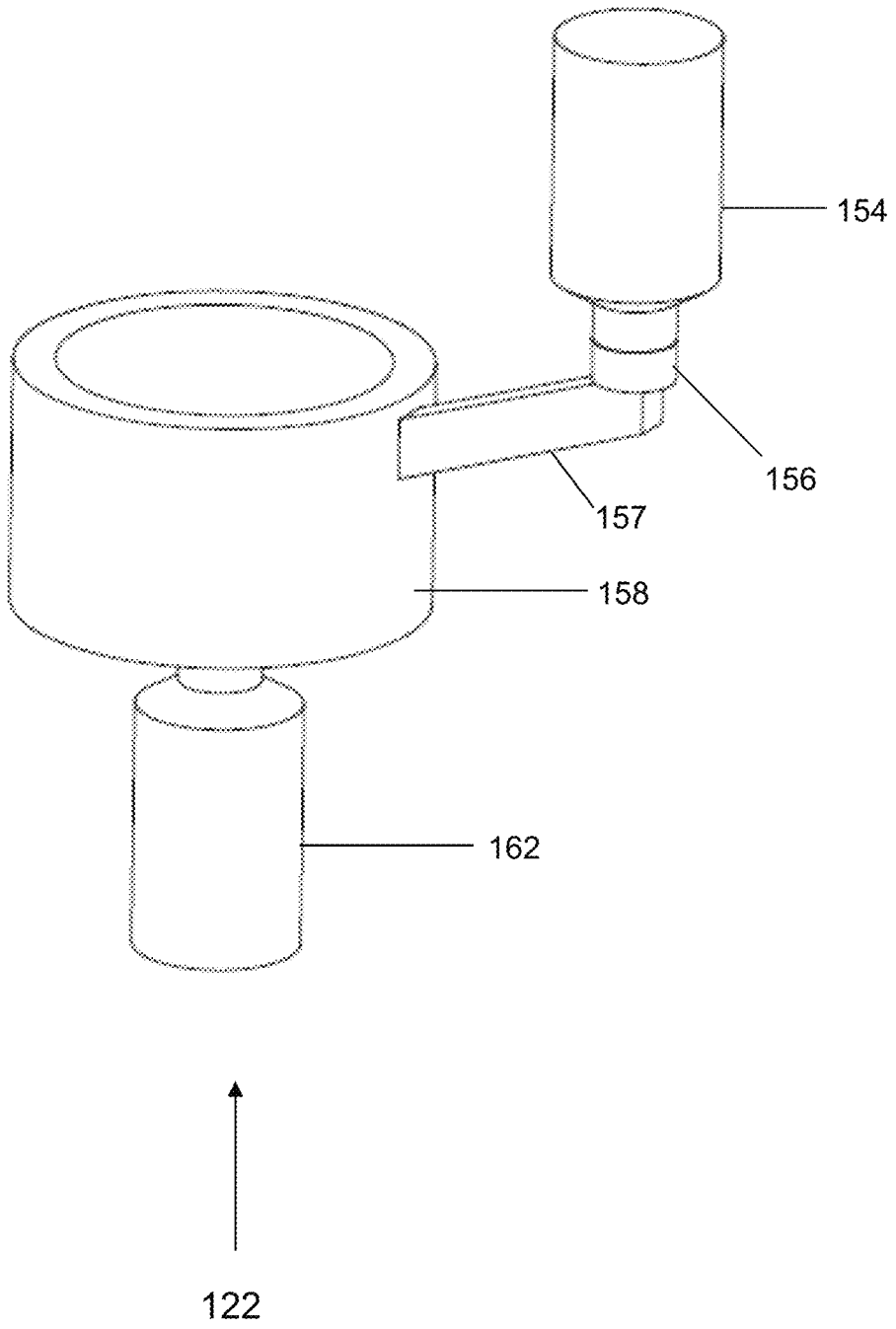
FIG. 36 illustrates an isometric view of the cleaning unit of FIG. 35.
Figure 37:
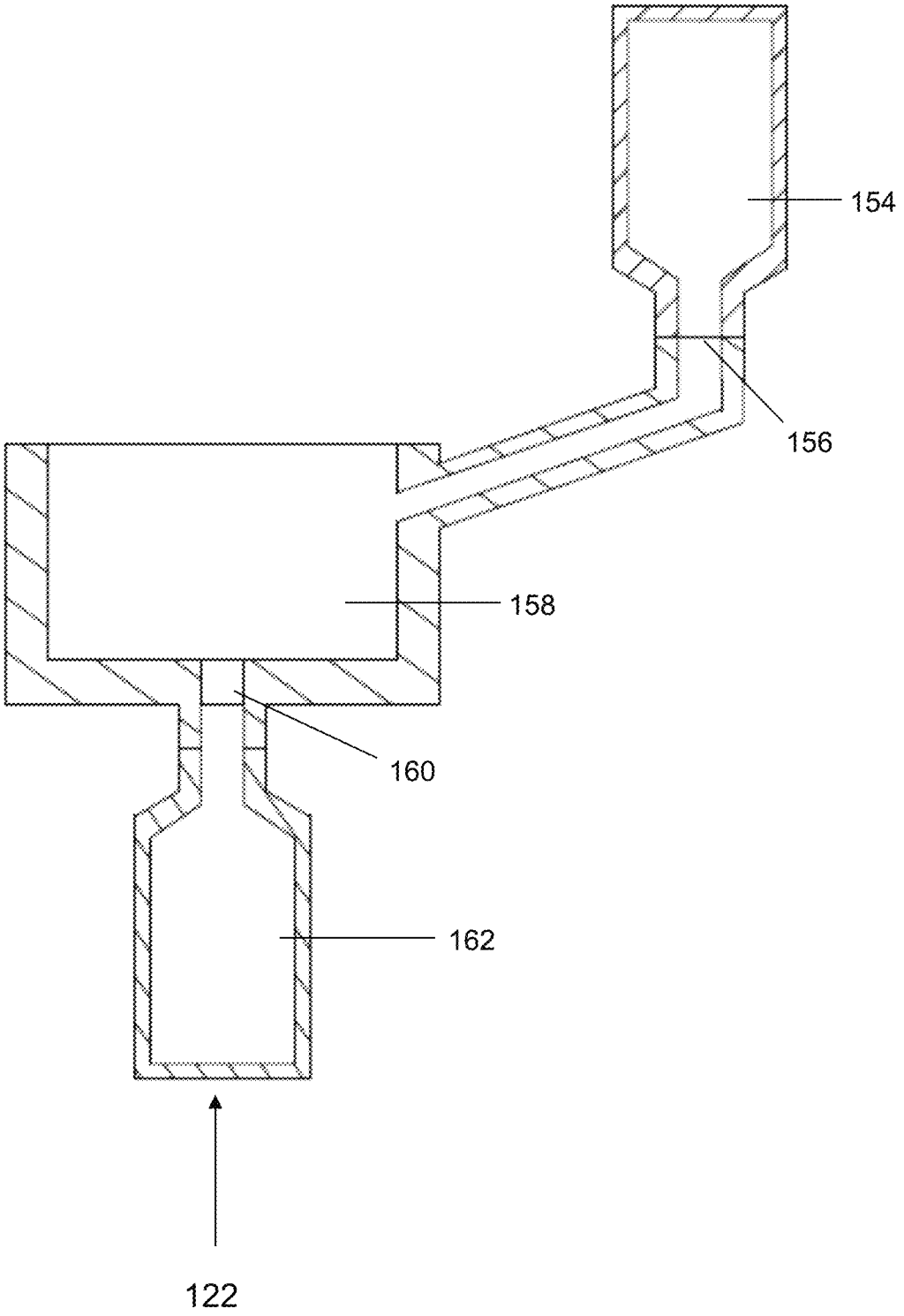
FIG. 37 illustrates a cross-sectional side view of the cleaning unit of FIG. 35.
Figure 38:
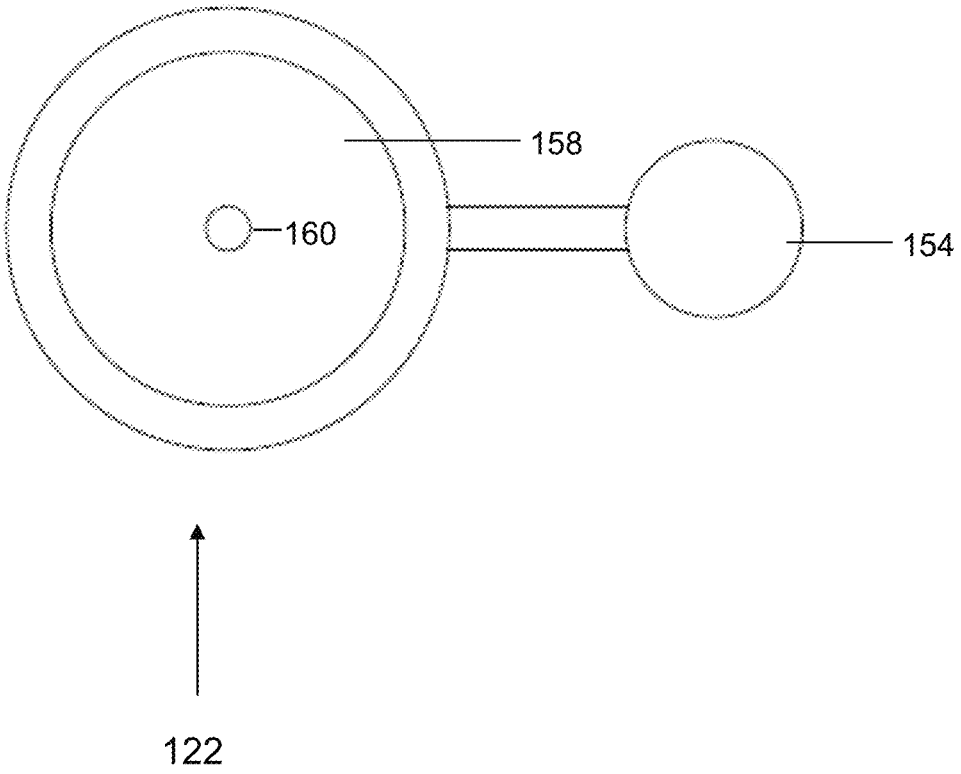
FIG. 38 illustrates a top view of the cleaning unit of FIG. 35.
Figure 39:
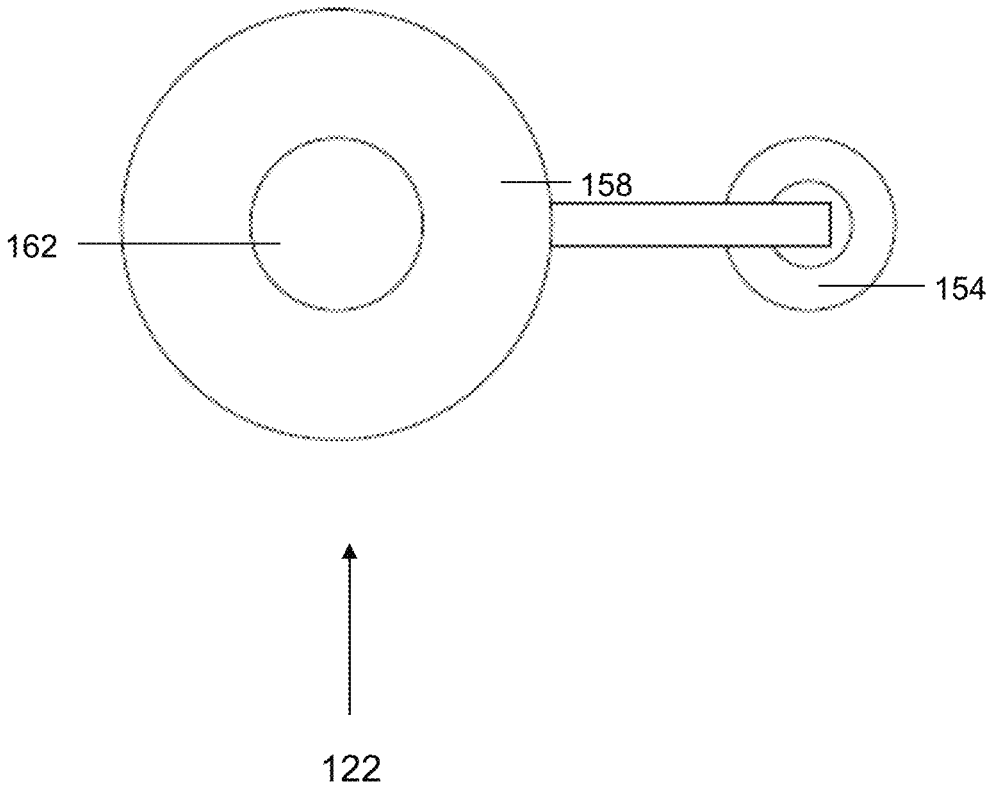
FIG. 39 illustrates a bottom view of the cleaning unit of FIG. 35.

Referring now also to FIGS. 33-34, further features are illustrated with respect to the mixer assembly 124. As disclosed herein, after the pigments are placed in the nail polish bottle the arm assembly 109 moves the nail polish bottle in position under the mixer assembly 124 for mixing. The mixer assembly 124 may include a telescoping handle 148, a mixer blade 150, and a motor 152. The telescoping handle 148 may allow the mixer blade 150 to be retracted away from or extended towards the nail polish bottle 170. In an embodiment, the telescoping handle 148 may be adjusted by utilizing the motor 152, which may be activated by the electronic processor. The mixer blade 150 may be removable from the mixer assembly 124 and may be replaced by the individual as needed. In an embodiment, the mixer blade 150 may have four extensions including cut out portions, such as shown in FIG. 33 (the fourth extension is not explicitly shown). The cut out portions and the configuration of the mixer blade 150 may allow the pigments to be mixed more easily. When the electronic processor sends a signal to the motor 152, the motor 152 may cause the mixer blade 150 to spin at a speed to effectively mix the pigments in the nail polish bottle 170 and prevent spilling or splashing. After mixing is completed, the mixer assembly 124 may move the mixer blade 150 to the cleaning unit 122, and the motor 152 may cause the mixer blade 150 to spin at a different rate in the cleaning unit solution of the cleaning unit 122 so as to effectively clean the mixer blade 150. After the mixer blade 150 is cleaned, the mixer assembly 124 may return to its original position.

Referring now also to FIGS. 35-39, the cleaning unit 122 is schematically illustrated in additional detail. Once the pigments have been dispensed into the nail polish bottle 170 and the mixer assembly 124 has finished mixing the pigments of the nail polish, the pigment holders 120, the pigment bottles 136, the nozzle snap on device 134, and the mixer blade 150 may be cleaned in the cleaning unit 122. In an embodiment, the pigment bottles 136, the nozzle snap on device 134, and the mixer blade 150 may be cleaned in the cleaning unit 122 whenever they are not actively being used to dispense pigments or mix the pigments. The cleaning unit 122 may be utilized to prevent clogging within the nozzle snap on device 134 and the pigment bottles 136, and also prevent previously used pigments that are on the mixer blade 150 from being introduced into a different nail polish selection. Additionally, the cleaning unit 122 may be activated or deactivated by the electronic processor.

The cleaning unit 122 may include a cleaner bottle 154 that may include a nail polish remover or cleaning solution for cleaning the various components that enter the cleaning unit. As illustrated in the Figures, the cleaner bottle 154 may be placed in a vertical upside down position on top of an opening valve 156. The opening valve 156 may be controlled by the electronic processor to ensure that the exact amount of cleaning solution is dispensed from the cleaner bottle 154. When the opening valve 156 is opened, the cleaning solution may go to the cleaning area 158 via an angled chute 157. The pigment holder unit 118 can lower the pigment bottles 136 and the nozzle snap on devices 134 into the cleaning area 158. Similarly, the mixer assembly 124 can lower the mixer blade 150 into the cleaning area when the cleaning area is not being used by the pigment holder unit 118.

Once the respective components have been cleaned using the cleaning solution in the cleaning area 158, the electronic processor may cause the mixer assembly 124 or the pigment holder unit 118 to return to their original positions and may send a signal to open valve 160 to allow the used cleaning solution to be dispensed into a waste bottle 162. The cleaner bottle 154 and the waste bottle 162 may be removed by the individual whenever they are empty or full respectively. In an embodiment, the electronic processor may cause a light or a diagram to display on the user interface 106 that may indicate an amount of cleaning solution remaining in the cleaner bottle 154 and/or an amount of used solution in the waste bottle 162. This may help the individual to know when the cleaner bottle 154 and the waste bottle 162 need to be replaced.

Figure 40:
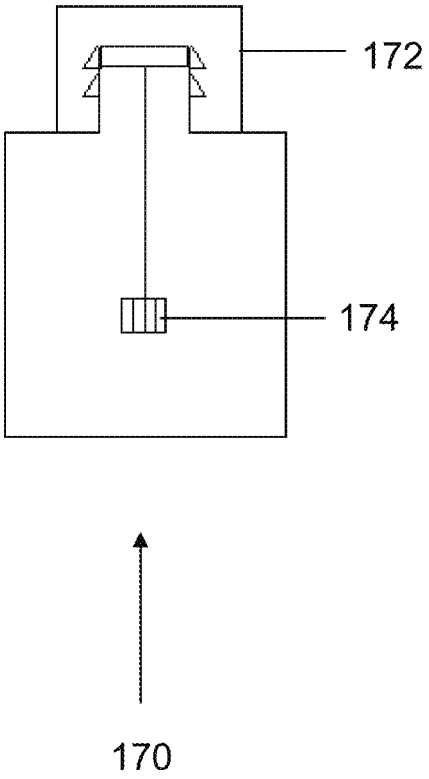
FIG. 40 illustrates a front view of a nail polish bottle utilized in a portable nail polish creator.

Referring now also to FIG. 40, the nail polish bottle 170 is schematically illustrated. The nail polish bottle 170 may include a cap 172 and a nail polish brush 174. The nail polish bottle 170 may be configured to have an opening such that the nozzle snap on devices 134, the pigments bottles 136, and the mixer blade 150 may be inserted and lowered into the nail polish bottle 170. The nail polish bottle 170 may be held by the nail polish holder 126 while the nail polish is being dispensed into the nail polish bottle 170 and while the nail polish is being mixed by the mixer assembly 124. Once the nail polish is mixed, the individual may remove the nail polish bottle 170 from the nail polish holder 126 and begin using the nail polish as desired.

Figure 41:
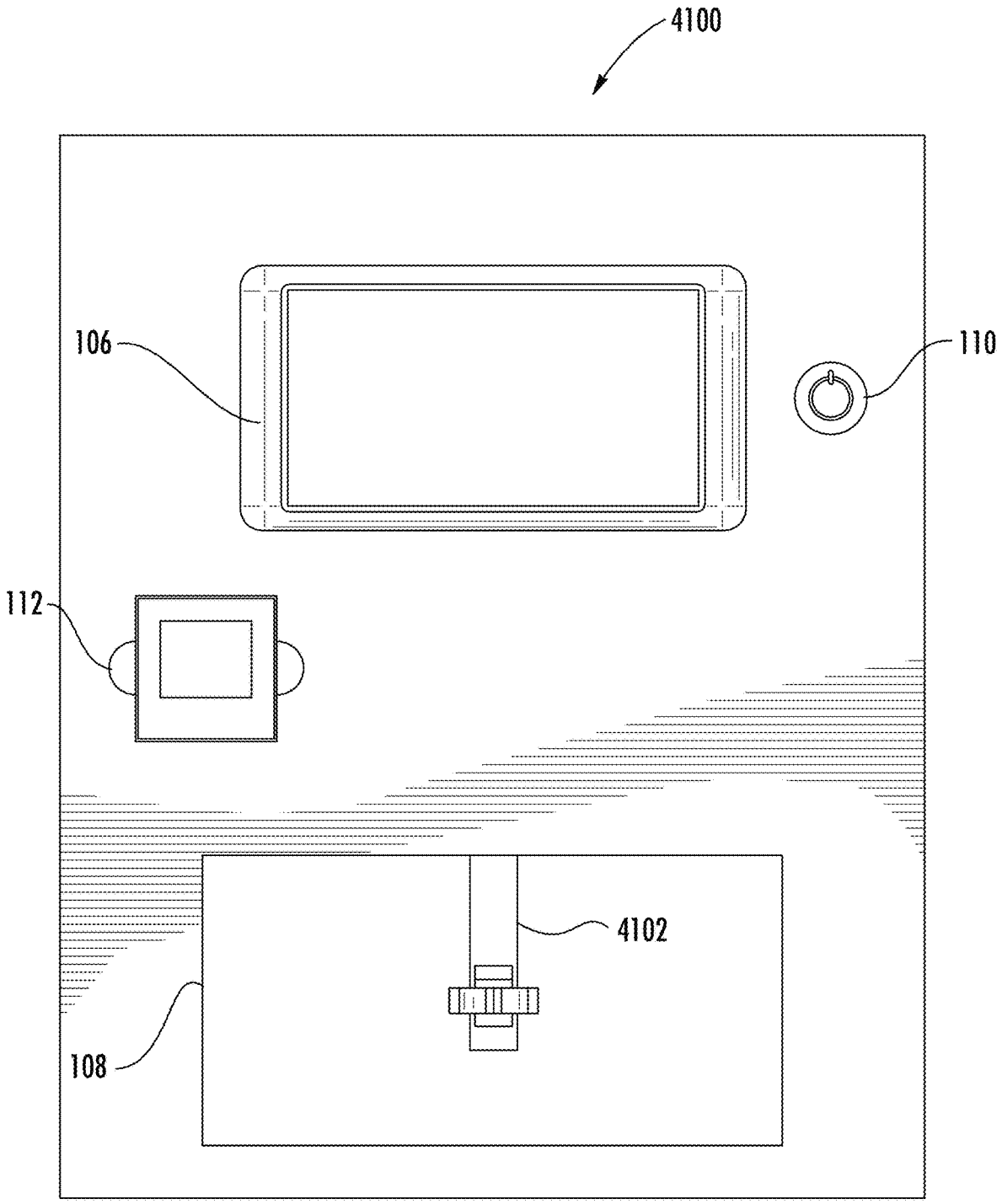
FIG. 41 illustrates a front view of a portable nail polish creator featuring a different arm assembly.
Figure 42:
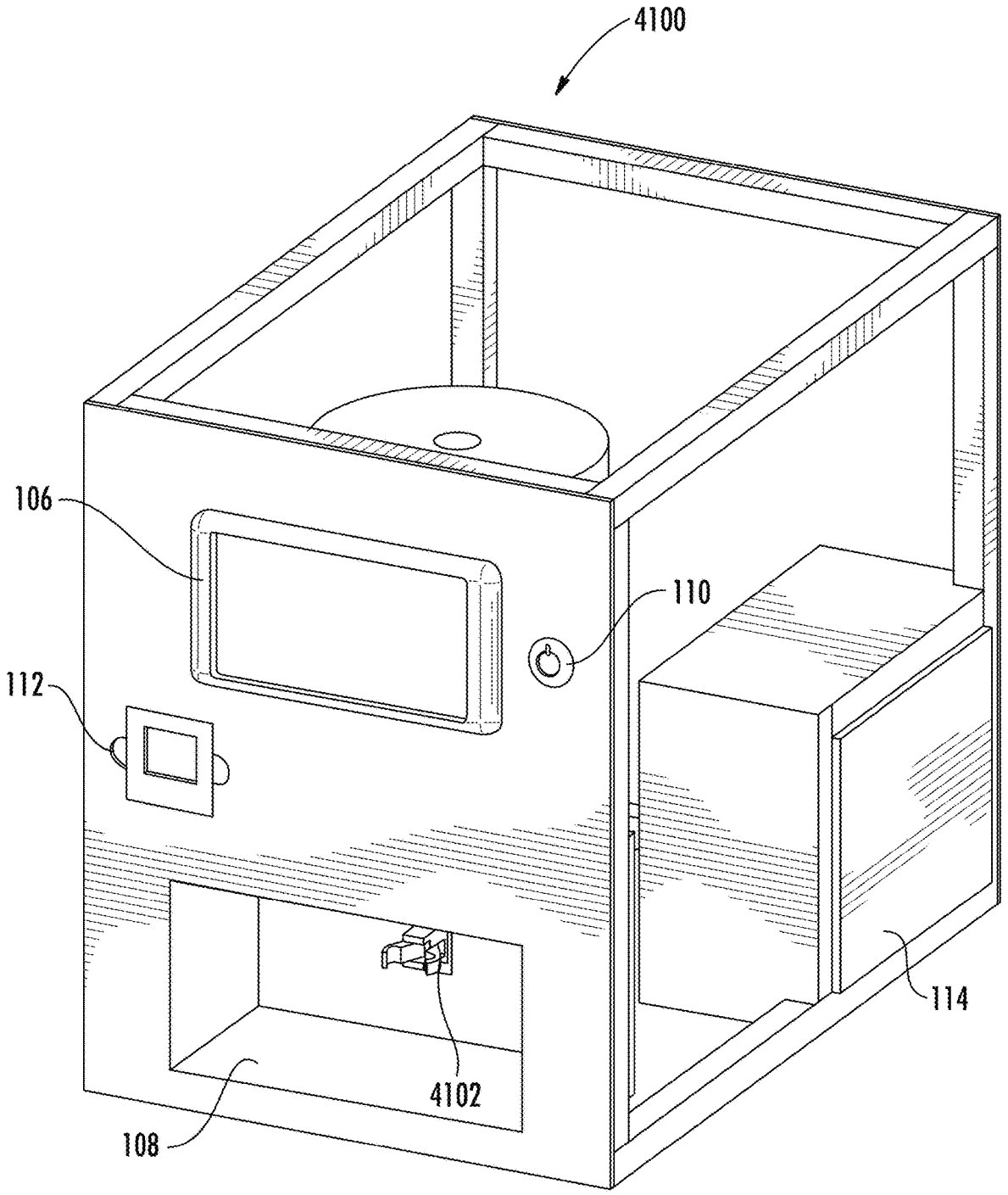
FIG. 42 illustrates an isometric view of the portable nail polish creator of FIG. 41.

Referring now also to FIGS. 41-42, a portable nail polish creator 4100 is provided. Portable nail polish creator 4100 may include an arm assembly 4102 that is vertical as opposed to arm assembly 109, which is horizontal. Notably, portable nail polish creator 4100 may include any of the other components utilized in nail polish creator 100. After a user has made a selection for a nail polish via the user interface 106, the portable nail polish creator 4100 may send a signal to arm assembly 4102 to lower down from a standard position to pick up a nail polish bottle 170, which may be placed in area 108. An electronic processor of the portable nail polish creator 4100 may then send a signal to lock the arm assembly 4102 into place under the pigment holder unit 118 so that pigments may be dispensed into the nail polish bottle 170. Once the pigments are dispensed into the nail polish bottle 170, the electronic processor may send a signal to the arm assembly to move down to a rotating position.

When in the rotating position, a locking top cap can either slide over an open section of the nail polish bottle 170, hinge down, or lock in place so as to cover the top of the nail polish bottle 170. When the arm assembly 4102 is locked into a position, a motor can rotate the arm of the arm assembly 4102 that is holding the nail polish bottle 170 in both clockwise and counter-clockwise rotations in order to mix the pigments in the nail polish bottle 170 with a base solution. Once mixing is complete, the arm assembly 4102 may lower the nail polish bottle 170 onto area 108 and the arms of the arm assembly 4102 may unlock the bottle from the arm assembly 4102. The individual may then proceed to take the nail polish bottle 170 and use the nail polish.

Figure 43:
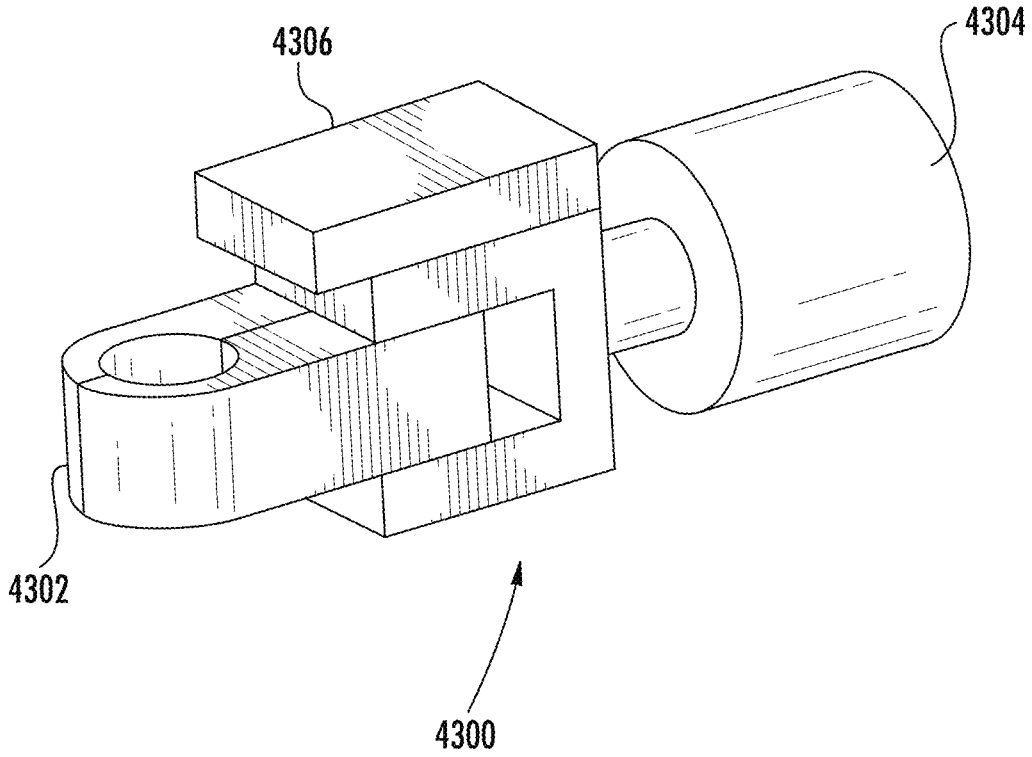
FIG. 43 illustrates an arm assembly featuring a nail polish top cover.
Figure 44:
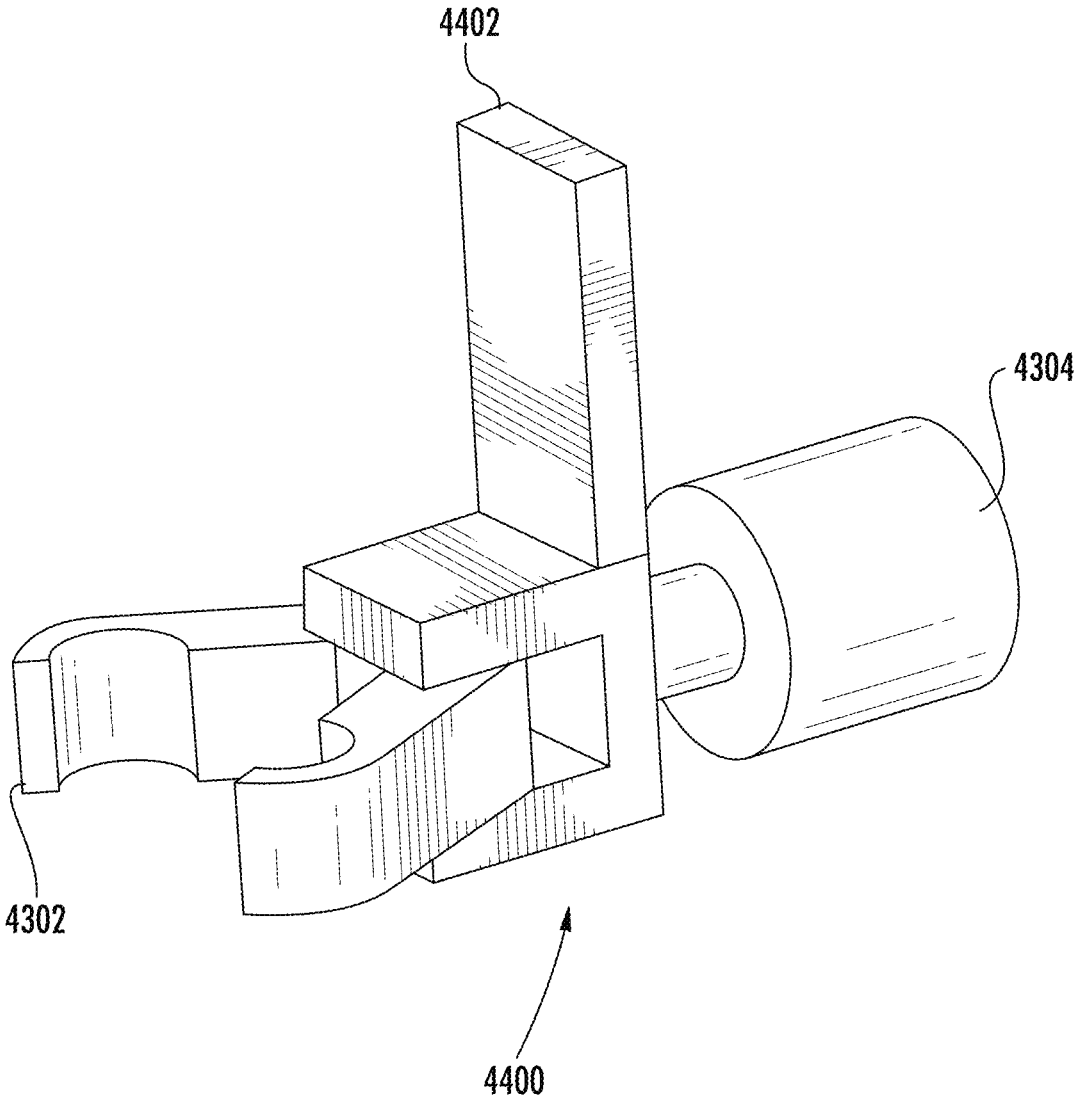
FIG. 44 illustrates an arm assembly featuring a hinged nail polish top cover.
Figure 45:
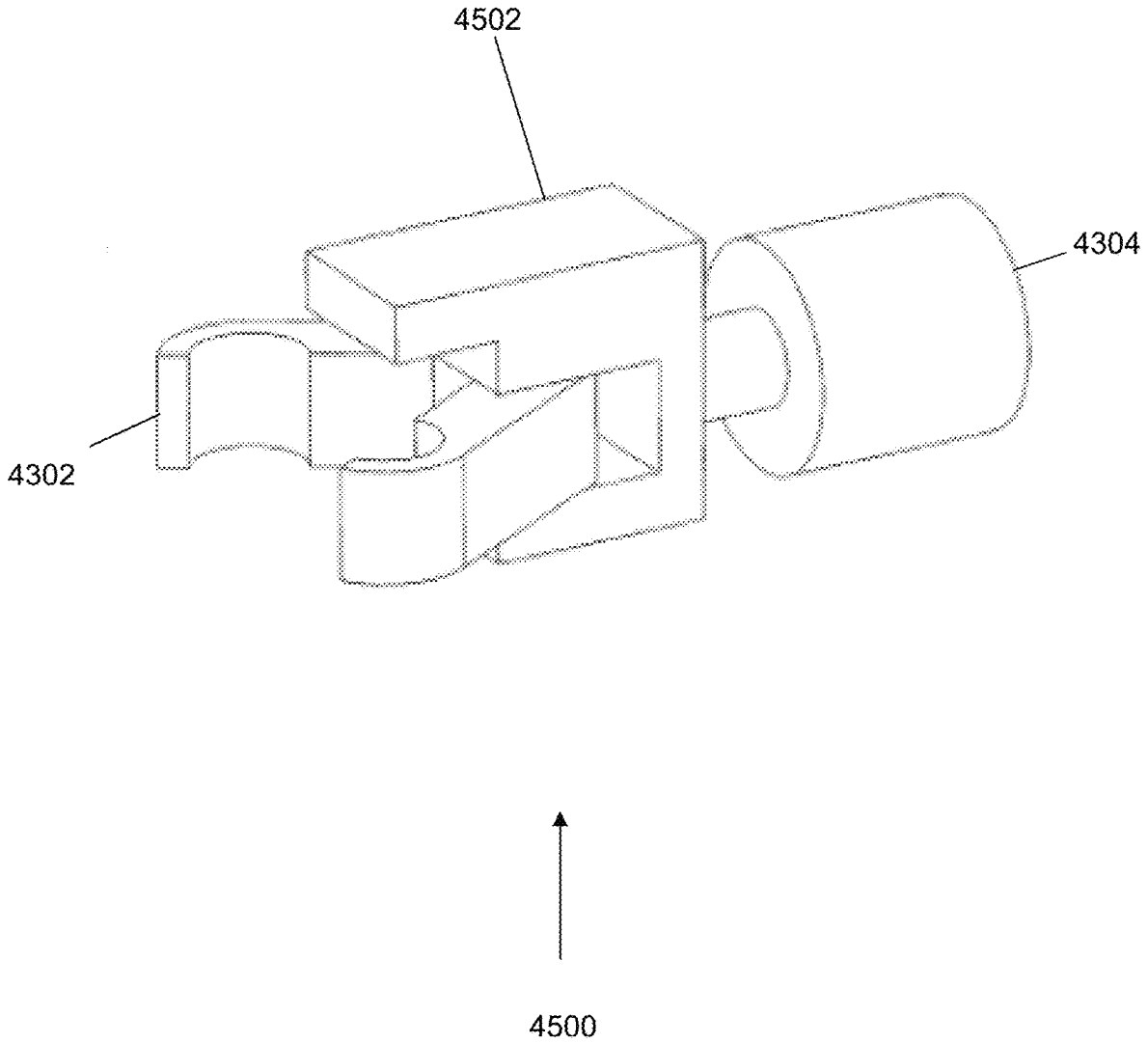
FIG. 45 illustrates an arm assembly featuring a sliding top nail polish bottle cover in an open position.

Referring now also to FIGS. 42-45, a series of arm assemblies for use in the portable nail polish creator 4100 or even portable nail polish creator 100 are illustrated. Arm assembly 4300 may include an arm 4302, which may be similar to nail polish holder 126. The arm 4302 may open and close based on signals from the electronic processor. For example, when the arm assembly 4300 needs to pick up the nail polish bottle 170 from the area 108, the electronic processor may send a signal to arm assembly 4300 to open the arm 4302 and lock the arm 4302 around the nail polish bottle 170. The arm assembly 4300 may also include a motor 4304 for powering the arm assembly 4300 and a nail polish top cover 4306. In FIG. 43, the nail polish top cover 4306, which may be utilized to cover the nail polish bottle 170 during mixing, is illustrated in a down position and the arm 4302 is shown in a locked position.

Arm assembly 4400 may also be utilized. Arm assembly 4400 may include an arm 4302 and a motor 4304 much like arm assembly 4300. However, arm assembly 4400 may include a hinged nail polish top cover 4402, which can cover the nail polish bottle 170 utilizing the hinge of the hinged nail polish top cover 4402. Arm assembly 4500 may also include an arm 4302 and a motor 4304. However, arm assembly 4500 may include a sliding nail polish top cover 4502. The arm assemblies 4300-4500 may be utilized with the portable nail polish creators disclosed herein.

Figure 46:
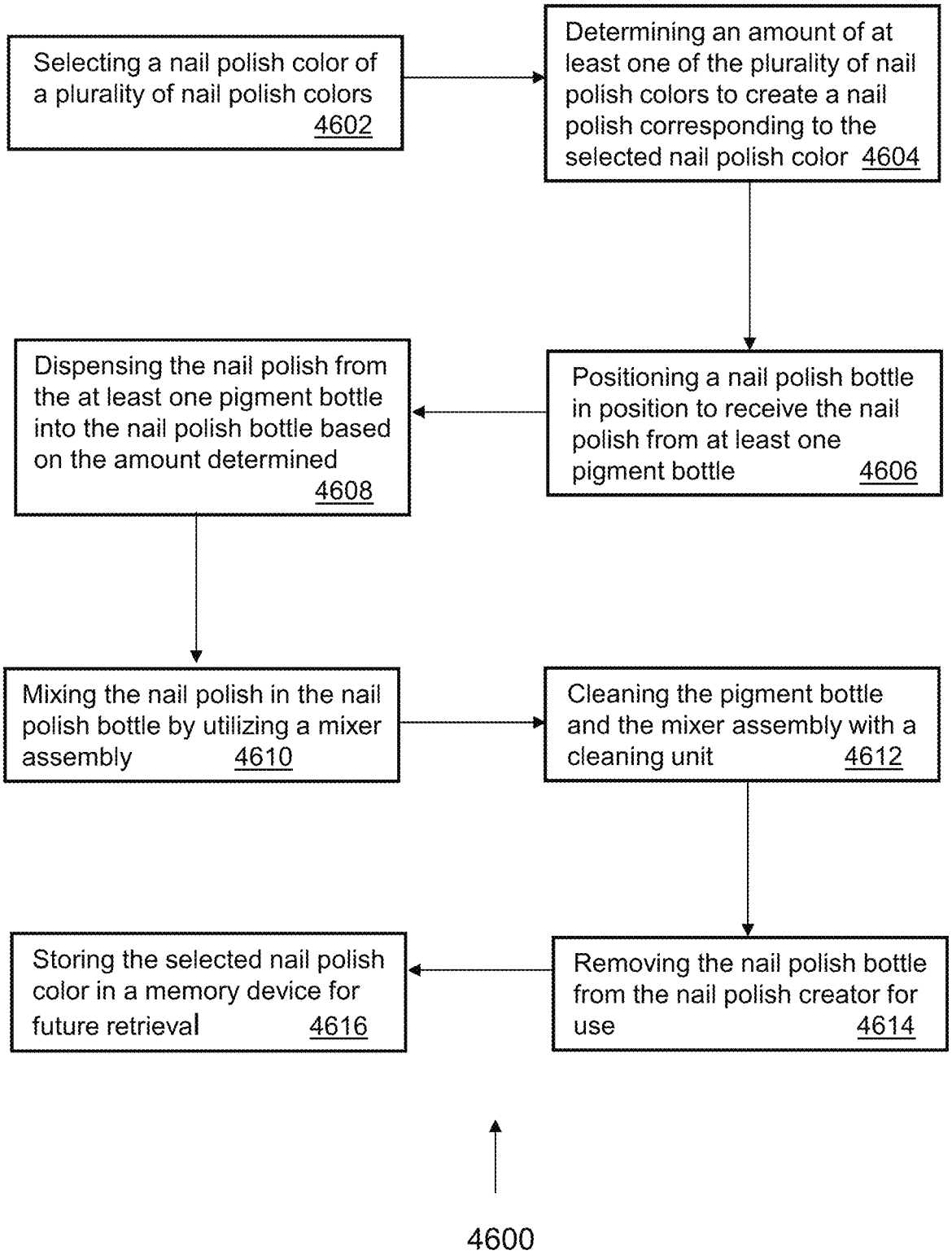
FIG. 46 illustrates an exemplary embodiment of a method for utilizing a portable nail polish creator.
Figure 47:
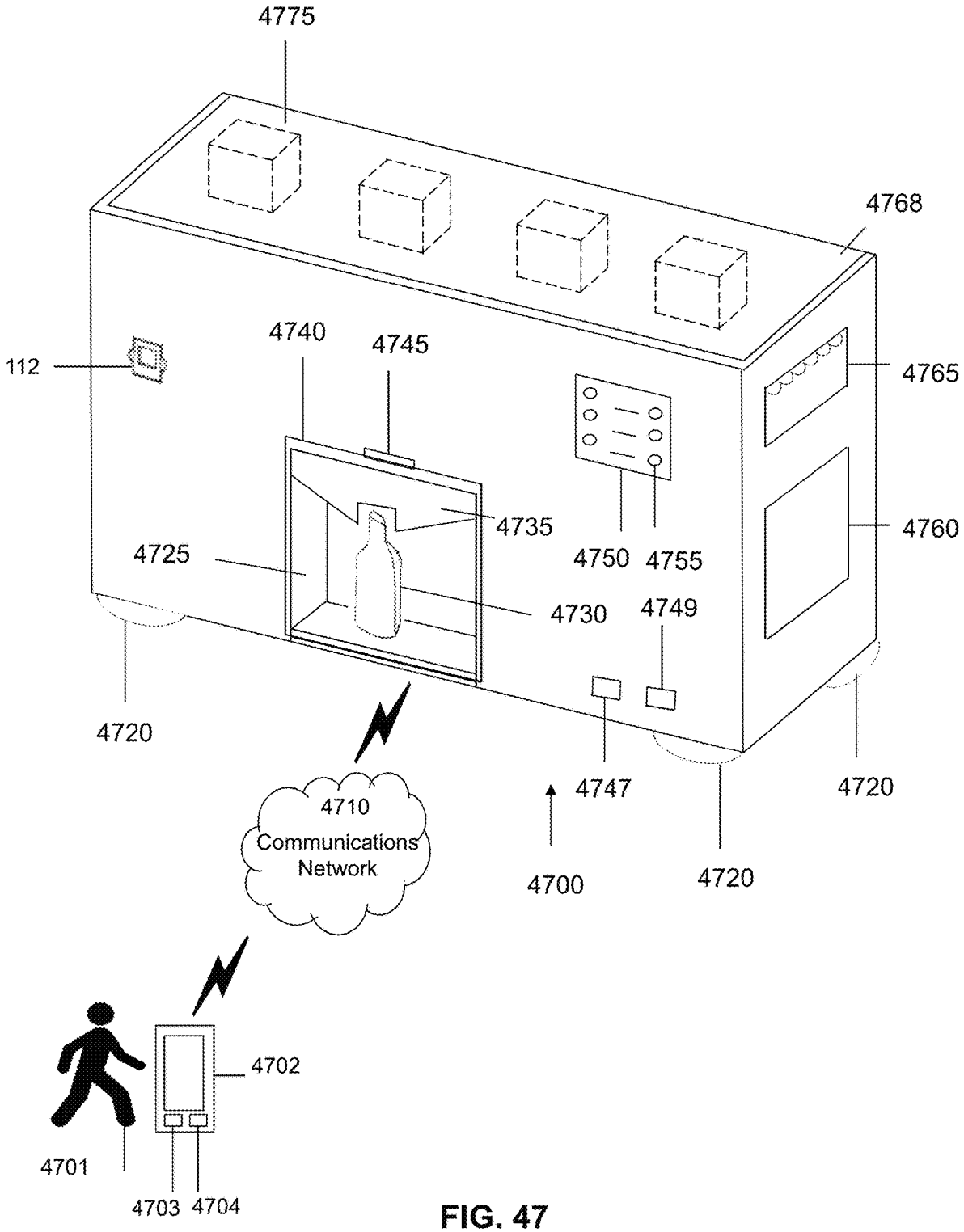
FIG. 47 illustrates an isometric view of the exterior of a portable nail polish creator according to an exemplary embodiment which features a door of the nail polish creator in a closed position and includes an optional spectrometer.
Figure 48:
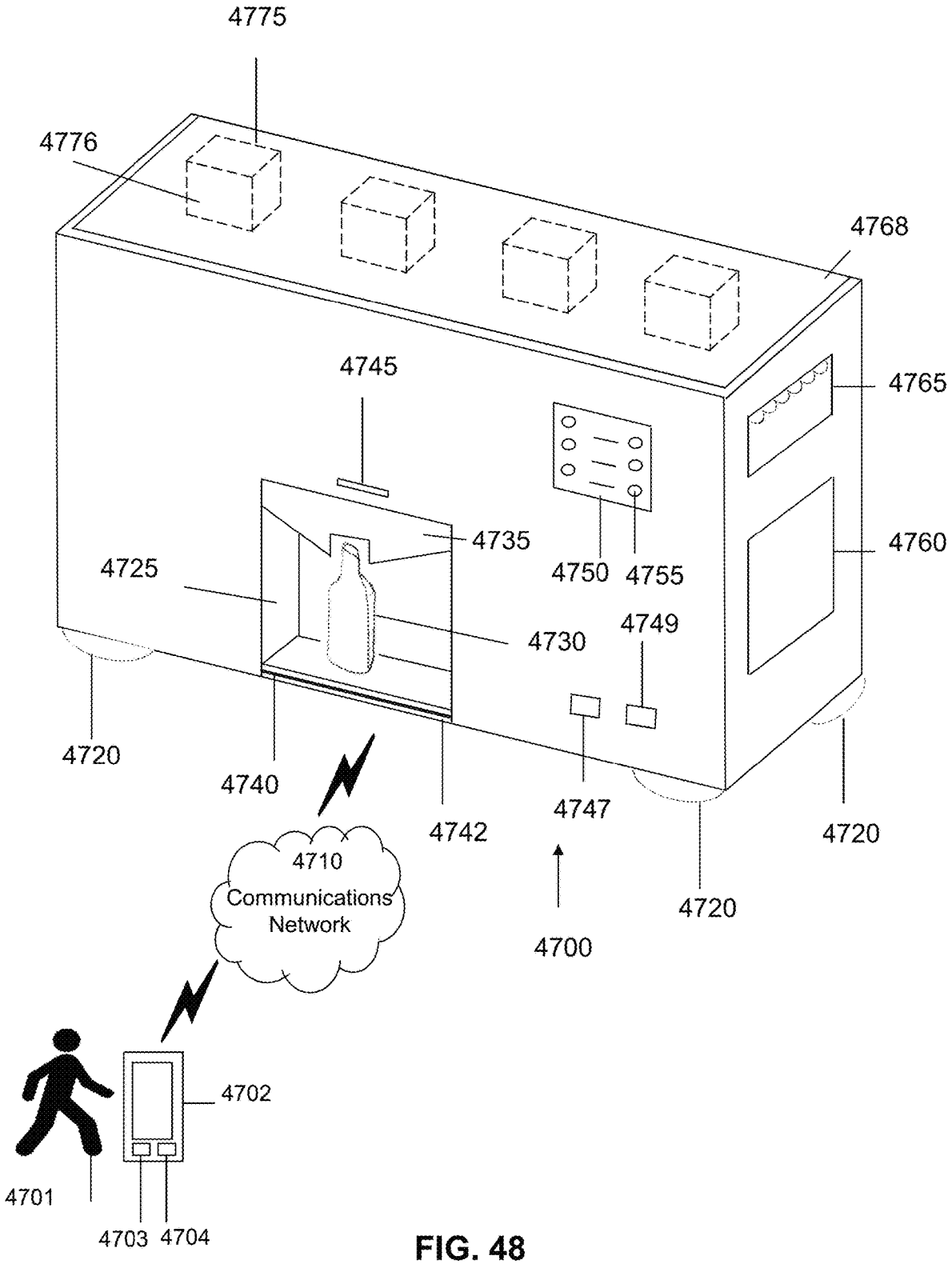
FIG. 48 illustrates another isometric view of the exterior of the portable nail polish creator of FIG. 47 with a door of the nail polish creator in an open position and not including the optional spectrometer of FIG. 47.
Figure 49:
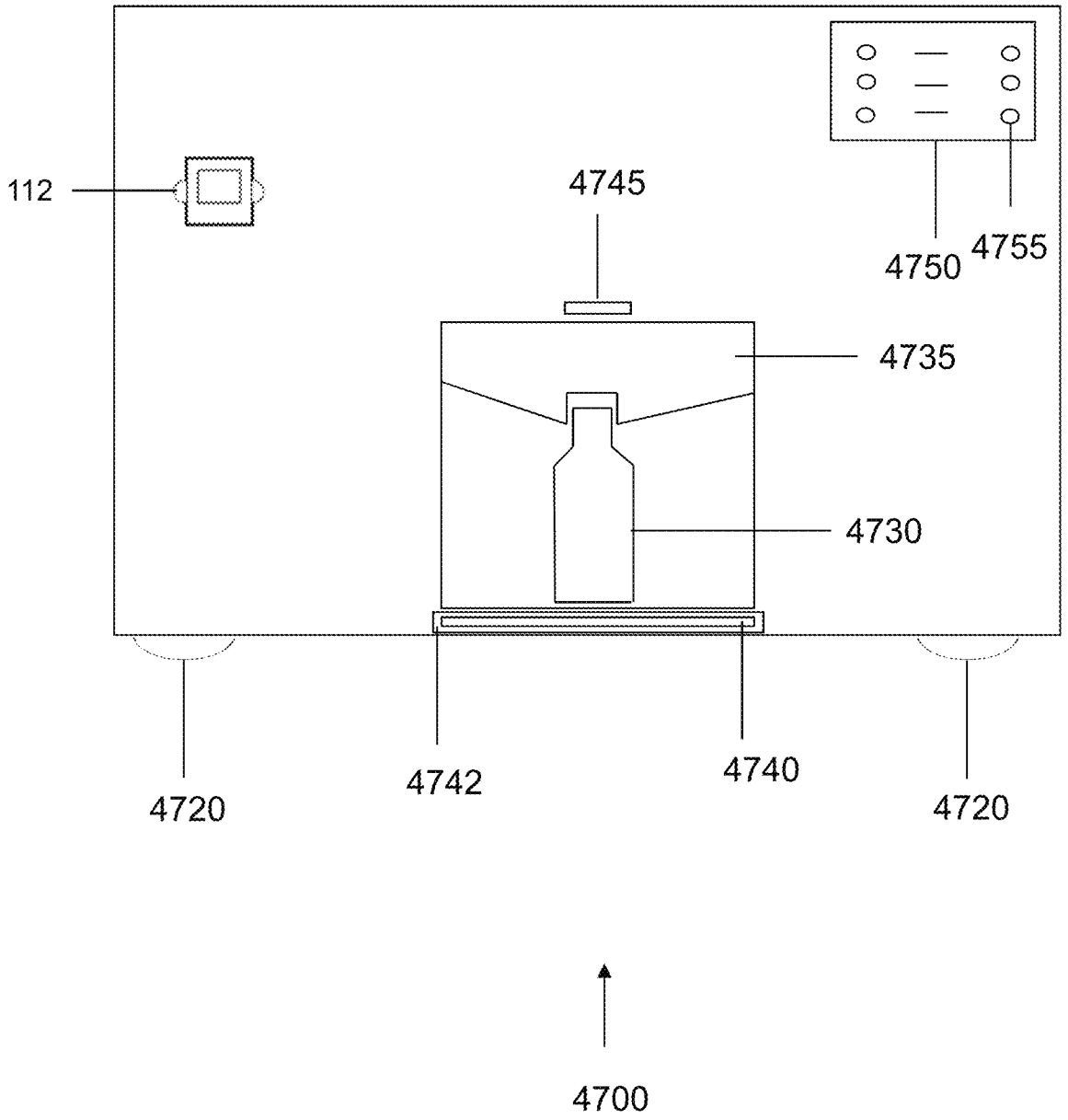
FIG. 49 illustrates a front exterior view of the portable nail polish creator of FIG. 47 with a door of the nail polish creator in an open position.
Figure 50:
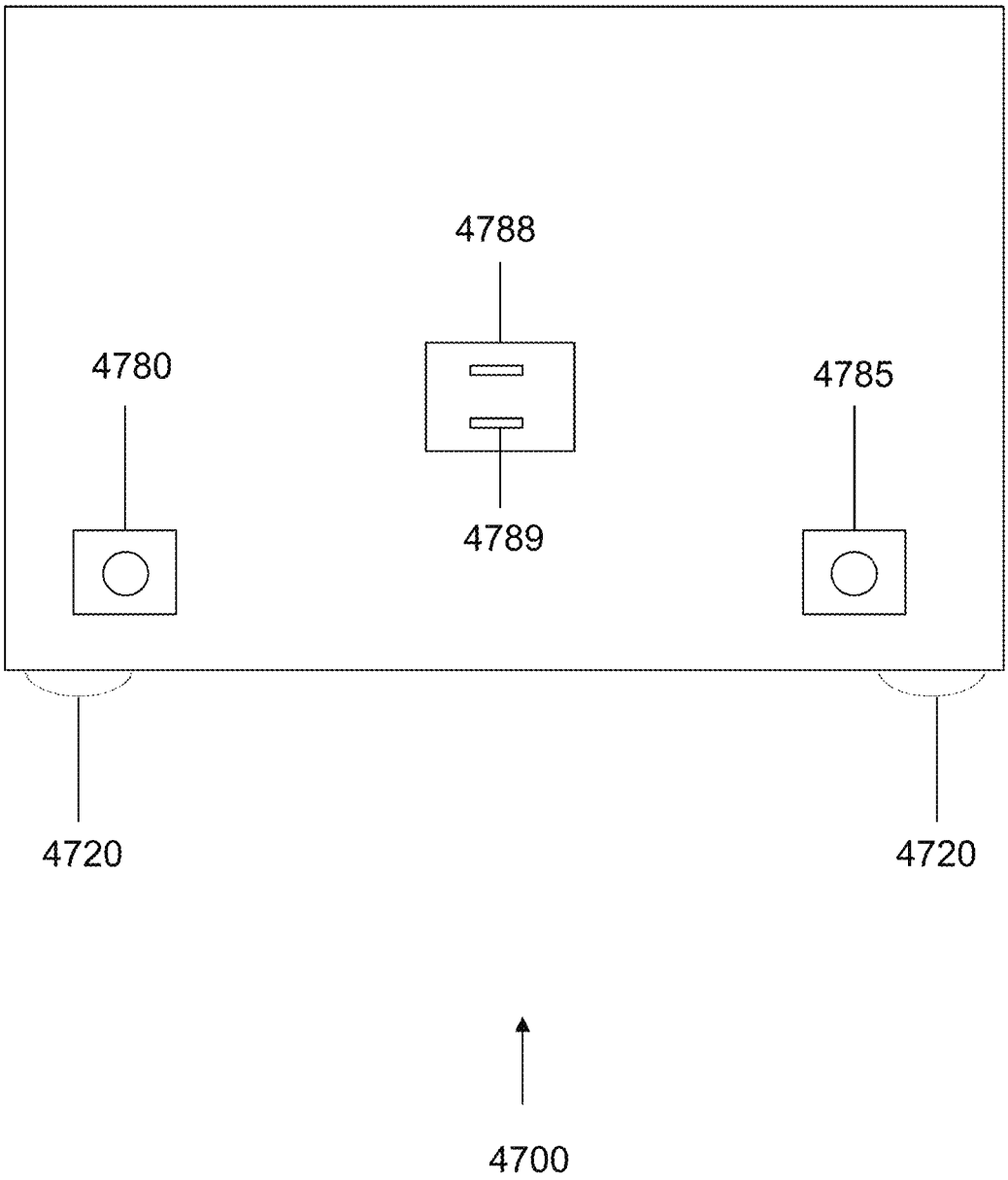
FIG. 50 illustrates a back exterior view of the portable nail polish creator of FIG. 47.
Figure 51:
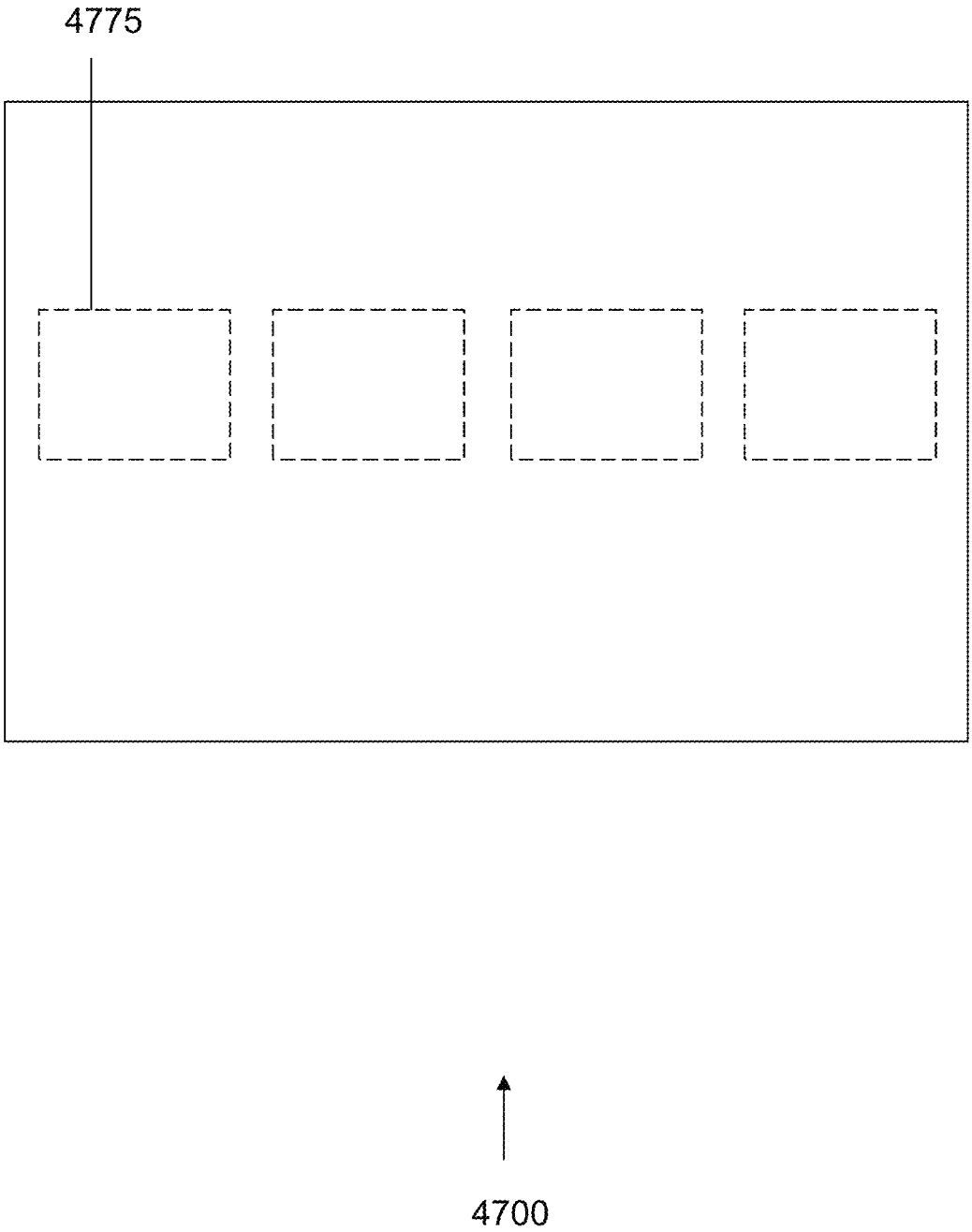
FIG. 51 illustrates a top exterior view of the portable nail polish creator of FIG. 47.
Figure 52:
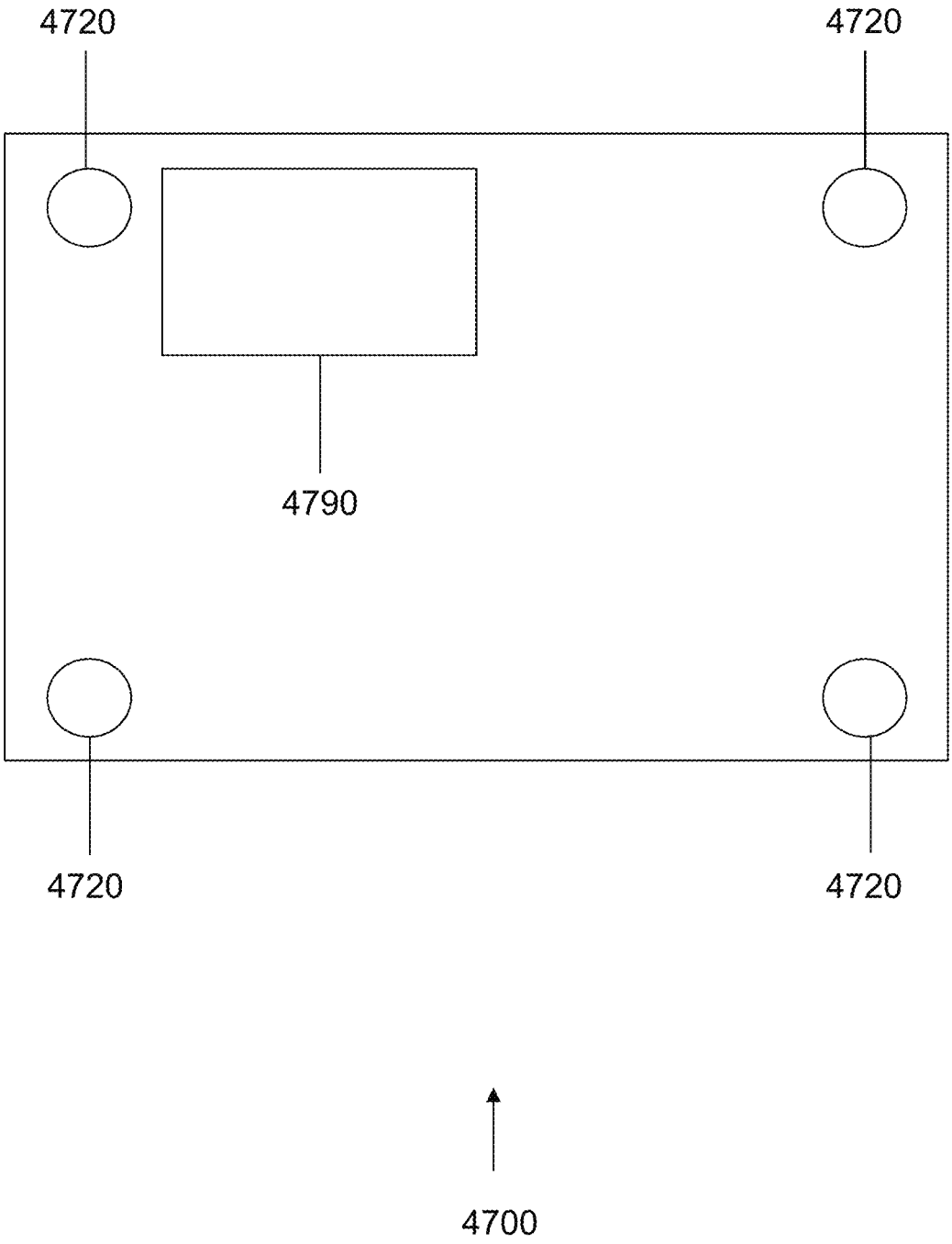
FIG. 52 illustrates a bottom exterior view of the portable nail polish creator of FIG. 47.
Figure 53:
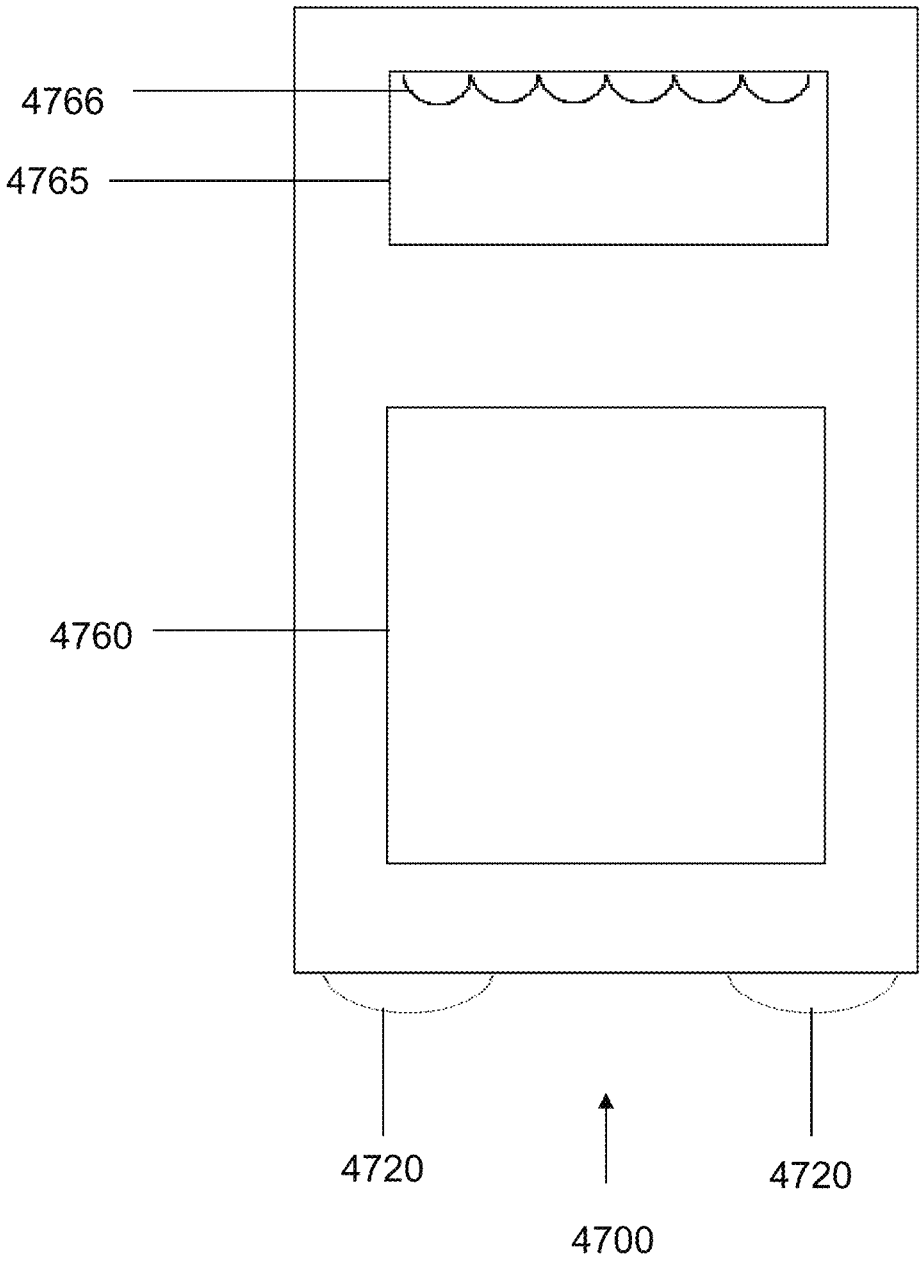
FIG. 53 illustrates a right side exterior view of the portable nail polish creator of FIG. 47.
Figure 54:
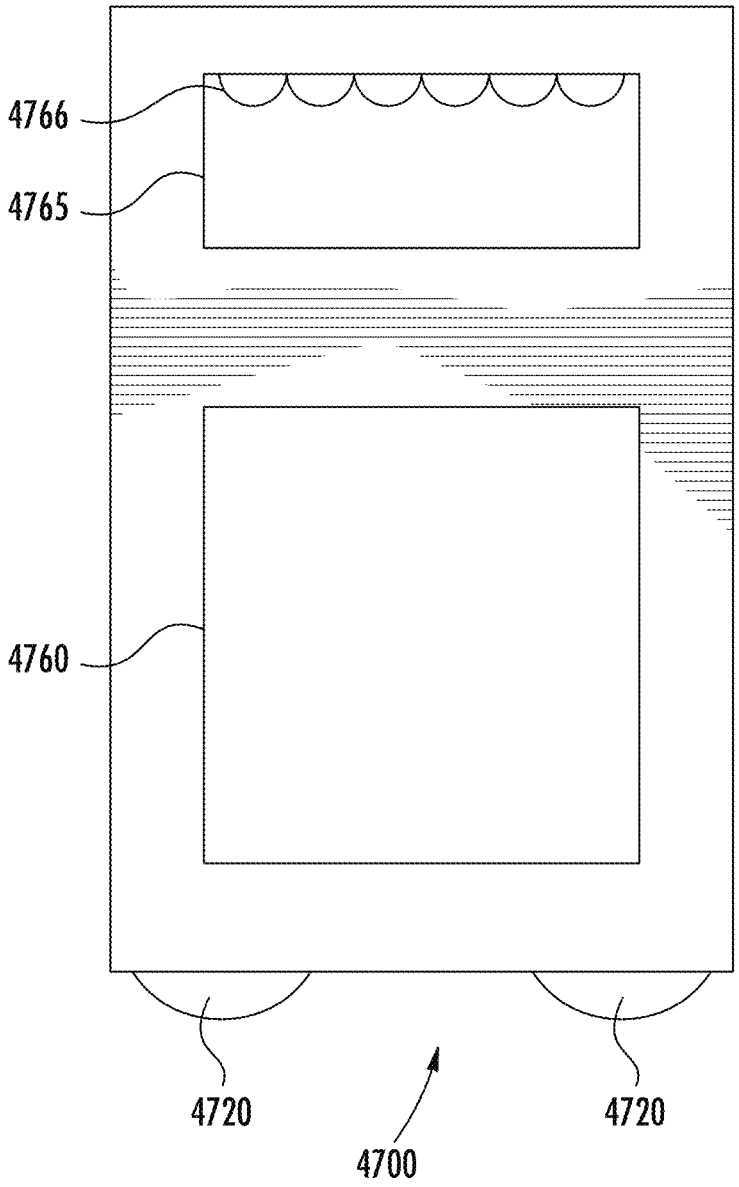
FIG. 54 illustrates a left side exterior view of the portable nail polish creator of FIG. 47.

Referring now to FIG. 46, an illustrative method 4600 for utilizing a portable nail polish creator is schematically illustrated. Notably, the method 4600 is not intended to be limited to the apparatuses and components described above or illustrated in the drawings. The method 4600 can begin with step 4602, which may include selecting a nail polish color from a plurality of nail polish colors via a user interface 106 of the portable nail polish creator 100. At step 4604, the method 4600 may include determining an amount of at least one of the plurality of nail polish colors to be used to create a nail polish corresponding to the selected nail polish color. The determination of the amount may be performed by the electronic processor described above or any other electronic processor. At step 4606, the method 4600 may include positioning a nail polish bottle, such as nail polish bottle 170, in position to receive the nail polish from at least one pigment bottle, such as pigment bottle 136. In an embodiment, the nail polish bottle may be positioned using the arm assembly 109.

The method 4600 may also include, at step 4608, dispensing the determined amounts of the nail polish from each of the pigment bottles 136 needed to create the selected color into the nail polish bottle 170. Once all of the pigments are successfully dispensed into the nail polish bottle 170, the method 4600 may include mixing the nail polish in the nail polish bottle 170 by utilizing the mixer assembly 124. The mixer blade 150 of the mixer assembly 124 may be dipped into the nail polish and may be rotated at a desired speed to adequately mix and create an even nail polish color. At step 4612, the method 4600 may include cleaning the pigment bottle 136 and/or the mixer assembly 124 using the cleaning unit 122. After the mixing is completed, the individual may then remove the nail polish bottle from the nail polish creator 100 and use the nail polish as needed at step 4614. At step 4616, the method 4600 may include storing the selected nail polish color in a memory device for future retrieval from the portable nail polish creator 100.

In an embodiment, the method 4600 may further include providing a color selection option from a set of colors, an option to create a customized color, an option to select a previously saved color, and an option to utilize the spectrometer 112 to scan a color of an object via the user interface 106. The method 4600 may also include scanning a color of an object by utilizing the spectrometer 112. The color of the object scanned may then be transmitted to the electronic processor, which can determine the amounts of one or more nail polish colors to create the selected nail polish color based on the color of the object scanned Notably, the method 4600 may incorporate any of the functionality or features described for the various embodiments of the portable nail polish creator 100 or the portable nail polish creator 4100 described herein and is not intended to be limited to the description above.

The portable nail polish creator 100 may also be provided as a kit to various individuals. The kit may separately include the housing 102, the handle 104, the user interface 106, the arm assembly 109, the on/off switch 110, the spectrometer 112, the storage area/compartment 114, the pigment holder unit 118, the pigment holders 120, the cleaning unit 122, the mixer assembly 124, the pigment bottles 136, the nail polish bottle 170, any of the other components described herein, or various combinations of such components. In an embodiment, the kit may be provided with the various combinations of the components already attached to one another. In another embodiment, each of the items that are part of the portable nail polish creator 100 may be packaged separately. The kit may also include instructions for assembling and disassembling the portable nail polish creator 100 as well. Additionally, the instructions may include various steps for using portable nail polish creator 100.

In addition to the embodiments described above and referring now also to FIGS. 47-58, a nail polish creator 4700 and method 5800 may be provided. Notably, the nail polish creator 4700 may include any of the components, functionality, and features as described for portable nail polish creators 100, 4100. The nail polish creator 4700 and the method 5800 for utilizing the nail polish creator 4700 may allow an individual to select a color from a pallet of standard colors, create their own color, use a spectrometer 112 to scan a desired color, or select a color from a previously saved set of colors. The user 4701 may select the color, such as by using a device that is separate from the nail polish creator 4700. The selection may be transmitted by the device to the nail polish creator 4700, such as via wireless communication link and/or wired link. The nail polish creator 4700 may then determine an amount from at least one of a plurality of colors to be used in creating the nail polish. Pigments for each color needed to create the selected nail polish may be dispensed into a nail polish bottle and then mixed by a mixer assembly or mixed by the user 4701 herself. The individual can then remove the bottle from the nail polish creator and use then nail polish as she or he desires. It should be understood by one of ordinary skill in the art that the exemplary embodiments of the present disclosure can be applied to other types of nail polish creators and methods, such as those described below. Additionally, features of the exemplary embodiments can be used with each other and/or with alternative features that are not shown.

In FIGS. 47-54, the nail polish creator 4700 is illustratively shown to have a particular structure, however, other alternative structures may also be utilized. The nail polish creator 4700 may be utilized by a user 4701 that may be utilizing a user device 4702 to interact with the nail polish creator 4700. The user device 4702 may include a memory 4703 that stores instructions and a processor 4704 that executes the instructions from the memory 4703 to perform the operations of the user device 4702. The processor 4704 may be software, hardware, or a combination of software and hardware. In certain embodiments, the user device 4702 may include a software application or other functionality to enable the user device to control the nail polish creator 4700. For example, the application may include a user interface that may be displayed on the user device 4702 and may be configured to receive inputs and/or selections from the user 4701. The application may enable the user 4701 to activate the nail polish creator 4700, turn off the nail polish creator 4700, select a nail polish color for the nail polish creator 4700 to create, store selections of nail polish colors, view a palette of possible nail polish colors, transmit selected nail polish colors to other users, post information associated with the nail polish to a social media application or website, activate the spectrometer 112, activate or deactivate a cleaning unit 122 that may be housed in the nail polish creator 4700, activate or deactivate a mixer assembly 124 that may be housed in the nail polish creator 4700, perform any of the operations disclosed herein, or any combination thereof.

The user device 4702 may be communicatively linked with the nail polish creator 4700, such as via a communications network 4710. The communications network 4710 may be any type of network and may be configured to transmit, generate, and receive any information and data that traverses the user device 4702 and the nail polish creator 4700. In one embodiment, the communications network 4710 may include any number of servers and may support any type of network capabilities, such as capabilities to facilitate communications between user device 4702 and nail polish creator 4700. The communications network 4710 may also include and be connected to a cloud computing network, a content delivery network, a wireless network, an ethernet network, a satellite network, a broadband network, a cellular network, a private network, a cable network, the Internet, an internet protocol network, a short-range wireless network (e.g. Bluetooth), a fiber optic network, a WiFi network, or any combination thereof.

The nail polish creator 4700 may be utilized to create nail polishes for the user 4701 and may include one or more stands 4720 to support the nail polish creator 4700. In FIGS. 47-54, the stands 4720 are illustratively shown as being positioned underneath the bottom of the nail polish creator 4700. The stands 4720 may be made out of any non-slip material to prevent the nail polish creator 4700 from being moved when being operated. Additionally, the nail polish creator 4700 may include an area 4725 where a user 4701 may place an empty nail polish bottle 4730 so that it may be filled with nail polish. The area 4725 may include an assembly 4735, which may be configured to grasp onto the nail polish bottle 4730, such as via an interference fit, by using clamps, or any other fastening structure.

The nail polish creator 4700 may also include a door 4740, which may be utilized to cover the area 4725, such as when the nail polish bottle 4730 is positioned in the area 4725. The door 4740 may be opaque, however, in certain embodiments, the door 4740 may be transparent so that the user 4701 may still see the nail polish bottle 4730 even after the door 4740 is covering the area 4725. The door 4740 may be configured to slide out of a slot 4742 and pushed upwards against the area 4725 to cover the area 4725, such as by using a hinge mechanism on a portion of the door 4740. The door 4740 may be locked into place such as by using a fastening mechanism, such as lock 4745. The door 4740 may be unlocked by unlocking the lock 4745 and then sliding the door 4740 back into the slot 4742.

Additionally, the nail polish creator 4700 may include a memory 4747 that stores instructions and a processor 4749 that executes the instructions from the memory 4747 to perform the operations of the nail polish creator 4700. In certain embodiments, the processor 4749 may be software, hardware, or a combination of software and hardware.

Also, the nail polish creator 4700 may include an interface 4750, which may include one or more lights 4755. The lights 4755 may be utilized to indicate which mode the nail polish creator 4700 is currently in. For example, one light 4755 may be turned green when the nail polish creator 4700 is on and ready to be used, another light 4755 may be turned red when the nail polish creator 47 is creating the nail polish, another light 4755 may be turned yellow if a cleaning unit 122 of the nail polish creator 4700 is in use, another light 4755 may be turned blue when a mixer assembly 124 of the nail polish creator 4700 is in use, another light 4755 may be configured to blink when the nail polish creator 4700 receives signals from the user device 4702. Any colors or blinking may be utilized for any of the functionality described above. When the nail polish creator 4700 is off, the lights 4755 may be turned off. In certain embodiments, the interface 4750 may include a touch screen for inputting nail polish color selections or perform any other function of the nail polish creator 4700. The interface 4750 may also display a color selection that is received from the user device 4702.

The nail polish creator 4700 may include one or more storages 4760, which may be utilized to store nail polish bottles 4730, pigment bottles 136, pigment cartridges 5500, or any other desired item. Illustratively, the storages 4760 are shown as being located on the sides of the nail polish creator 4700, however, the storage 4760 may be located on any suitable location of the nail polish creator 4700. The nail polish creator 4700 may also include openings 4765 on either side of the nail polish creator 4700 that may be utilized by the user 4701 to carry the nail polish creator 4700. In certain embodiments, the openings 4765 may include grips 4766 that may be utilized to assist the user 4701 to hold onto the nail polish creator 4700 more easily. The openings 4765 may be configured to include handles or other structures to assist the user 4701 to carry the nail polish creator 4700. In certain embodiments, a grip or handle may be positioned near the openings 4765 to both the right and left sides of the nail polish creator 4700, and may be configured to rotate from the front of the nail polish creator 4700 to the back of the nail polish creator 4700.

In certain embodiments, the nail polish creator 4700 may include a cover 4768, which may be opaque or transparent depending on whether the user 4701 would like to see the internals of the nail polish creator 4700. The cover 4768 may be attached using a hinge mechanism along at least one of the ends of the cover 4768. The cover 4768 may be closed to protect the internal components of the nail polish creator 4700 and may be opened to access one or more pigment cartridge holders 4775 or other components of the nail polish creator 4700. The pigment cartridge holders 4775 may include receptacles 4776 that may be utilized to receive one or more pigment cartridges 5500 that contain the pigments needed to make a desired nail polish. The user 4701 may insert or remove pigment cartridges 5500 from the pigment cartridge holders 4775 as needed. The pigment cartridge holders 4775 and receptacles may have any suitable shape to accommodate the pigment cartridges 5500.

The nail polish creator 4700 may also include an on switch 4780 and an off switch 4785, which may be utilized to turn the nail polish creator 4700 on or off respectively. In certain embodiments, the nail polish creator 4700 may include a single switch to turn the nail polish creator 4700 on or off. The switches 4780, 4785 may be positioned at any suitable location on the nail polish creator 4700. Also, the nail polish creator 4700 may include a connection site 4788 that may include one or more ports 4789. In certain embodiments, the ports 4789 may be universal serial bus ports or any other type of port that may serve as a means to connect the nail polish creator 4700 to the user device 4702. The ports 4789 may enable the user device 4702 to charge and/or to enable the nail polish creator 4700 and user device 4702 to transmit data back and forth between each other. The nail polish creator 4700 may also include a plug for providing plugging into a socket so as to provide power to the nail polish creator 4700. In some embodiments, the nail polish creator 4700 may be powered by one or more batteries, which may, for example, be accessed by opening door 4790. In certain embodiments, wiring for a plug may also reside behind the door 4790.

Figure 56:
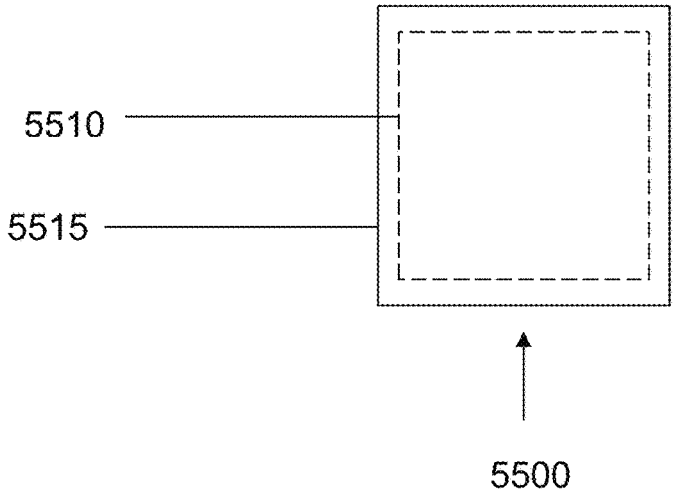
FIG. 56 illustrates a top view of the pigment cartridge of FIG. 55.
Figure 55:
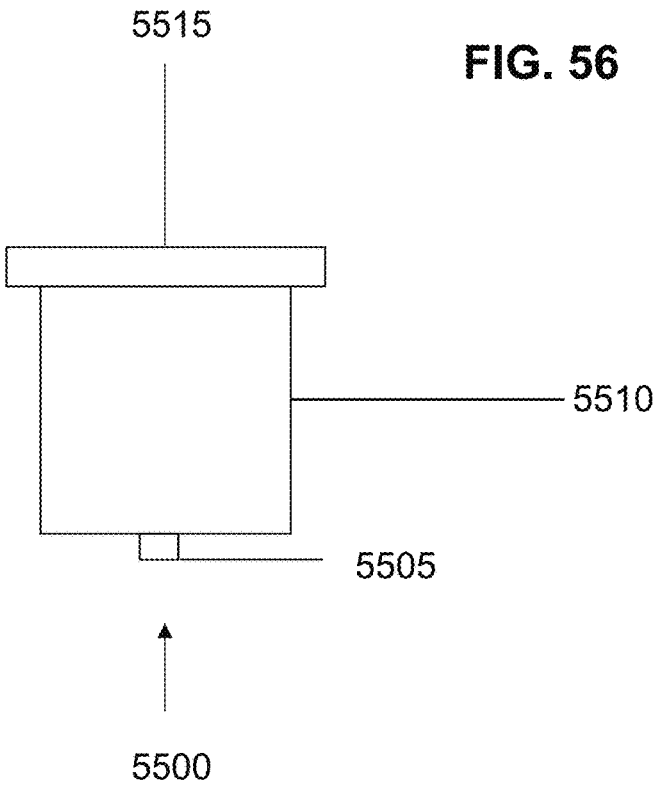
FIG. 55 illustrates a front view of a pigment cartridge to be utilized in the portable nail polish creator of FIG. 47.
Figure 57:
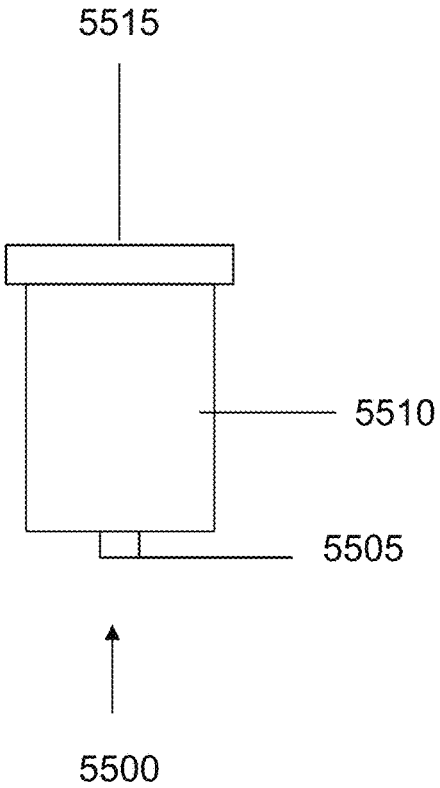
FIG. 57 illustrates a side view of the pigment cartridge of FIG. 55.

Referring now also to FIGS. 55-57, further details relating to the pigment cartridges 5500 are shown. The pigment cartridges 5500 may include a top 5510 that the user 4701 can easily grab onto, a pigment container 5510 that contains one or more pigments, and a pigment cartridge tip 5505 through which the pigment(s) may be dispensed. The pigment cartridges 5500 may be configured to have a size and shape to fit into the pigment cartridge holders 4775 and may be easily inserted into the nail polish creator 4700 or removed from the nail polish creator 4700.

Furthermore, the nail polish creator 4700 may also include any of the components from portable nail polish creator 100 and/or portable nail polish creator 4100. For example, the nail polish creator 4700 may include the arm assembly 109 for moving a nail polish bottle back and forth during a nail polish creation process. The nail polish creator 4700 may also optionally include a spectrometer 112 for scanning colors of various objects, a storage area 114, a vent 116, a pigment holding unit 118, pigment holders 120, a cleaning unit 122, and a mixer assembly 124.

Figure 58:
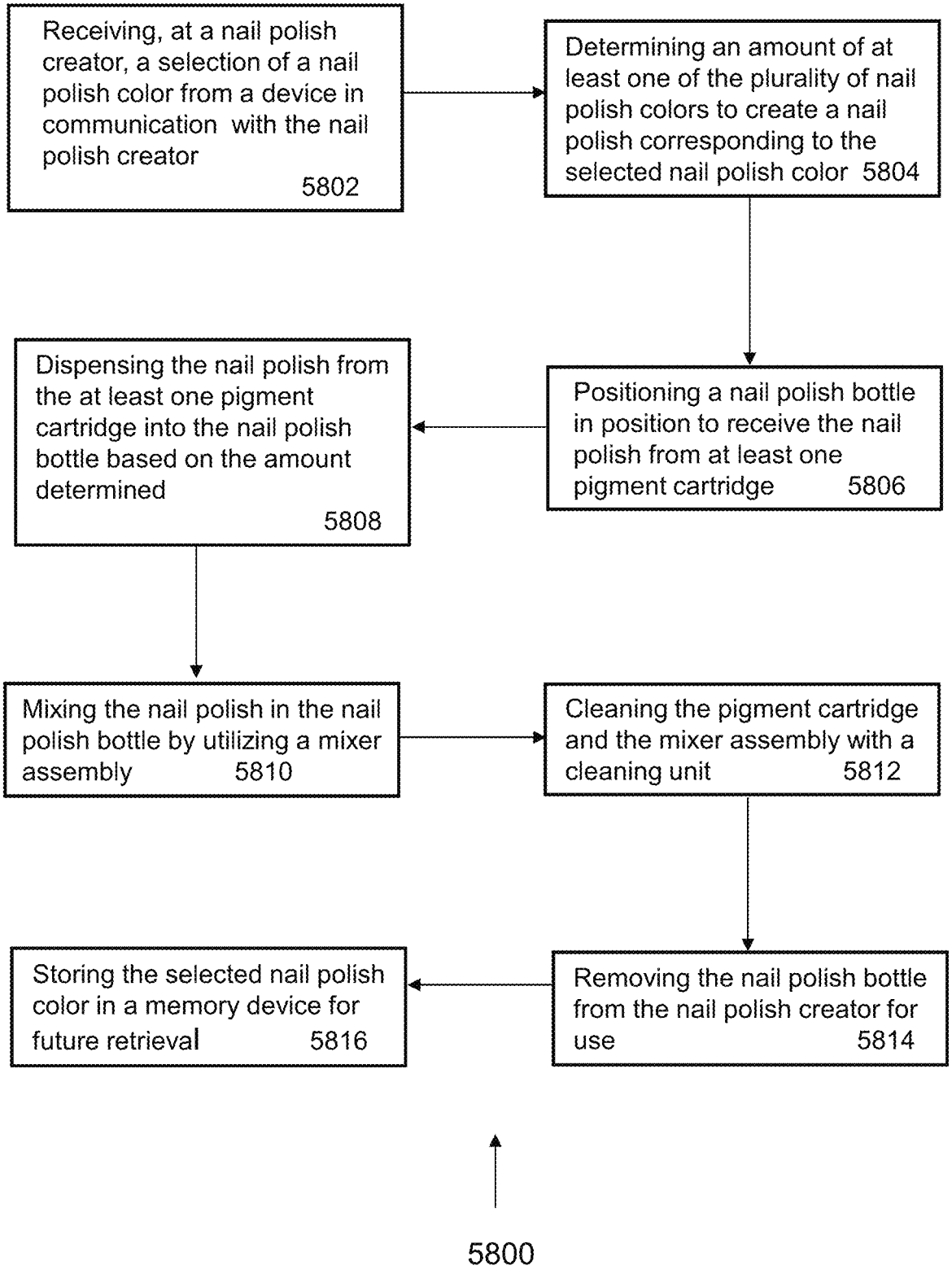
FIG. 58 is a flow diagram illustrating an exemplary embodiment of a method for utilizing a portable nail polish creator.

Referring now to FIG. 58, an illustrative method 5800 for utilizing a nail polish creator, such as nail polish creator 4700, is schematically illustrated. In certain embodiments, portable nail polish creator 100 may be utilized for performing method 5800. Notably, the method 5800 is not intended to be limited to the apparatuses and components described above or illustrated in the drawings. The method 5800 can begin at step 5802, which may include receiving a selection of a nail polish color from a plurality of nail polish colors. The selection may be received from a device, such as user device 4702, by utilizing a wired or wireless communication link between the device and the nail polish creator 4700. In certain embodiments, the user device 4702 may transmit the selection of the nail polish color to the nail polish creator 4700 via an application executing on the user device 4702. At step 5804, the method 5800 may include determining an amount of at least one of the plurality of nail polish colors to be used to create a nail polish corresponding to the selected nail polish color. The determination of the amount may be performed by the electronic processor 4749 described above or any other electronic processor. At step 5806, the method 5800 may include positioning a nail polish bottle, such as nail polish bottle 4730, in position to receive the nail polish from at least one pigment cartridge, such as pigment cartridge 5500. In certain embodiments, the nail polish may be received from the pigment bottles 136. In an embodiment, the nail polish bottle may be positioned using an assembly, such as assembly 4735 and/or arm assembly 109.

The method 5800 may also include, at step 5608, dispensing the determined amounts of the nail polish from each of the pigment cartridges 5500 containing the colors needed to create the selected color into the nail polish bottle 4730. Once all of the pigments are successfully dispensed into the nail polish bottle 4730, the method 5800 may include mixing the nail polish in the nail polish bottle 4730 by utilizing a mixer assembly, such as the mixer assembly 124. In certain embodiments, instead of using a mixer assembly 124 to mix the nail polish, the user 4701 may simply remove the nail polish bottle 4730 from the assembly 4735 and shake the nail polish bottle 4730 to mix the nail polish herself. At step 5812, the method 5800 may include cleaning the pigment cartridges 5500 and/or the mixer assembly 124 with a cleaning unit, such as cleaning unit 122. After the mixing is completed, the individual may then remove the nail polish bottle 4730 from the nail polish creator 4700 if the mixer assembly 124 is used and then use the nail polish as needed at step 5814. If the mixer assembly 124 is not used and the user 4701 mixes the nail polish herself, the user 4701 may use the nail polish after mixing the nail polish herself. At step 5816, the method 5800 may include storing the selected nail polish color in a memory device, such as memory 4747, for future retrieval from the nail polish creator 4700.

In an embodiment, the method 5800 may further include providing a color selection option from a set of colors, an option to create a customized color, an option to select a previously saved color, and an option to utilize the spectrometer 112 to scan a color of an object via the interface 4750. The method 5800 may also include scanning a color of an object by utilizing the spectrometer 112. The color of the object scanned may then be transmitted to the electronic processor 4749, which can determine the amounts of one or more nail polish colors to create the selected nail polish color based on the color of the object scanned Notably, the method 5800 may incorporate any of the functionality or features described for the various embodiments of the portable nail polish creator 100, nail polish creator 4700, or the portable nail polish creator 4100 described herein and is not intended to be limited to the description above.

Upon reviewing the aforementioned embodiments, it would be evident to an artisan with ordinary skill in the art that said embodiments can be modified, reduced, or enhanced without departing from the scope and spirit of the claims described below.

Figure 59:
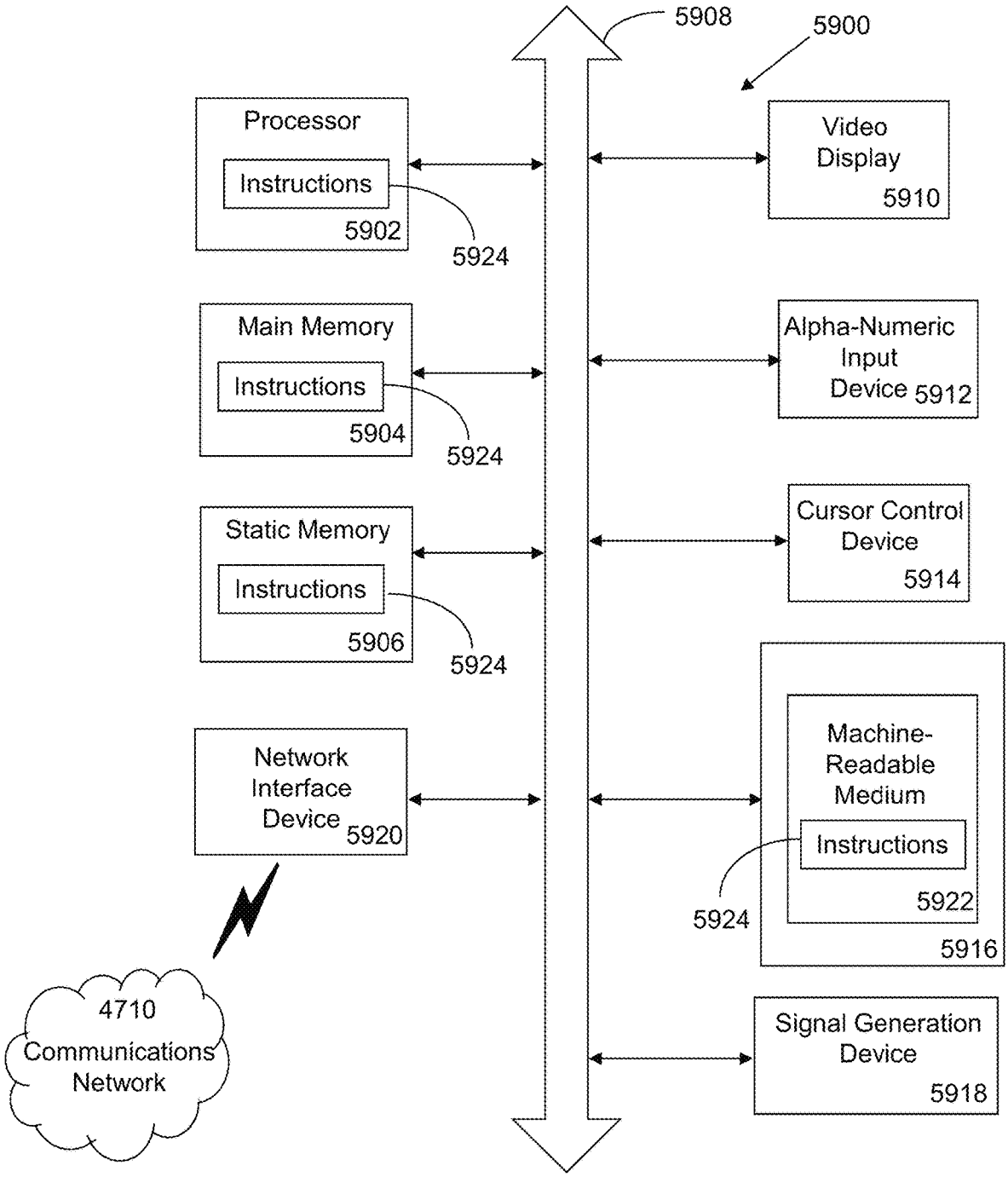
FIG. 59 is a schematic diagram of a machine in the form of a computer system within which a set of instructions, when executed, may cause the machine to perform any one or more of the methodologies or operations of a portable nail polish creator.

Referring now also to FIG. 59, at least a portion of the methodologies and techniques described with respect to the exemplary embodiments of the portable nail polish creator 100, nail polish creator 4700, or both, can incorporate a machine, such as, but not limited to, computer system 5900, or other computing device within which a set of instructions, when executed, may cause the machine to perform any one or more of the methodologies or functions discussed above. The machine may be configured to facilitate various operations conducted by portable nail polish creator 100, portable nail polish creator 4100, nail polish creator 4700, or a combination thereof. For example, the machine may be configured to, but is not limited to, assist the portable nail polish creator 100, portable nail polish creator 4100, nail polish creator 4700, or a combination thereof, by providing processing power to assist with processing loads experienced by the portable nail polish creator 100, portable nail polish creator 4100, nail polish creator 4700, or a combination thereof, by providing storage capacity for storing instructions or data associated with the portable nail polish creator 100, portable nail polish creator 4100, nail polish creator 4700, or a combination thereof, or by assisting with any other operations conducted by or within the portable nail polish creator 100, portable nail polish creator 4100, nail polish creator 4700, or a combination thereof.

In some embodiments, the machine may operate as a standalone device. In some embodiments, the machine may be connected (e.g., using communications network 4710, another network, or a combination thereof) to and assist with operations performed by other machines, such as, but not limited to, the user device 4702, any other component disclosed herein, or any combination thereof. The machine may be connected with any component associated with the portable nail polish creator 100, nail polish creator 4700, or both. In a networked deployment, the machine may operate in the capacity of a server or a client user machine in a server-client user network environment, or as a peer machine in a peer-to-peer (or distributed) network environment. The machine may comprise a server computer, a client user computer, a personal computer (PC), a tablet PC, a laptop computer, a desktop computer, a control system, a network router, switch or bridge, or any machine capable of executing a set of instructions (sequential or otherwise) that specify actions to be taken by that machine. Further, while a single machine is illustrated, the term "machine" shall also be taken to include any collection of machines that individually or jointly execute a set (or multiple sets) of instructions to perform any one or more of the methodologies discussed herein.

The computer system 5900 may include a processor 5902 (e.g., a central processing unit (CPU), a graphics processing unit (GPU, or both), a main memory 5904 and a static memory 5906, which communicate with each other via a bus 5908. The computer system 5900 may further include a video display unit 5910, which may be, but is not limited to, a liquid crystal display (LCD), a flat panel, a solid state display, or a cathode ray tube (CRT). The computer system 5900 may include an input device 5912, such as, but not limited to, a keyboard, a cursor control device 5914, such as, but not limited to, a mouse, a disk drive unit 5916, a signal generation device 5918, such as, but not limited to, a speaker or remote control, and a network interface device 5920.

The disk drive unit 5916 may include a machine-readable medium 5922 on which is stored one or more sets of instructions 5924, such as, but not limited to, software embodying any one or more of the methodologies or functions described herein, including those methods illustrated above. The instructions 5924 may also reside, completely or at least partially, within the main memory 5904, the static memory 5906, or within the processor 5902, or a combination thereof, during execution thereof by the computer system 5900. The main memory 5904 and the processor 5902 also may constitute machine-readable media.

Dedicated hardware implementations including, but not limited to, application specific integrated circuits, programmable logic arrays and other hardware devices can likewise be constructed to implement the methods described herein. Applications that may include the apparatus and systems of various embodiments broadly include a variety of electronic and computer systems. Some embodiments implement functions in two or more specific interconnected hardware modules or devices with related control and data signals communicated between and through the modules, or as portions of an application-specific integrated circuit. Thus, the example system is applicable to software, firmware, and hardware implementations.

In accordance with various embodiments of the present disclosure, the methods described herein are intended for operation as software programs running on a computer processor. Furthermore, software implementations can include, but not limited to, distributed processing or component/object distributed processing, parallel processing, or virtual machine processing can also be constructed to implement the methods described herein.

The present disclosure contemplates a machine-readable medium 5922 containing instructions 5924 so that a device connected to the communications network 4710, other network, or a combination thereof, can send or receive voice, video or data, and to communicate over the communications network 4710, other network, or both, using the instructions. The instructions 5924 may further be transmitted or received over the communications network 4710, other network, or a combination thereof, via the network interface device 5920.

While the machine-readable medium 5922 is shown in an example embodiment to be a single medium, the term "machine-readable medium" should be taken to include a single medium or multiple media (e.g., a centralized or distributed database, and/or associated caches and servers) that store the one or more sets of instructions. The term "machine-readable medium" shall also be taken to include any medium that is capable of storing, encoding or carrying a set of instructions for execution by the machine and that causes the machine to perform any one or more of the methodologies of the present disclosure.

The terms "machine-readable medium," "machine-readable device," or "computer-readable device" shall accordingly be taken to include, but not be limited to: memory devices, solid-state memories such as a memory card or other package that houses one or more read-only (non-volatile) memories, random access memories, or other re-writable (volatile) memories; magneto-optical or optical medium such as a disk or tape; or other self-contained information archive or set of archives is considered a distribution medium equivalent to a tangible storage medium. The "machine-readable medium," "machine-readable device," or "computer-readable device" may be non-transitory, and, in certain embodiments, may not include a wave or signal per se. Accordingly, the disclosure is considered to include any one or more of a machine-readable medium or a distribution medium, as listed herein and including art-recognized equivalents and successor media, in which the software implementations herein are stored.

The illustrations of arrangements described herein are intended to provide a general understanding of the structure of various embodiments, and they are not intended to serve as a complete description of all the elements and features of apparatus and systems that might make use of the structures described herein. Other arrangements may be utilized and derived therefrom, such that structural and logical substitutions and changes may be made without departing from the scope of this disclosure. Figures are also merely representational and may not be drawn to scale. Certain proportions thereof may be exaggerated, while others may be minimized. Accordingly, the specification and drawings are to be regarded in an illustrative rather than a restrictive sense.

Thus, although specific arrangements have been illustrated and described herein, it should be appreciated that any arrangement calculated to achieve the same purpose may be substituted for the specific arrangement shown. This disclosure is intended to cover any and all adaptations or variations of various embodiments and arrangements of the invention. Combinations of the above arrangements, and other arrangements not specifically described herein, will be apparent to those of skill in the art upon reviewing the above description. Therefore, it is intended that the disclosure not be limited to the particular arrangement(s) disclosed as the best mode contemplated for carrying out this invention, but that the invention will include all embodiments and arrangements falling within the scope of the appended claims.

The foregoing is provided for purposes of illustrating, explaining, and describing embodiments of this invention. Modifications and adaptations to these embodiments will be apparent to those skilled in the art and may be made without departing from the scope or spirit of this invention. Upon reviewing the aforementioned embodiments, it would be evident to an artisan with ordinary skill in the art that said embodiments can be modified, reduced, or enhanced without departing from the scope and spirit of the claims described below.

The Abstract of the Disclosure is provided to comply with 37 C.F.R. § 1.72(b), requiring an abstract that will allow the reader to quickly ascertain the nature of the technical disclosure. It is submitted with the understanding that it will not be used to interpret or limit the scope or meaning of the claims.

What is claimed is:

1. A nail polish creator comprising:

a housing;

a memory that stores instructions;

an electronic processor that executes the instructions to perform operations, the operations comprising:

receiving a selection of a nail polish color from a device communicatively linked with the nail polish creator, wherein the selection of the nail polish color is received from an application executing on the device that activates the nail polish creator, wherein activating the nail polish creator comprises turning on the nail polish creator using the application executing on the device, and wherein the application is configured to transmit the selection of the nail polish color to a different device of a first user that is different from a second user utilizing the device that provided the selection of the nail polish color; and determining an amount of at least one of a plurality of nail polish colors needed to create a nail polish corresponding to the selection;

an assembly that receives a nail polish bottle so that the nail polish bottle is in a position to receive the nail polish; and a cover attached to a top portion of the housing of the nail polish creator, wherein the cover is positioned between opposing sides of the housing of the nail polish creator, wherein the cover is configured to be opened so as to enable access to a pigment cartridge holder of the nail polish creator.

2. The nail polish creator of claim 1, further comprising an arm assembly, wherein the operations performed by the electronic processor further comprise transmitting a signal to move the arm assembly and causing the nail polish to be created based on the amount determined.

3. The nail polish creator of claim 1, further comprising a wireless communication link between the device and the nail polish creator, wherein receiving the selection of the nail polish color from the device communicatively linked with the nail polish creator further comprises receiving the selection at the electronic processor via a wireless communication between the device and the electronic processor over the wireless communication link.

4. The nail polish creator of claim 1, wherein the pigment cartridge holder includes a receptacle for receiving a pigment cartridge including a pigment or accessory to be dispensed into the nail polish bottle.

5. The nail polish creator of claim 1, further comprising a spectrometer configured to scan a color of an object placed in a vicinity of the spectrometer.

6. The nail polish creator of claim 1, wherein the device further comprises an interface, wherein the operations performed by the electronic processor further comprise storing the selection of the nail polish color in the memory based on an input received from the interface of the device.

7. The nail polish creator of claim 1, wherein the device further comprises an interface, wherein the operations performed by the electronic processor further comprise transmitting, to the device for display on the interface, information that indicates the amount of the at least one of the plurality of nail polish colors determined to be needed to create the nail polish corresponding to the selection.

8. The nail polish creator of claim 1, further comprising a mixer assembly, wherein the mixer assembly further comprises a motor, a telescoping handle, and a mixer blade, wherein the motor of the mixer assembly is configured to turn a mixer blade so as to mix the nail polish.

9. The nail polish creator of claim 1, further comprising a storage location for storing at least one of pigment cartridges and the nail polish bottle.

10. A nail polish creator comprising:

a housing;

a memory that stores instructions;

an electronic processor that executes the instructions to perform operations, the operations comprising:

receiving a selection of a nail polish color from a device communicatively linked with the nail polish creator, wherein the selection of the nail polish color is received from an application executing on the device that activates the nail polish creator, wherein activating the nail polish creator comprises turning on the nail polish creator using the application executing on the device, and wherein the application is configured to transmit the selection of the nail polish color to a different device of a first user that is different from a second user utilizing the device that provided the selection of the nail polish color; and determining an amount of at least one of a plurality of nail polish colors needed to create a nail polish corresponding to the selection;

an assembly that receives a nail polish bottle so that the nail polish bottle is in a position to receive the nail polish;

a cover attached to a top portion of the housing of the nail polish creator, wherein the cover is positioned between opposing sides of the housing of the nail polish creator, wherein the cover is configured to be opened so as to enable access to a pigment cartridge holder of the nail polish creator;

a pair of openings on either side of the nail polish creator that enable the nail polish creator to be carried; and the pigment cartridge holder, wherein the pigment cartridge holder includes a receptacle for receiving a pigment cartridge including a pigment of the nail polish that is to be dispensed into the nail polish bottle.

11. The nail polish creator of claim 10, further comprising a mixer assembly for mixing the nail polish after the nail polish is received in the nail polish bottle.

12. The nail polish creator of claim 10, further comprising a wireless communication link between the device and the nail polish creator, wherein receiving the selection of the nail polish color from the device communicatively linked with the nail polish creator further comprises receiving the selection, via the wireless communication link, at the electronic processor via a wireless communication with the application executing on the device and the electronic processor.

13. The nail polish creator of claim 10, wherein the device further comprises an interface, wherein the operations performed by the electronic processor further comprise storing the selection of the nail polish color based on an input received from the interface of the device.

14. The nail polish creator of claim 10, further comprising an interface for displaying the selection of the nail polish color.

15. The nail polish creator of claim 10, wherein the device further comprises an interface, wherein the operations performed by the electronic processor further comprise transmitting, to the device for display on the interface, information that indicates the amount of the at least one of the plurality of nail polish colors determined to be needed to create the nail polish corresponding to the selection.

16. The nail polish creator of claim 10, wherein the device further comprises an interface, wherein the operations performed by the electronic processor further comprise receiving an instruction from the device via the interface to create the nail polish.

17. The nail polish creator of claim 10, further comprising a storage compartment for storing an object, wherein the storage compartment resides within the housing of the nail polish creator.

18. A nail polish creator comprising:

a housing;

a memory that stores instructions;

an electronic processor that executes the instructions to perform operations, the operations comprising:

receiving a selection of a nail polish color from a device communicatively linked with the nail polish creator, wherein the selection of the nail polish color is received from an application executing on the device that activates the nail polish creator, wherein activating the nail polish creator comprises turning on the nail polish creator using the application executing on the device, and wherein the application is configured to transmit the selection of the nail polish color to a different device of a first user that is different from a second user utilizing the device that provided the selection of the nail polish color; and determining an amount of at least one of a plurality of nail polish colors needed to create a nail polish corresponding to the selection;

an assembly that receives a nail polish bottle so that the nail polish bottle is in a position to receive the nail polish; and a cover attached to a top portion of the housing of the nail polish creator via a hinge mechanism, wherein the cover is positioned between opposing sides of the housing of the nail polish creator, wherein the cover is configured to be opened so as to enable access to a pigment cartridge holder of the nail polish creator.

19. The nail polish creator of claim 18, further comprising a cleaning unit configured to clean a component of the nail polish creator.

20. The nail polish creator of claim 18, further comprising a mixer assembly for mixing the nail polish after the nail polish is received in the nail polish bottle.

* * * * *